US010236015B2

(12) United States Patent
Yamamoto et al.

(10) Patent No.: US 10,236,015 B2
(45) **Date of Patent: *Mar. 19, 2019**

(54) ENCODING DEVICE AND METHOD, DECODING DEVICE AND METHOD, AND PROGRAM

(71) Applicant: Sony Corporation, Tokyo (JP)

(72) Inventors: Yuki Yamamoto, Tokyo (JP); Toru Chinen, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/684,340

(22) Filed: Aug. 23, 2017

(65) Prior Publication Data

US 2017/0352365 A1 Dec. 7, 2017

Related U.S. Application Data

(63) Continuation of application No. 15/357,877, filed on Nov. 21, 2016, now Pat. No. 9,767,824, which is a (Continued)

(30) Foreign Application Priority Data

Oct. 15, 2010 (JP) ..... 2010-232106

(51) Int. Cl.
*G10L 21/0388* (2013.01)
*G10L 25/21* (2013.01)

(Continued)

(52) U.S. Cl.
CPC ..... *G10L 21/0388* (2013.01); *G10L 19/008* (2013.01); *G10L 25/18* (2013.01); *G10L 25/21* (2013.01); *G10L 19/0208* (2013.01)

(58) Field of Classification Search
CPC ..... G10L 21/0388; G10L 19/008; G10L 19/0208; G10L 25/18; G10L 25/21
See application file for complete search history.

(56) References Cited

U.S. PATENT DOCUMENTS 4,628,529 A 12/1986 Borth et al.
5,687,157 A 11/1997 Imai et al.

(Continued)

FOREIGN PATENT DOCUMENTS

CA 2775387 A1 4/2011
CN 1328707 C 7/2007

(Continued)

OTHER PUBLICATIONS

Baumgarte, F., Enhanced Metadata for Dynamic Range Compression, MPEG Meeting, Apr. 2013, ISO/IEC JTC1/SC29/WG11 MPEG 2013, No. m28901, 10 pages.

(Continued)

*Primary Examiner* — David Ton
(74) *Attorney, Agent, or Firm* — Wolf, Greenfield & Sacks, P.C.

(57) ABSTRACT

The present invention relates to an encoding device and method, and a decoding device and method, and a program which enable music signals to be played with higher sound quality by expanding a frequency band.

A band pass filter divides an input signal into multiple subband signals, a feature amount calculating circuit calculates feature amount using at least any one of the divided multiple subband signals and the input signal, a high-frequency subband power estimating circuit calculates an estimated value of high-frequency subband power based on the calculated feature amount, and a high-frequency signal generating circuit generates a high-frequency signal component based on the multiple subband signals divided by the band pass filter and the estimated value of the high-fre- (Continued)

quency subband power calculated by the high-frequency subband power estimating circuit. A frequency band expanding device expands the frequency band of the input signal using the high-frequency signal component generated by the high-frequency signal generating circuit. The present invention may be applied to a frequency band expanding device, encoding device, decoding device, and so forth, for example.

3 Claims, 34 Drawing Sheets

Related U.S. Application Data continuation of application No. 14/861,734, filed on Sep. 22, 2015, now Pat. No. 9,536,542, which is a continuation of application No. 13/877,192, filed as application No. PCT/JP2011/072957 on Oct. 5, 2011, now Pat. No. 9,177,563.

(51) Int. Cl.

| | |
|---|---|
| ***G10L 25/18*** | (2013.01) |
| ***G10L 19/008*** | (2013.01) |
| ***G10L 19/02*** | (2013.01) |

(56) References Cited

U.S. PATENT DOCUMENTS

| | | | |
|---|---|---|---|
| 6,073,100 | A | 6/2000 | Goodridge, Jr. |
| 6,415,251 | B1 | 7/2002 | Oikawa et al. |
| 6,708,145 | B1 | 3/2004 | Liljeryd et al. |
| 6,829,360 | B1 | 12/2004 | Iwata et al. |
| 6,895,375 | B2 | 5/2005 | Malah et al. |
| 7,003,451 | B2 | 2/2006 | Kjorling et al. |
| 7,069,212 | B2 | 6/2006 | Tanaka et al. |
| 7,139,702 | B2 | 11/2006 | Tsushima et al. |
| 7,242,710 | B2 | 7/2007 | Ekstrand |
| 7,246,065 | B2 | 7/2007 | Tanaka et al. |
| 7,283,955 | B2 | 10/2007 | Liljeryd et al. |
| 7,318,035 | B2 | 1/2008 | Andersen et al. |
| 7,330,812 | B2 | 2/2008 | Ding |
| 7,337,118 | B2 | 2/2008 | Davidson et al. |
| 7,447,631 | B2 | 11/2008 | Truman et al. |
| 7,899,676 | B2 | 3/2011 | Honma et al. |
| 7,941,315 | B2 | 5/2011 | Matsuo |
| 7,974,847 | B2 | 7/2011 | Kjoerling et al. |
| 7,983,424 | B2 | 7/2011 | Kjorling et al. |
| 7,991,621 | B2 | 8/2011 | Oh et al. |
| 8,019,614 | B2 | 9/2011 | Takagi et al. |
| 8,032,387 | B2 | 10/2011 | Davidson et al. |
| 8,050,933 | B2 | 11/2011 | Davidson et al. |
| 8,063,809 | B2 | 11/2011 | Liu et al. |
| 8,078,474 | B2 | 12/2011 | Vos et al. |
| 8,144,804 | B2 | 3/2012 | Chinen et al. |
| 8,145,475 | B2 | 3/2012 | Kjoerling et al. |
| 8,244,524 | B2 | 8/2012 | Shirakawa et al. |
| 8,260,609 | B2 | 9/2012 | Rajendran et al. |
| 8,321,229 | B2 | 11/2012 | Choo et al. |
| 8,332,210 | B2 | 12/2012 | Nilsson et al. |
| 8,340,213 | B2 | 12/2012 | Chinen et al. |
| 8,346,566 | B2 | 1/2013 | Kjoerling et al. |
| 8,352,249 | B2 | 1/2013 | Chong et al. |
| 8,364,474 | B2 | 1/2013 | Honma et al. |
| 8,370,133 | B2 | 2/2013 | Taleb et al. |
| 8,386,243 | B2 | 2/2013 | Nilsson et al. |
| 8,407,046 | B2 | 3/2013 | Gao |
| 8,423,371 | B2 | 4/2013 | Yamanashi et al. |
| 8,433,582 | B2 | 4/2013 | Ramabadran et al. |
| 8,463,599 | B2 | 6/2013 | Ramabadran et al. |
| 8,463,602 | B2 | 6/2013 | Oshikiri |
| 8,484,036 | B2 | 7/2013 | Vos |
| 8,498,344 | B2 | 7/2013 | Wilson et al. |
| 8,527,283 | B2 | 9/2013 | Jasiuk et al. |
| 8,560,330 | B2 | 10/2013 | Gao |
| 8,688,441 | B2 | 4/2014 | Ramabadran et al. |
| 8,793,126 | B2 | 7/2014 | Gao |
| 8,818,541 | B2 | 8/2014 | Villemoes et al. |
| 8,949,119 | B2 | 2/2015 | Yamamoto et al. |
| 8,972,248 | B2 | 3/2015 | Otani et al. |
| 9,047,875 | B2 | 6/2015 | Gao |
| 9,177,563 | B2 | 11/2015 | Yamamoto et al. |
| 9,208,795 | B2 | 12/2015 | Yamamoto et al. |
| 9,294,062 | B2 | 3/2016 | Hatanaka et al. |
| 9,361,900 | B2 | 6/2016 | Yamamoto et al. |
| 9,390,717 | B2 | 7/2016 | Yamamoto et al. |
| 9,406,306 | B2 | 8/2016 | Yamamoto et al. |
| 9,406,312 | B2 | 8/2016 | Yamamoto et al. |
| 9,437,197 | B2 | 9/2016 | Honma et al. |
| 9,437,198 | B2 | 9/2016 | Hatanaka et al. |
| 9,536,542 | B2 | 1/2017 | Yamamoto et al. |
| 9,542,952 | B2 | 1/2017 | Hatanaka et al. |
| 9,583,112 | B2 | 2/2017 | Yamamoto et al. |
| 9,659,573 | B2 | 5/2017 | Yamamoto et al. |
| 9,679,580 | B2 | 6/2017 | Yamamoto et al. |
| 9,691,410 | B2 | 6/2017 | Yamamoto et al. |
| 9,767,814 | B2 | 9/2017 | Yamamoto et al. |
| 9,767,824 | B2 | 9/2017 | Yamamoto et al. |
| 9,842,603 | B2 | 12/2017 | Yamamoto et al. |
| 9,875,746 | B2 | 1/2018 | Honma et al. |
| 10,083,700 | B2 | 9/2018 | Hatanaka et al. |
| 2002/0128835 | A1 | 9/2002 | Iso |
| 2003/0033142 | A1 | 2/2003 | Murashima |
| 2003/0093271 | A1 | 5/2003 | Tsushima et al. |
| 2003/0093278 | A1 | 5/2003 | Malah |
| 2003/0187663 | A1 | 10/2003 | Truman et al. |
| 2003/0233234 | A1 | 12/2003 | Truman et al. |
| 2004/0028244 | A1 | 2/2004 | Tsushima et al. |
| 2005/0004793 | A1 | 1/2005 | Ojala et al. |
| 2005/0060146 | A1 | 3/2005 | Oh |
| 2005/0096917 | A1 | 5/2005 | Kjorling et al. |
| 2005/0143985 | A1 | 6/2005 | Sung et al. |
| 2005/0171785 | A1 | 8/2005 | Nomura et al. |
| 2005/0267763 | A1 | 12/2005 | Ojanpera |
| 2006/0031075 | A1 | 2/2006 | Oh et al. |
| 2006/0106620 | A1 | 5/2006 | Thompson et al. |
| 2006/0136199 | A1 | 6/2006 | Nongpiur et al. |
| 2006/0251178 | A1 | 11/2006 | Oshikiri |
| 2006/0271356 | A1 | 11/2006 | Vos |
| 2007/0005351 | A1 | 1/2007 | Sathyendra et al. |
| 2007/0040709 | A1 | 2/2007 | Sung et al. |
| 2007/0071116 | A1 | 3/2007 | Oshikiri |
| 2007/0088541 | A1 | 4/2007 | Vos et al. |
| 2007/0150267 | A1 | 6/2007 | Honma et al. |
| 2007/0165869 | A1 | 7/2007 | Ojanpera |
| 2007/0174063 | A1 | 7/2007 | Mehrotra et al. |
| 2007/0219785 | A1 | 9/2007 | Gao |
| 2007/0282599 | A1 | 12/2007 | Choo et al. |
| 2007/0296614 | A1 | 12/2007 | Lee et al. |
| 2007/0299656 | A1 | 12/2007 | Son et al. |
| 2008/0027733 | A1 | 1/2008 | Oshikiri et al. |
| 2008/0056511 | A1 | 3/2008 | Zhang et al. |
| 2008/0097751 | A1 | 4/2008 | Tsuchinaga et al. |
| 2008/0120118 | A1 | 5/2008 | Choo et al. |
| 2008/0129350 | A1 | 6/2008 | Mitsufuji et al. |
| 2008/0140425 | A1 | 6/2008 | Shimada |
| 2008/0219344 | A1 | 9/2008 | Suzuki et al. |
| 2008/0253587 | A1 | 10/2008 | Une |
| 2008/0262835 | A1 | 10/2008 | Oshikiri |
| 2008/0263285 | A1 | 10/2008 | Sharma et al. |
| 2008/0270125 | A1 | 10/2008 | Choo et al. |
| 2009/0048846 | A1 | 2/2009 | Smaragdis et al. |
| 2009/0132238 | A1 | 5/2009 | Sudhakar |
| 2009/0157413 | A1 | 6/2009 | Oshikiri |
| 2009/0171673 | A1 | 7/2009 | Yamanashi et al. |
| 2009/0192792 | A1 | 7/2009 | Lee et al. |
| 2009/0228284 | A1 | 9/2009 | Moon et al. |
| 2009/0234657 | A1 | 9/2009 | Takagi et al. |
| 2009/0248407 | A1 | 10/2009 | Oshikiri |
| 2009/0265167 | A1 | 10/2009 | Ehara et al. |
| 2009/0271204 | A1 | 10/2009 | Tammi |
| 2009/0281811 | A1 | 11/2009 | Oshikiri et al. |
| 2010/0017198 | A1 | 1/2010 | Yamanashi et al. |

(56) References Cited

U.S. PATENT DOCUMENTS

| | | | |
|---|---|---|---|
| 2010/0063802 | A1 | 3/2010 | Gao |
| 2010/0063812 | A1 | 3/2010 | Gao |
| 2010/0083344 | A1 | 4/2010 | Schildbach et al. |
| 2010/0106494 | A1 | 4/2010 | Honma et al. |
| 2010/0106509 | A1 | 4/2010 | Shimada |
| 2010/0161323 | A1 | 6/2010 | Oshikiri |
| 2010/0198587 | A1 | 8/2010 | Ramabadran et al. |
| 2010/0198588 | A1 | 8/2010 | Sudo et al. |
| 2010/0217607 | A1 | 8/2010 | Neuendorf et al. |
| 2010/0222907 | A1 | 9/2010 | Hashimoto |
| 2010/0226498 | A1 | 9/2010 | Kino et al. |
| 2010/0228541 | A1 | 9/2010 | Oshikiri |
| 2010/0228557 | A1 | 9/2010 | Chen et al. |
| 2010/0241437 | A1 | 9/2010 | Taleb et al. |
| 2010/0280833 | A1 | 11/2010 | Yamanashi et al. |
| 2010/0286990 | A1 | 11/2010 | Biswas et al. |
| 2010/0305956 | A1 | 12/2010 | Oh et al. |
| 2010/0318350 | A1 | 12/2010 | Endo et al. |
| 2011/0046965 | A1 | 2/2011 | Taleb et al. |
| 2011/0054911 | A1 | 3/2011 | Baumgarte et al. |
| 2011/0075855 | A1 | 3/2011 | Oh et al. |
| 2011/0106529 | A1 | 5/2011 | Disch |
| 2011/0112845 | A1 | 5/2011 | Jasiuk et al. |
| 2011/0137643 | A1 | 6/2011 | Yamanashi et al. |
| 2011/0137650 | A1 | 6/2011 | Ljolje |
| 2011/0137659 | A1 | 6/2011 | Honma et al. |
| 2011/0153318 | A1 | 6/2011 | Rossello et al. |
| 2011/0170711 | A1 | 7/2011 | Rettelbach et al. |
| 2011/0173006 | A1 | 7/2011 | Nagel et al. |
| 2011/0178807 | A1 | 7/2011 | Yang et al. |
| 2011/0222630 | A1 | 9/2011 | Suzuki et al. |
| 2011/0264454 | A1 | 10/2011 | Ullberg et al. |
| 2011/0282675 | A1 | 11/2011 | Nagel et al. |
| 2011/0305352 | A1 | 12/2011 | Villemoes et al. |
| 2011/0307248 | A1 | 12/2011 | Yamanashi et al. |
| 2012/0010880 | A1 | 1/2012 | Nagel et al. |
| 2012/0016667 | A1 | 1/2012 | Gao |
| 2012/0016668 | A1 | 1/2012 | Gao |
| 2012/0057711 | A1 | 3/2012 | Makino et al. |
| 2012/0226505 | A1 | 9/2012 | Lin et al. |
| 2012/0243526 | A1 | 9/2012 | Yamamoto et al. |
| 2012/0310654 | A1 | 12/2012 | Riedmiller et al. |
| 2012/0328124 | A1 | 12/2012 | Kjoerling |
| 2013/0028427 | A1 | 1/2013 | Yamamoto et al. |
| 2013/0030818 | A1 | 1/2013 | Yamamoto et al. |
| 2013/0124214 | A1 | 5/2013 | Yamamoto et al. |
| 2013/0202118 | A1 | 8/2013 | Yamamoto et al. |
| 2013/0208902 | A1 | 8/2013 | Yamamoto et al. |
| 2013/0218577 | A1 | 8/2013 | Taleb et al. |
| 2013/0226598 | A1 | 8/2013 | Laaksonen et al. |
| 2013/0275142 | A1 | 10/2013 | Hatanaka et al. |
| 2014/0006037 | A1 | 1/2014 | Honma et al. |
| 2014/0156289 | A1 | 6/2014 | Hatanaka et al. |
| 2014/0172433 | A2 | 6/2014 | Honma et al. |
| 2014/0180682 | A1 | 6/2014 | Shi et al. |
| 2014/0200899 | A1 | 7/2014 | Yamamoto et al. |
| 2014/0200900 | A1 | 7/2014 | Yamamoto et al. |
| 2014/0205101 | A1 | 7/2014 | Yamamoto et al. |
| 2014/0205111 | A1 | 7/2014 | Hatanaka et al. |
| 2014/0211948 | A1 | 7/2014 | Hatanaka et al. |
| 2014/0214432 | A1 | 7/2014 | Hatanaka et al. |
| 2014/0214433 | A1 | 7/2014 | Hatanaka et al. |
| 2014/0226822 | A1 | 8/2014 | Endegard et al. |
| 2015/0051904 | A1 | 2/2015 | Kikuiri et al. |
| 2015/0088528 | A1 | 3/2015 | Toguri et al. |
| 2015/0120307 | A1 | 4/2015 | Yamamoto et al. |
| 2015/0243295 | A1 | 8/2015 | Truman et al. |
| 2016/0012829 | A1 | 1/2016 | Yamamoto et al. |
| 2016/0019911 | A1 | 1/2016 | Yamamoto et al. |
| 2016/0140982 | A1 | 5/2016 | Yamamoto et al. |
| 2016/0225376 | A1 | 8/2016 | Honma et al. |
| 2016/0322057 | A1 | 11/2016 | Yamamoto et al. |
| 2016/0343380 | A1 | 11/2016 | Hatanaka et al. |
| 2017/0076737 | A1 | 3/2017 | Yamamoto et al. |
| 2017/0148452 | A1 | 5/2017 | Hatanaka et al. |
| 2017/0229139 | A1 | 8/2017 | Yamamoto et al. |
| 2017/0236530 | A1 | 8/2017 | Yamamoto et al. |
| 2017/0337928 | A1 | 11/2017 | Yamamoto et al. |

FOREIGN PATENT DOCUMENTS

| | | | |
|---|---|---|---|
| CN | 1992533 | A | 7/2007 |
| CN | 101083076 | A | 12/2007 |
| CN | 101178898 | A | 5/2008 |
| CN | 101183527 | A | 5/2008 |
| CN | 101548318 | A | 9/2009 |
| CN | 101853663 | A | 10/2010 |
| CN | 101896968 | A | 11/2010 |
| EP | 1921610 | A2 | 5/2008 |
| EP | 2019391 | A2 | 1/2009 |
| EP | 2317509 | A1 | 5/2011 |
| EP | 2472512 | A1 | 7/2012 |
| JP | 3-254223 | A | 11/1991 |
| JP | 08-008933 | A | 1/1996 |
| JP | 08-030295 | A | 2/1996 |
| JP | 08-123484 | A | 5/1996 |
| JP | 10-020888 | A | 1/1998 |
| JP | 2001-134287 | A | 5/2001 |
| JP | 2001-521648 | A | 11/2001 |
| JP | 2002-536679 | A | 10/2002 |
| JP | 2002-373000 | A | 12/2002 |
| JP | 2003-514267 | A | 4/2003 |
| JP | 2003-216190 | A | 7/2003 |
| JP | 2003-255973 | A | 9/2003 |
| JP | 2003-316394 | A | 11/2003 |
| JP | 2004-101720 | A | 4/2004 |
| JP | 2004-521394 | A | 7/2004 |
| JP | 2004-258603 | A | 9/2004 |
| JP | 2005-520219 | A | 7/2005 |
| JP | 2005-521907 | A | 7/2005 |
| JP | 2006-048043 | A | 2/2006 |
| JP | 2007-017908 | A | 1/2007 |
| JP | 2007-171821 | A | 7/2007 |
| JP | 2007-316254 | A | 12/2007 |
| JP | 2007-333785 | A | 12/2007 |
| JP | 2008-107415 | A | 5/2008 |
| JP | 2008-139844 | A | 6/2008 |
| JP | 2008-158496 | A | 7/2008 |
| JP | 2008-224902 | A | 9/2008 |
| JP | 2008-261978 | A | 10/2008 |
| JP | 2009-116275 | A | 5/2009 |
| JP | 2009-116371 | A | 5/2009 |
| JP | 2009-134260 | A | 6/2009 |
| JP | 2010-020251 | A | 1/2010 |
| JP | 2010-079275 | A | 4/2010 |
| JP | 2010-526331 | A | 7/2010 |
| JP | 2010-212760 | A | 9/2010 |
| JP | 2012-504260 | A | 2/2012 |
| JP | 2013-015633 | A | 1/2013 |
| JP | 2016-006540 | A | 1/2016 |
| KR | 10-2006-0060928 | A | 6/2006 |
| KR | 10-2006-0085118 | A | 7/2006 |
| KR | 10-2007-0083997 | A | 8/2007 |
| KR | 10-2007-0118174 | A | 12/2007 |
| WO | WO 2004/010415 | A1 | 1/2004 |
| WO | WO 2004/027368 | A1 | 4/2004 |
| WO | WO 2005/111568 | A1 | 11/2005 |
| WO | WO 2006/049205 | A1 | 5/2006 |
| WO | WO 2006/075563 | A1 | 7/2006 |
| WO | WO 2007/037361 | A1 | 4/2007 |
| WO | WO 2007/052088 | A1 | 5/2007 |
| WO | WO 2007/126015 | A1 | 11/2007 |
| WO | WO 2007/129728 | A1 | 11/2007 |
| WO | WO 2007/142434 | A1 | 12/2007 |
| WO | WO 2009/001874 | A1 | 12/2008 |
| WO | WO 2009/004727 | A1 | 1/2009 |
| WO | WO 2009/029037 | A1 | 3/2009 |
| WO | WO 2009/054393 | A1 | 4/2009 |
| WO | WO 2009/059631 | A1 | 5/2009 |
| WO | WO 2009/093466 | A1 | 7/2009 |

(56) References Cited

FOREIGN PATENT DOCUMENTS

| | | | |
|---|---|---|---|
| WO | WO 2010/024371 | A1 | 3/2010 |
| WO | WO 2011/043227 | A1 | 4/2011 |

OTHER PUBLICATIONS

Chennoukh et al., Speech enhancement via frequency bandwidth extension using line spectral frequencies. IEEE International Conference on Acoustics, Speech and Signal Processing, 2001;1:665-6[68].

Chinen et al., Report on PVC CE for SBR in USAC, Motion Picture Expert Group Meeting, Oct. 28, 2010, ISO/IEC JTC1/SC29/WG11, No. M18399, 47 pages.

Krishnan et al., EVRC-Wideband: The New 3GPP2 Wideband Vocoder Standard, Qualcomm Inc., IEEE International Conference on Acoustics, Speech, and Signal Processing, Apr. 15, 2007, pp. II-333-336.

Liu et al., High frequency reconstruction for band-limited audio signals. Proc of the 6th Int'l Conference on Digital Audio Effects, DAX 1-6, London, UK. Sep. 8-11, 2003.

No Author Listed, Information technology—Coding of audio-visual objects—Part 3: Audio, International Standard, ISO/IEC 14496-3:/Amd.1:1999(E), ISO/IEC JTC 1/SC 29/WG 11, 199 pages.

No Author Listed, Information technology Coding of audio-visual objects Part 3: Audio, International Standard, ISO/IEC 14496-3:2001(E), Second Edition, Dec. 15, 2001, 110 pages.

Extended European Search Report dated Aug. 23, 2017 in connection with European Application No. 17170369.7.

Korean Office Action dated Sep. 20, 2017 in connection with Korean Application No. 10-2012-7026087 and English translation thereof.

Korean Office Action dated Sep. 20, 2017 in connection with Korean Application No. 10-2012-7026063 and English translation thereof.

Extended European Search Report dated Feb. 20, 2018 in connection with European Application No. 17210387.1.

Korean Office Action dated Feb. 9, 2018 in connection with Korean Application No. 10-2017-7030518 and English translation thereof.

Korean Office Action dated May 4, 2018 in connection with Korean Application No. 10-2018-7004221 and English translation thereof.

Korean Office Action dated May 21, 2018 in connection with Korean Application No. 10-2018-7005834 and English translation thereof.

Japanese Office Action dated Aug. 28, 2018 in connection with Japanese Application No. 2017-140510 and English translation thereof.

Korean Office Action dated Aug. 29, 2018 in connection with Korean Application No. 10-2018-7020930 and English translation thereof.

Korean Office Action dated Nov. 28, 2018 in connection with Korean Application No. 10-2018-7004221, and English translation thereof.

Korean Office Action dated Nov. 28, 2018 in connection with Korean Application No. 10-2018-7005834, and English translation thereof.

ENCODING DEVICE AND METHOD, DECODING DEVICE AND METHOD, AND PROGRAM

CROSS REFERENCES TO RELATED APPLICATIONS

This Application claims the benefit under 35 U.S.C. § 120 of U.S. application Ser. No. 15/357,877, entitled "ENCODING DEVICE AND METHOD, DECODING DEVICE AND METHOD, AND PROGRAM," filed on Nov. 21, 2016, which claims the benefit under 35 U.S.C. § 120 of U.S. application Ser. No. 14/861,734, entitled "ENCODING DEVICE AND METHOD, DECODING DEVICE AND METHOD, AND PROGRAM" filed on Sep. 22, 2015, now U.S. Pat. No. 9,536,542, which claims the benefit under 35 U.S.C. § 120 of U.S. application Ser. No. 13/877,192, entitled "ENCODING DEVICE AND METHOD, DECODING DEVICE AND METHOD, AND PROGRAM" filed on Apr. 1, 2013, now U.S. Pat. No. 9,177,563, which is the National Stage of International Application No. PCT/JP2011/072957 filed in the Japanese Patent Office as a Receiving Office on Oct. 5, 2011, and and claims the priority benefit of Japanese Patent Application Number JP2010-232106, filed in the Japanese Patent Office on Oct. 15, 2010, which are herein incorporated by reference in their entirety.

TECHNICAL FIELD

The present invention relates to an encoding device and method, a decoding device and method, and a program, and specifically relates to an encoding device and method, a decoding device and method, and a program which enable music signals to be played with high sound quality by expanding a frequency band.

BACKGROUND ART

In recent years, music distribution service to distribute music data via the Internet or the like has been spreading. With this music distribution service, encoded data obtained by encoding music signals is distributed as music data. As a music signal encoding technique, an encoding technique has become the mainstream wherein a bit rate is lowered while suppressing file capacity of encoded data so as not to take time at the time of downloading.

Such a music signal encoding techniques, are roughly divided into an encoding technique such as MP3 (MPEG (Moving Picture Experts Group) Audio Layer 3) (International Standards ISO/IEC 11172-3) and so forth, and an encoding technique such as HE-AAC (High Efficiency MPEG4 AAC) (International Standards ISO/IEC 14496-3) and so forth.

With the encoding technique represented by MP3, of music signals, signal components in a high-frequency band (hereinafter, referred to as high-frequency) equal to or greater than around 15 kHz of hardly sensed by the human ear, are deleted, and signal components in the remaining low-frequency band (hereinafter, referred to as low-frequency) are encoded. Such an encoding technique will be referred to as high-frequency deletion encoding technique. With this high-frequency deletion encoding technique, file capacity of encoded data may be suppressed. However, high-frequency sound may slightly be sensed by the human ear, and accordingly, at the time of generating and outputting sound from music signals after decoding obtained by decoding encoded data, there may be deterioration in sound quality such as loss of sense of presence that the original sound has, or the sound may seem to be muffled.

On the other hand, with the encoding technique represented by HE-AAC, characteristic information is extracted from high-frequency signal components, and encoded along with low-frequency signal components. Herein after, such an encoding technique will be referred to as a high-frequency characteristic encoding technique. With this high-frequency characteristic encoding technique, only characteristic information of high-frequency signal components is encoded as information relating to the high-frequency signal components, and accordingly, encoding efficiency may be improved while suppressing deterioration in sound quality.

With decoding of encoded data encoded by this high-frequency characteristic encoding technique, low-frequency signal components and characteristic information are decoded, and high-frequency signal components are generated from the low-frequency signal components and characteristic information after decoding. Thus, a technique to expand the frequency band of low-frequency signal components by generating high-frequency signal components from low-frequency signal components will hereinafter be referred to as a band expanding technique.

As one application of the band expanding technique, there is post-processing after decoding of encoded data by the above-mentioned high-frequency deletion encoding technique. With this post-processing, high-frequency signal components lost by encoding are generated from the low-frequency signal components after decoding, thereby expanding the frequency band of the low-frequency signal components (see PTL 1). Note that the frequency band expanding technique according to PTL 1 will hereinafter be referred to as the band expanding technique according to PTL 1.

With the band expanding technique according to PTL 1, a device takes low-frequency signal components after decoding as an input signal, estimates high-frequency power spectrum (hereinafter, referred to as high-frequency frequency envelopment as appropriate) from the power spectrum of the input signals, and generates high-frequency signal components having the high-frequency frequency envelopment from the low-frequency signal components.

FIG. 1 illustrates an example of the low-frequency power spectrum after decoding, serving as the input signal, and the estimated high-frequency frequency envelopment.

In FIG. 1, the vertical axis indicates power by a logarithm, and the horizontal axis indicates frequencies.

The device determines the band of low-frequency end of high-frequency signal components (hereinafter, referred to as expanding start band) from information of the type of an encoding method relating to the input signal, sampling rate, bit rate, and so forth (hereinafter, referred to as side information). Next, the device divides the input signal serving as low-frequency signal components into multiple subband signals. The device obtains average for each group regarding a temporal direction of power (hereinafter, referred to as group power) of each of multiple subband signals following division, that is to say, the multiple subband signals on the lower frequency side than the expanding start band (hereinafter, simply referred to as low-frequency side). As illustrated in FIG. 1, the device takes a point with average of group power of each of the multiple subband signals on the low-frequency side as power, and also the frequency of the lower end of the expanding start band as the frequency, as the origin. The device performs estimation with a primary straight line having predetermined inclination passing through the origin thereof as frequency envelopment on higher frequency side than the expanding start band (hereinafter, simply referred to as high-frequency side). Note that a position regarding the power direction of the origin may be adjusted by a user. The device generates each of the multiple subband signals on the high-frequency side from the multiple subband signals on the low-frequency side so as to obtain the estimated frequency envelopment on the high-frequency side. The device adds the generated multiple subband signals on the high-frequency side to obtain high-frequency signal components, and further adds the low-frequency signal components thereto and output these. Thus, music signals after expanding the frequency band approximates to the original music signals. Accordingly, music signals with high sound quality may be played.

The above-mentioned band expanding technique according to PTL 1 has a feature wherein, with regard to various high-frequency deletion encoding techniques and encoded data with various bit rates, the frequency band regarding music signals after decoding of the encoded data thereof can be expanded.

CITATION LIST

Patent Literature

PTL 1: Japanese Unexamined Patent Application Publication No. 2008-139844

SUMMARY OF INVENTION

Technical Problem

However, with the band expanding technique according to PTL 1, there is room for improvement in that the estimated frequency envelopment on the high-frequency side becomes a primary straight line with predetermined inclination, i.e., in that the shape of the frequency envelopment is fixed.

Specifically, the power spectrums of music signals have various shapes, there may be many cases to greatly deviate from the frequency envelopment on the high-frequency side estimated by the band expanding technique according to PTL 1, depending on the types of music signals.

FIG. 2 illustrates an example of the original power spectrum of a music signal of attack nature (music signal with attack) accompanying temporal rapid change such as strongly hitting a drum once.

Note that FIG. 2 also illustrates frequency envelopment on the high-frequency side estimated by the band expanding technique according to PTL 1 from signal components on the low-frequency side of a music signal with attack serving as an input signal.

As illustrated in FIG. 2, the original power spectrum on the high-frequency side of the music signal with attack is generally flat.

On the other hand, the estimated frequency envelopment on the high-frequency side has a predetermined negative inclination, and accordingly, even when adjusting the power at the origin approximate to the original power spectrum, as the frequency increases, difference with the original power spectrum increases.

Thus, with the band expanding technique according to PTL 1, according to the estimated frequency envelopment on the high-frequency side, the original frequency envelopment on the high-frequency side cannot to be reproduced with high precision. As a result thereof, at the time of generating and outputting sound from a music signal after expanding the frequency band, clearness of sound has been lost as compared to the original sound on listenability.

Also, with the above-mentioned high-frequency characteristic encoding technique such as HE-AAC or the like, though frequency envelopment on the high-frequency side is employed as characteristic information of high-frequency signal components to be encoded, it is demanded that the decoding side reproduces the frequency envelopment on the high-frequency side with high precision.

The present invention has been made in the light of such situations, and enables music signals to be played with high sound quality by expanding the frequency band.

Solution to Problem

An encoding device according to a first aspect of the present invention includes: subband diving means configured to divide an input signal into multiple subbands, and to generate a low-frequency subband signal made up of multiple subbands on the low-frequency side, and a high-frequency subband signal made up of multiple subbands on the high-frequency side; feature amount calculating means configured to calculate feature amount that represents features of the input signal based on at least any one of the low-frequency subband signal and the input signal; smoothing means configured to subject the feature amount smoothing; pseudo high-frequency subband power calculating means configured to calculate pseudo high-frequency subband power that is an estimated value of power of the high-frequency subband signal based on the smoothed feature amount and a predetermined coefficient; selecting means configured to calculate high-frequency subband power that is power of the high-frequency subband signal from the high-frequency subband signal, and to compare the high-frequency subband power and the pseudo high-frequency subband power to select any of the multiple coefficients; high-frequency encoding means configured to encode coefficient information for obtaining the selected coefficient, and smoothing information relating to the smoothing to generate high-frequency encoded data; low-frequency encoding means configured to encode a low-frequency signal that is a low-frequency signal of the input signal to generate low-frequency encoded data; and multiplexing means configured to multiplex the low-frequency encoded data and the high-frequency encoded data to obtain an output code string.

The smoothing means may subject the feature amount to smoothing by performing weighted averaging for the feature amount of a predetermined number of continuous frames of the input signal.

The smoothing information may be information that indicates at least one of the number of the frames used for the weighted averaging, or weight used for the weighted averaging.

The encoding device may include parameter determining means configured to determine at least one of one of the number of the frames used for the weighted averaging, or weight used for the weighted averaging based on the high-frequency subband signal.

The coefficient may be generated by learning with the feature amount and the high-frequency subband power obtained from a broadband supervisory signal as an explanatory variable and an explained variable.

The broadband supervisory signal may be a signal obtained by encoding a predetermined signal in accordance with an encoding method and encoding algorithm and decoding the encoded predetermined signal; with the coefficient being generated by the learning using the broadband supervisory signal for each of multiple different encoding methods and encoding algorithms.

An encoding method or program according to the first aspect of the present invention includes the steps of: dividing an input signal into multiple subbands, and generating a low-frequency subband signal made up of multiple subbands on the low-frequency side, and a high-frequency subband signal made up of multiple subbands on the high-frequency side; calculating feature amount that represents features of the input signal based on at least any one of the low-frequency subband signal and the input signal; subjecting the feature amount smoothing; calculating pseudo high-frequency subband power that is an estimated value of power of the high-frequency subband signal based on the smoothed feature amount and a predetermined coefficient; calculating high-frequency subband power that is power of the high-frequency subband signal from the high-frequency subband signal, and comparing the high-frequency subband power and the pseudo high-frequency subband power to select any of the multiple coefficients; encoding coefficient information for obtaining the selected coefficient, and smoothing information relating to the smoothing to generate high-frequency encoded data; encoding a low-frequency signal that is a low-frequency signal of the input signal to generate low-frequency encoded data; and multiplexing the low-frequency encoded data and the high-frequency encoded data to obtain an output code string.

With the first aspect of the present invention, an input signal is divided into multiple subbands, a low-frequency subband signal made up of multiple subbands on the low-frequency side, and a high-frequency subband signal made up of multiple subbands on the high-frequency side are generated, feature amount that represents features of the input signal is calculated based on at least any one of the low-frequency subband signal and the input signal, the feature amount is subjected to smoothing, pseudo high-frequency subband power that is an estimated value of power of the high-frequency subband signal is calculated based on the smoothed feature amount and a predetermined coefficient, high-frequency subband power that is power of the high-frequency subband signal is calculated from the high-frequency subband signal, the high-frequency subband power and the pseudo high-frequency subband power are compared to select any of the multiple coefficients, coefficient information for obtaining the selected coefficient, and smoothing information relating to the smoothing to generate high-frequency encoded data are encoded, a low-frequency signal that is a low-frequency signal of the input signal is encoded to generate low-frequency encoded data, and the low-frequency encoded data and the high-frequency encoded data are multiplexed to obtain an output code string.

A decoding device according to a second aspect of the present invention includes: demultiplexing means configured to demultiplex input encoded data into low-frequency encoded data, coefficient information for obtaining a coefficient, and smoothing information relating to smoothing; low-frequency decoding means configured to decode the low-frequency encoded data to generate a low-frequency signal; subband dividing means configured to divide the low-frequency signal into multiple subbands to generate a low-frequency subband signal for each of the subbands; feature amount calculating means configured to calculate feature amount based on the low-frequency subband signals; smoothing means configured to subject the feature amount to smoothing based on the smoothing information; and generating means configured to generate a high-frequency signal based on the coefficient obtained from the coefficient information, the feature amount subjected to smoothing, and the low-frequency subband signals.

The smoothing means may subject the feature amount to smoothing by performing weighted averaging on the feature amount of a predetermined number of continuous frames of the low-frequency signal.

The smoothing information may be information indicating at least one of the number of frames used for the weighted averaging, or weight used for the weighted averaging.

The generating means may include decoded high-frequency subband power calculating means configured to calculate decoded high-frequency subband power that is an estimated value of subband power making up the high-frequency signal based on the smoothed feature amount and the coefficient, and high-frequency signal generating means configured to generate the high-frequency signal based on the decoded high-frequency subband power and the low-frequency subband signal.

The coefficient may be generated by learning with the feature amount obtained from a broadband supervisory signal, and power of the same subband as a subband making up the high-frequency signal of the broadband supervisory signal, as an explanatory variable and an explained variable.

The broadband supervisory signal may be a signal obtained by encoding a predetermined signal in accordance with a predetermined encoding method and encoding algorithm and decoding the encoded predetermined signal; with the coefficient being generated by the learning using the broadband supervisory signal for each of multiple different encoding methods and encoding algorithms.

A decoding method or program according to the second aspect of the present invention includes the steps of: demultiplexing input encoded data into low-frequency encoded data, coefficient information for obtaining a coefficient, and smoothing information relating to smoothing; decoding the low-frequency encoded data to generate a low-frequency signal; dividing the low-frequency signal into multiple subbands to generate a low-frequency subband signal for each of the subbands; calculating feature amount based on the low-frequency subband signals; subjecting the feature amount to smoothing based on the smoothing information; and generating a high-frequency signal based on the coefficient obtained from the coefficient information, the feature amount subjected to smoothing, and the low-frequency subband signals.

With the second aspect of the present invention, input encoded data is demultiplexed into low-frequency encoded data, coefficient information for obtaining a coefficient, and smoothing information relating to smoothing, the low-frequency encoded data is decoded to generate a low-frequency signal, the low-frequency signal is divided into multiple subbands to generate a low-frequency subband signal for each of the subbands, feature amount is calculated based on the low-frequency subband signals, the feature amount is subjected to smoothing based on the smoothing information, and a high-frequency signal is generated based on the coefficient obtained from the coefficient information, the feature amount subjected to smoothing, and the low-frequency subband signals.

Advantageous Effects of Invention

According to the first aspect and second aspect of the present invention, music signals may be played with higher sound quality by expanding the frequency band.

DESCRIPTION OF EMBODIMENTS

Hereinafter, embodiments of the present invention will be described with reference to the drawings. Note that description will be made in accordance with the following order.

1. First Embodiment (Case of Having Applied Present Invention to Frequency Band Expanding Device)
2. Second Embodiment (Case of Having Applied Present Invention to Encoding Device and Decoding Device)
3. Third Embodiment (Case of Including Coefficient Index in High-frequency Encoded Data)
4. Fourth Embodiment (Case of Including Coefficient Index and Pseudo High-frequency Subband Power Difference in High-frequency Encoded Data)
5. Fifth Embodiment (Case of Selecting Coefficient Index Using Evaluated Value)
6. Sixth Embodiment (Case of Sharing Part of Coefficients)
7. Seventh Embodiment (Case of Subjecting Feature Amount to Smoothing)

1. First Embodiment

With the first embodiment, low-frequency signal components after decoding to be obtained by decoding encoded data using the high-frequency deletion encoding technique is subjected to processing to expand the frequency band (hereinafter, referred to as frequency band expanding processing).

[Functional Configuration Example of Frequency Band Expanding Device]

Figure 3:
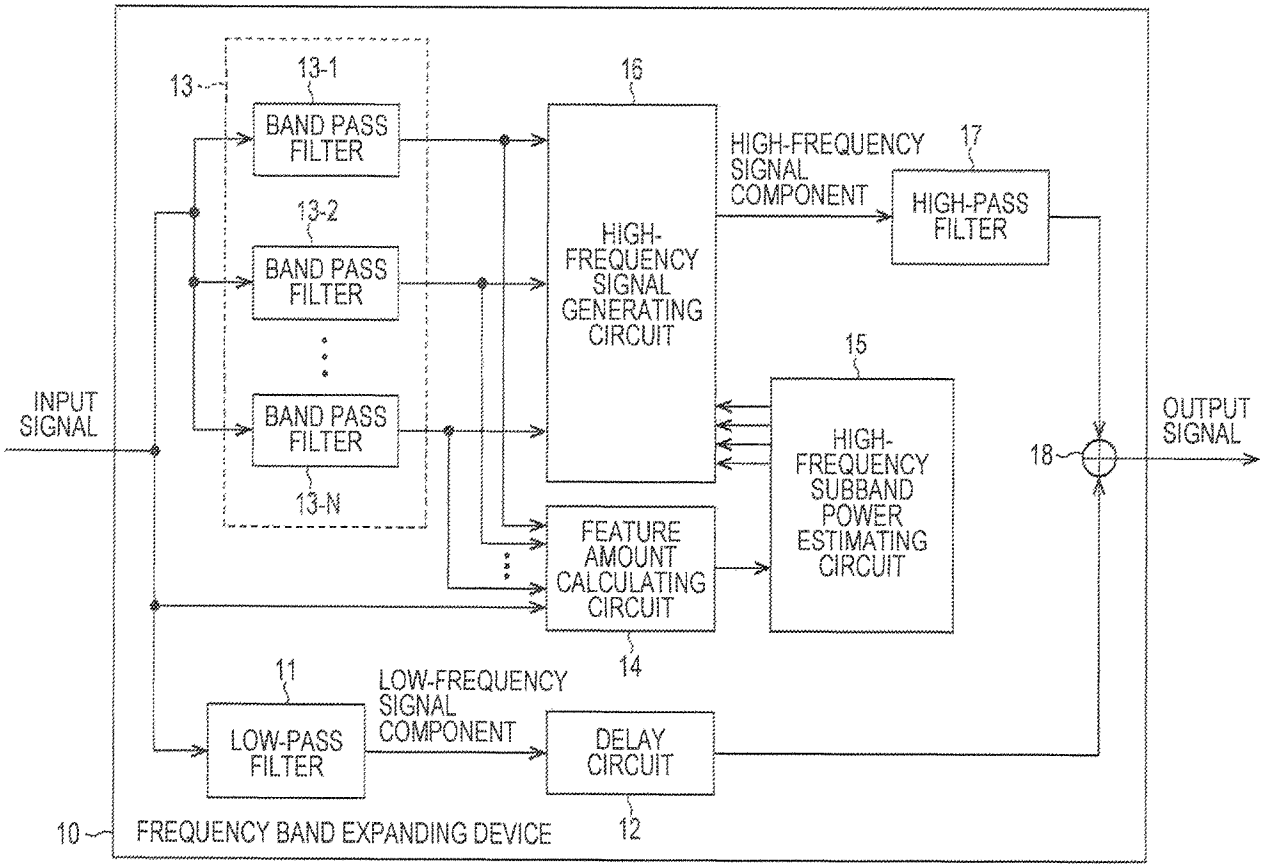
FIG. 3 is a block diagram illustrating a functional configuration example of a frequency band expanding device according to a first embodiment of the present invention.

FIG. 3 illustrates a functional configuration example of a frequency band expanding device to which the present invention has been applied.

A frequency band expanding device 10 takes a low-frequency signal component after decoding as an input signal, and subjects the input signal thereof to frequency band expanding processing, and outputs a signal after the frequency band expanding processing obtained as a result thereof as an output signal.

The frequency band expanding device 10 is configured of a low-pass filter 11, a delay circuit 12, band pass filters 13, a feature amount calculating circuit 14, a high-frequency subband power estimating circuit 15, a high-frequency signal generating circuit 16, a high-pass filter 17, and a signal adder 18.

The low-pass filter 11 performs filtering of an input signal with a predetermined cutoff frequency, and supplies a low-frequency signal component which is a signal component of low-frequency to the delay circuit 12 as a signal after filtering.

In order to synchronize the time of adding a low-frequency signal component from the low-pass filter 11 and a later-described high-frequency signal component, the delay circuit 12 delays the low-frequency signal component by fixed delay time to supply to the signal adder 18.

The band pass filters 13 are configured of band pass filters 13-1 to 13-N each having a different passband. The band pass filter 13-*i* ($1 \leq i \leq N$) passes a predetermined passband signal of input signals, and supplies this to the feature amount calculating circuit 14 and high-frequency signal generating circuit 16 as one of the multiple subband signals.

The feature amount calculating circuit 14 calculates a single or multiple feature amounts using at least any one of the multiple subband signals from the band pass filters 13 or the input signal to supply to the high-frequency subband power estimating circuit 15. Here, the feature amount is information representing features as a signal of the input signal.

The high-frequency subband power estimating circuit 15 calculates a high-frequency subband power estimated value which is power of a high-frequency subband signal for each high-frequency subband based on a single or multiple feature amounts from the feature amount calculating circuit 14, and supplies these to the high-frequency signal generating circuit 16.

The high-frequency signal generating circuit 16 generates a high-frequency signal component which is a high-frequency signal component based on the multiple subband signals from the band pass filters 13, and the multiple high-frequency subband power estimated values from the high-frequency subband power estimating circuit 15 to supply to the high-pass filter 17.

The high-pass filter 17 subjects the high-frequency signal component from the high-frequency signal generating circuit 16 to filtering with a cutoff frequency corresponding to a cutoff frequency at the low-pass filter 11 to supply to the signal adder 18.

The signal adder 18 adds the low-frequency signal component from the delay circuit 12 and the high-frequency signal component from the high-pass filter 17, and outputs this as an output signal.

Note that, with the configuration in FIG. 3, in order to obtain a subband signal, the band pass filters 13 are applied, but not restricted to this, and a band dividing filter as described in PTL 1 may be applied, for example.

Also, similarly, with the configuration in FIG. 3, in order to synthesize subband signals, the signal adder 18 is applied, but not restricted to this, a band synthetic filter as described in PTL 1 may be applied.

[Frequency Band Expanding Processing of Frequency Band Expanding Device]

Next, the frequency band expanding processing by the frequency band expanding device in FIG. 3 will be described with reference to the flowchart in FIG. 4.

In step S1, the low-pass filter 11 subjects the input signal to filtering with a predetermined cutoff frequency, and supplies the low-frequency signal component serving as a signal after filtering to the delay circuit 12.

The low-pass filter 11 may set an optional frequency as a cutoff frequency, but with the present embodiment, a predetermined band is taken as a later-described expanding start band, and a cutoff frequency is set corresponding to the lower end frequency of the expanding start band thereof. Accordingly, the low-pass filter 11 supplies a low-frequency signal component which is a lower frequency signal component than the expanding start band to the delay circuit 12 as a signal after filtering.

Also, the low-pass filter 11 may also set the optimal frequency as a cutoff frequency according to the high-frequency deletion encoding technique of the input signal, and encoding parameters such as the bit rate and so forth. As the encoding parameters, side information employed by the band expanding technique according to PTL 1 may be used, for example.

In step S2, the delay circuit 12 delays the low-frequency signal component from the low-pass filter 11 by fixed delay time and supplies this to the signal adder 18.

In step S3, the band pass filters 13 (band pass filters 13-1 to 13-N) divided the input signal to multiple subband signals, and supplies each of the multiple subband signals after division to the feature amount calculating circuit 14 and high-frequency signal generating circuit 16. Note that, with regard to input signal dividing processing by the band pass filters 13, details thereof will be described later.

In step S4, the feature amount calculating circuit 14 calculates a single or multiple feature amounts using at least one of the multiple subband signals from the band pass filters 13, and the input signal to supply to the high-frequency subband power estimating circuit 15. Note that, with regard to feature amount calculating processing by the feature amount calculating circuit 14, details thereof will be described later.

In step S5, the high-frequency subband power estimating circuit 15 calculates multiple high-frequency subband power estimated values based on a single or multiple feature amounts from the feature amount calculating circuit 14, and supplies these to the high-frequency signal generating circuit 16. Note that, with regard to processing to calculate high-frequency subband power estimated values by the high-frequency subband power estimating circuit 15, details thereof will be described later.

In step S6, the high-frequency signal generating circuit 16 generates a high-frequency signal component based on the multiple subband signals from the band pass filters 13, and the multiple high-frequency subband power estimated values from the high-frequency subband power estimating circuit 15, and supplies this to the high-pass filter 17. The high-frequency signal component mentioned here is a higher frequency signal component than the expanding start band. Note that, with regard to high-frequency signal component generation processing by the high-frequency signal generating circuit 16, details thereof will be described later.

In step S7, the high-pass filter 17 subjects the high-frequency signal component from the high-frequency signal generating circuit 16 to filtering, thereby removing noise such as aliasing components to a low frequency included in a high-frequency signal component, and supplying the high-frequency signal component thereof to the signal adder 18.

In step S8, the signal adder 18 adds the low-frequency signal component from the delay circuit 12 and the high-frequency signal component from the high-pass filter 17 to supply this as an output signal.

According to the above-mentioned processing, the frequency band may be expanded as to a low-frequency signal component after decoding.

Next, details of each process in steps S3 to S6 in the flowchart in FIG. 4 will be described.

[Details of Processing by Band Pass Filter]

First, details of processing by the band pass filters 13 in step S3 in the flowchart in FIG. 4 will be described.

Note that, for convenience of description, hereinafter, the number N of the band pass filters 13 will be taken as N=4.

For example, one of the 16 subbands obtained by equally dividing a Nyquist frequency of the input signal into 16 is taken as the expanding start band, four subbands of the 16 subbands of which the frequencies are lower than the expanding start band are taken as the passbands of the band pass filters 13-1 to 13-4, respectively.

Figure 5:
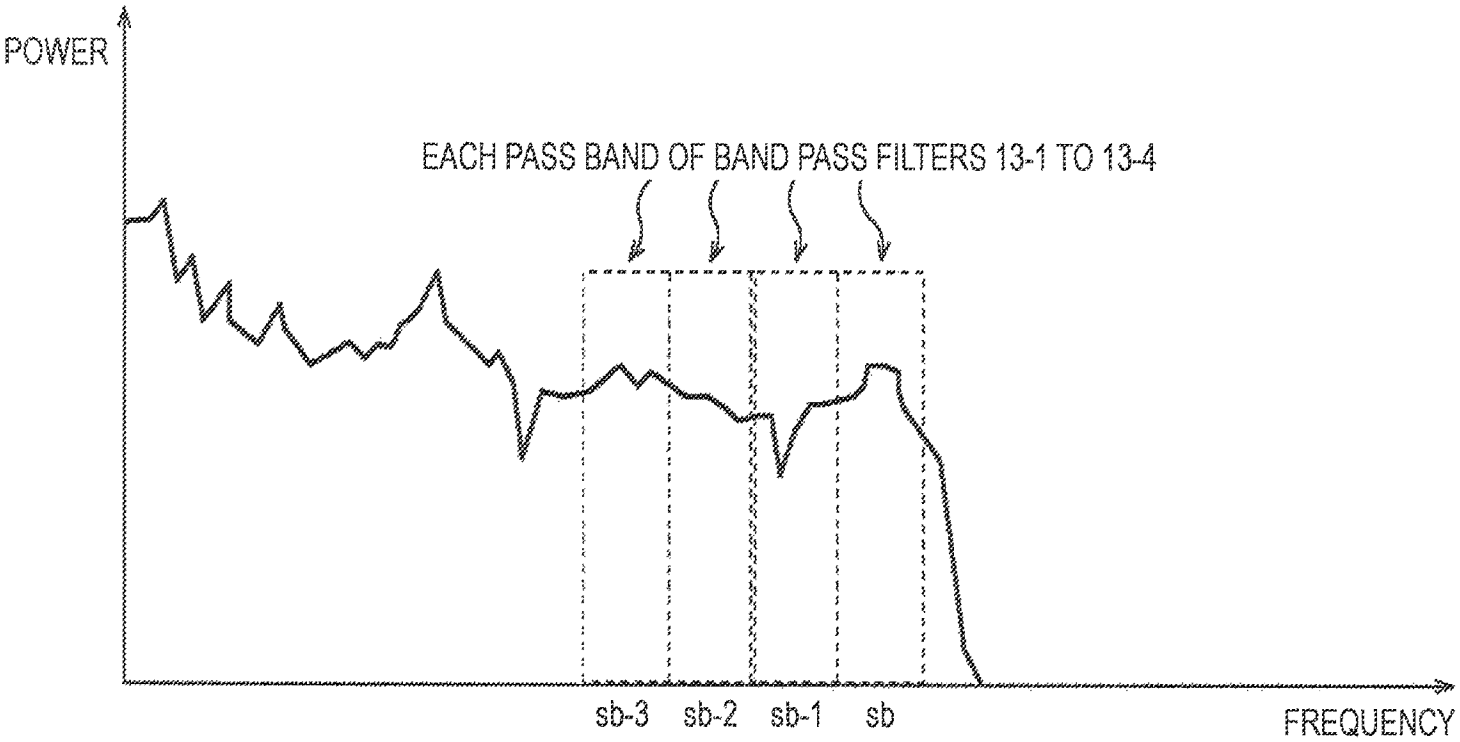
FIG. 5 is a diagram illustrating the power spectrum of a signal to be input to the frequency band expanding device in FIG. 3, and locations of band pass filters on the frequency axis.

FIG. 5 illustrates locations on the frequency axis of the passbands of the band pass filters 13-1 to 13-4, respectively.

As illustrated in FIG. 5, if we say that of frequency bands (subbands) which are lower than the expanding start band, the index of the first subband from the high-frequency is sb, the index of the second subband is sb−1, and the index of the first subband is sb−(I−1), the band pass filters 13-1 to 13-4, assign of the subbands having a lower frequency than the expanding start band, the subbands of which the indexes are sb to sb−3, as passbands, respectively.

Note that, with the present embodiment, the passbands of the band pass filters 13-1 to 13-4 are predetermined four subbands of 16 subbands obtained by equally dividing the Nyquist frequency of the input signal into 16, respectively, but not restricted to this, and may be predetermined four subbands of 256 subbands obtained by equally dividing the Nyquist frequency of the input signal into 256, respectively. Also, the bandwidths of the band pass filters 13-1 to 13-4 may differ.

[Details of Processing by Feature Amount Calculating Circuit]

Next, description will be made regarding details of processing by the feature amount calculating circuit 14 in step S4 in the flowchart in FIG. 4.

The feature amount calculating circuit 14 calculates a single or multiple feature amounts to be used for the high-frequency subband power estimating circuit 15 calculating a high-frequency subband power estimated value, using at least any one of the multiple subband signals from the band pass filters 13 and the input signal.

More specifically, the feature amount calculating circuit 14 calculates, from four subband signals from the band pass filters 13, subband signal power (subband power (hereinafter, also referred to as low-frequency subband power)) for each subband as a feature amount to supply to the high-frequency subband power estimating circuit 15.

Specifically, the feature amount calculating circuit 14 obtains low-frequency subband power power(ib, J) in a certain predetermined time frame J from four subband signals x(ib, n) supplied from the band pass filters 13, using the following Expression (1). Here, ib represents an index of a subband, and n represents an index of discrete time. Now, let us say that the number of samples in one frame is FSIZE, and power is represented by decibel.

[Mathematical Expression 1]

$$\text{power}(ib, J) = 10\log10\left\{\left(\sum_{n=J*FSIZE}^{(J+1)FSIZE-1} x(ib, n)^2\right) \Big/ FSIZE\right\} \quad (1)$$

$$(sb-3 \le ib \le sb)$$

In this manner, the low-frequency subband power power (ib, J) obtained by the feature amount calculating circuit 14 is supplied to the high-frequency subband power estimating circuit 15 as a feature amount.

[Details of Processing by High-Frequency Subband Power Estimating Circuit]

Next, description will be made regarding details of processing by the high-frequency subband power estimating circuit 15 in step S5 in the flowchart in FIG. 4.

The high-frequency subband power estimating circuit 15 calculates a subband power (high-frequency subband power) estimated value of a band to be expanded (frequency expanding band) of a subband of which the index is sb+1 (expanding start band), and thereafter based on the four subband powers supplied from the feature amount calculating circuit 14.

Specifically, if we say that an index of the highest frequency subband of the frequency expanding band is eb, the high-frequency subband power estimating circuit 15 estimates (eb−sb) subband powers regarding subbands of which the indexes are sb+1 to eb.

An estimated value subband $\text{power}_{est}$(ib, J) of which the index is ib in the frequency expanding band is represented, for example, by the following Expression (2) using the four subband powers power(ib, J) supplied from the feature amount calculating circuit 14.

[Mathematical Expression 2]

$$power_{est}(ib, J) = \left(\sum_{kb=sb-3}^{sb} \{A_{ib}(kb)\text{power}(kb, J)\}\right) + B_{ib} \quad (2)$$

$$(J*FSIZE \le n \le (J+1)FSIZE-1,\ sb+1 \le ib \le eb)$$

Here, in Expression (2), coefficients $A_{ib}$(kb) and $B_{ib}$ are coefficients having a different value for each subband ib. Let us say that the coefficients $A_{ib}$(kb) and $B_{ib}$ are coefficients to be suitably set so as to obtain a suitable value for various input signals. Also, according to change in the subband sb, the coefficients $A_{ib}$(kb) and $B_{ib}$ are also changed to optimal values. Note that derivation of the coefficients $A_{ib}$(kb) and $B_{ib}$ will be described later.

In Expression (2), though an estimated value of a high-frequency subband power is calculated by the primary linear coupling using each power of the multiple subband signals from the band pass filters 13, not restricted to this, and may be calculated using, for example, linear coupling of multiple low-frequency subband powers of several frames before and after in a time frame J, or may be calculated using a non-linear function.

In this manner, the high-frequency subband power estimated value calculated by the high-frequency subband power estimating circuit 15 is supplied to the high-frequency signal generating circuit 16.

[Details of Processing by High-Frequency Signal Generating Circuit]

Next, description will be made regarding details of processing by the high-frequency signal generating circuit 16 in step S6 in the flowchart in FIG. 4.

The high-frequency signal generating circuit 16 calculates a low-frequency subband power power(ib, J) of each subband from the multiple subband signals supplied from the band pass filters 13 based on the above-mentioned Expression (1). The high-frequency signal generating circuit 16 obtains a gain amount G(ib, J) by the following Expression (3) using the calculated multiple low-frequency subband powers power(ib, J), and the high-frequency subband power estimated value $\text{power}_{est}$(ib, J) calculated based on the above-mentioned Expression (2) by the high-frequency subband power estimating circuit 15.

[Mathematical Expression 3]

$$G(ib,J)=10^{[(power_{est}(ib,J)-power(sb_{map}(ib),J))/20]}$$

$$(J*FSIZE \le n \le (J+1)FSIZE-1, sb+1 \le ib \le eb) \quad (3)$$

Here, in Expression (3), $sb_{map}(ib)$ indicates a mapping source subband in the event that the subband ib is taken as a mapping destination subband, and is represented by the following Expression (4).

[Mathematical Expression 4]

$$sb_{map}(ib) = ib - 4INT\left(\frac{ib - sb - 1}{4} + 1\right) \quad (sb + 1 \le ib \le eb) \tag{4}$$

Note that, in Expression (4), INT(a) is a function to truncate below decimal point of a value a.

Next, the high-frequency signal generating circuit 16 calculates a subband signal x2(ib, n) after gain adjustment by multiplying output of the band pass filters 13 by the gain amount G(ib, J) obtained by Expression (3), using the following Expression (5).

[Mathematical Expression 5]

$$x2(ib,n)=6(ib,J)\times(sb_{map}(ib),n) \quad (J*FSIZE\le n\le(J+1)FSIZE-1, sb+1\le ib\le eb) \tag{5}$$

Further, the high-frequency signal generating circuit 16 calculates a subband signal x3(ib, n) after gain adjustment cosine-transformed from the subband signal x2(ib, n) after gain adjustment by performing cosine modulation from a frequency corresponding to the lower end frequency of a subband of which the index is sb−3 to a frequency corresponding to the upper end frequency of a subband of which the index is sb.

[Mathematical Expression 6]

$$x3(ib,n)=x2(ib,n)*2\cos(n)*[4(ib+1)\pi/32] \quad (sb+1\le ib\le eb) \tag{6}$$

Note that, in Expression (6), π represents a circular constant. This Expression (6) means that the subband signals x2(ib, n) after gain adjustment are each shifted to a frequency on a high-frequency side for four bands worth.

The high-frequency signal generating circuit 16 calculates a high-frequency signal component $x_{high}(n)$ from the subband signals x3(ib, n) after gain adjustment shifted to the high-frequency side, using the following Expression (7).

[Mathematical Expression 7]

$$x_{high}(n) = \sum_{ib=sb+1}^{ab} x3(ib, n) \tag{7}$$

In this manner, according to the high-frequency signal generating circuit 16, high-frequency signal components are generated based on the four low-frequency subband powers calculated based on the four subband signals from the band pass filters 13, and the high-frequency subband power estimated value from the high-frequency subband power estimating circuit 15 and are supplied to the high-pass filter 17.

According to the above-mentioned processing, as to the input signal obtained after decoding of encoded data by the high-frequency deletion encoding technique, low-frequency subband powers calculated from the multiple subband signals are taken as feature amounts, and based on these and the coefficients suitably set, a high-frequency subband power estimated value is calculated, and a high-frequency signal component is generated in an adapted manner from the low-frequency subband powers and high-frequency subband power estimated value, and accordingly, the subband powers in the frequency expanding band may be estimated with high precision, and music signals may be played with higher sound quality.

Though description has been made so far regarding an example wherein the feature amount calculating circuit 14 calculates only low-frequency subband powers calculated from the multiple subband signals as feature amounts, in this case, a subband power in the frequency expanding band may be able to be estimated with high precision depending on the types of the input signal.

Therefore, the feature amount calculating circuit 14 also calculates a feature amount having a strong correlation with how to output a sound power in the frequency expanding band, thereby enabling estimation of a subband power in the frequency expanding band at the high-frequency subband power estimating circuit 15 to be performed with higher precision.

[Another Example of Feature Amount Calculated by Feature Amount Calculating Circuit]

Figure 6:
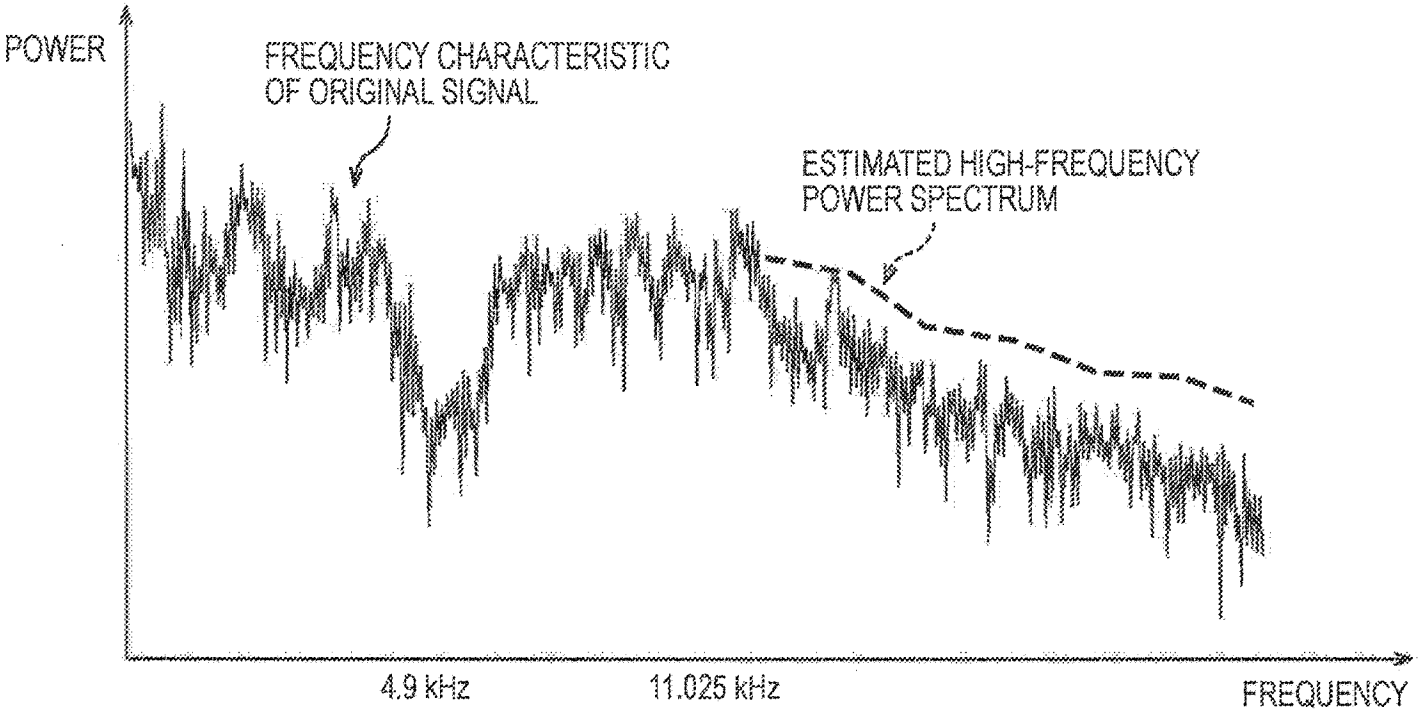
FIG. 6 is a diagram illustrating an example of frequency characteristic within a vocal section, and an estimated high-frequency power spectrum.

FIG. 6 illustrates an example of frequency characteristic of a vocal section which is a section where vocal occupies the majority in a certain input signal, and a high-frequency power spectrum obtained by calculating only low-frequency subband powers as feature amounts to estimate a high-frequency subband power.

As illustrated in FIG. 6, with the frequency characteristic of a vocal section, the estimated high-frequency power spectrum is frequently located above the high-frequency power spectrum of the original signal. Unnatural sensations regarding the human signing voice are readily sensed by the human ear, and accordingly, estimation of a high-frequency subband power needs to be performed with particular high precision within a vocal section.

Also, as illustrated in FIG. 6, with the frequency characteristic of a vocal section, there is frequently a great recessed portion from 4.9 kHz to 11.025 kHz.

Therefore, hereinafter, description will be made regarding an example wherein a recessed degree from 4.9 kHz to 11.025 kHz in a frequency region is applied as a feature amount to be used for estimation of a high-frequency subband power of a vocal section. Now, hereinafter, the feature amount indicating this recessed degree will be referred to as dip.

Hereinafter, a calculation example of dip dip(J) in the time frame J will be described.

First, of the input signal, signals in 2048 sample sections included in several frames before and after including the time frame J are subjected to 2048-point FFT (Fast Fourier Transform) to calculate coefficients on the frequency axis. The absolute values of the calculated coefficients are subjected to db transform to obtain power spectrums.

Figure 7:
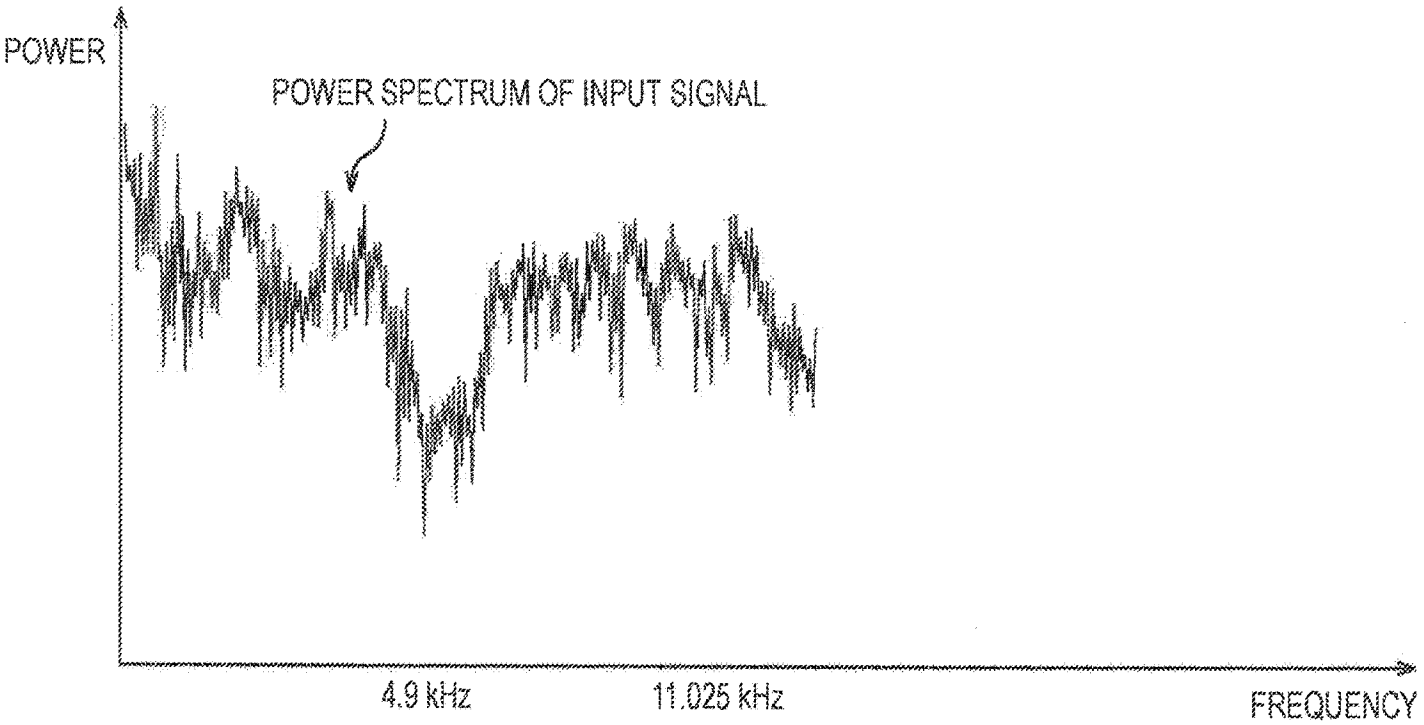
FIG. 7 is a diagram illustrating an example of the power spectrum of a signal to be input to the frequency band expanding device in FIG. 3.

FIG. 7 illustrates an example of the power spectrums thus obtained. Here, in order to remove fine components of the power spectrums, liftering processing is performed so as to remove components of 1.3 kHz or less, for example. According to the liftering processing, each dimension of the power spectrums is taken as time series, and is subjected to a low-pass filter to perform filtering processing, whereby fine components of a spectrum peak may be smoothed.

Figure 8:
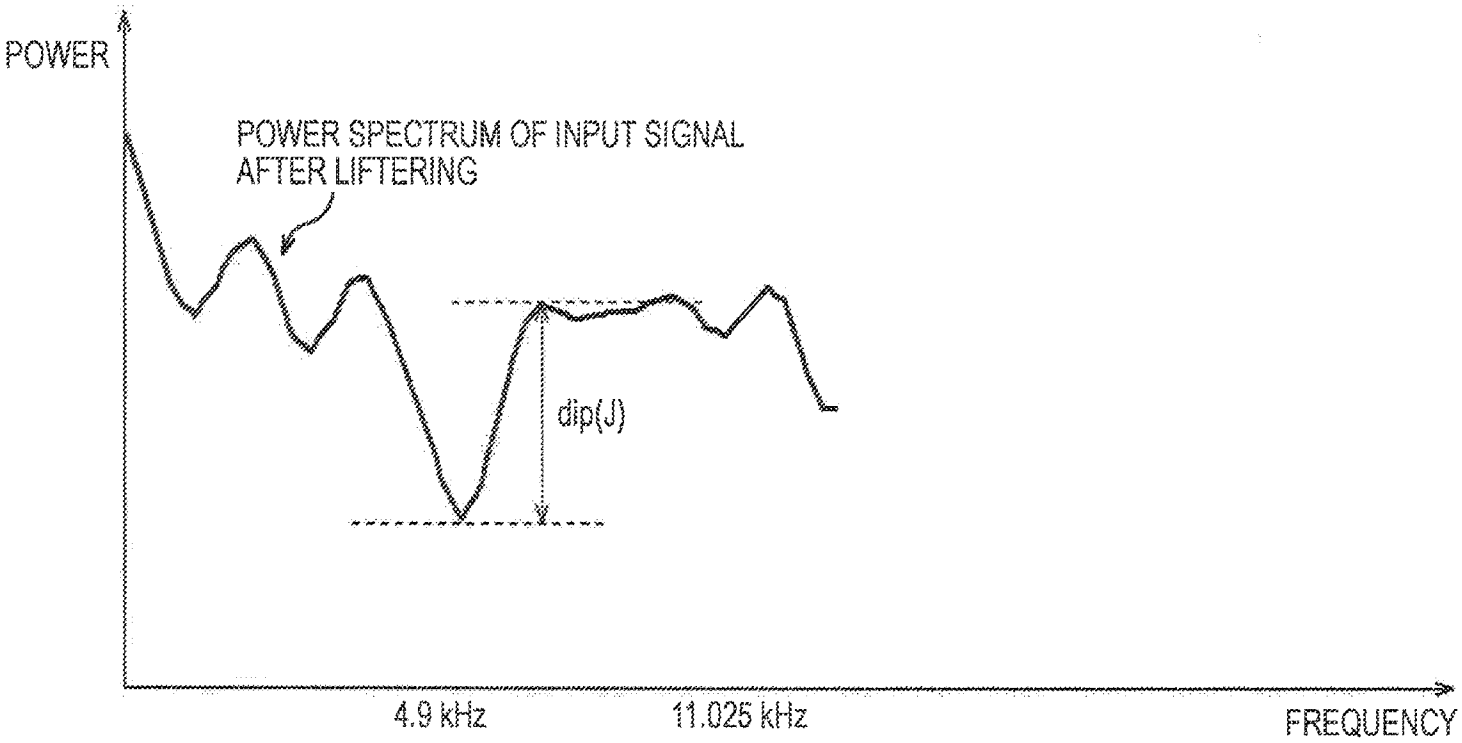
FIG. 8 is a diagram illustrating an example of the power spectrum after liftering of the input signal in FIG. 7.

FIG. 8 illustrates an example of the power spectrum of an input signal after liftering. With the power spectrum after liftering illustrated in FIG. 8, difference between the minimum value and the maximum value of the power spectrum included in a range equivalent to 4.9 kHz to 11.025 kHz is taken as dip dip(J).

In this manner, a feature amount having strong correlation with the subband power in the frequency expanding band is calculated. Note that a calculation example of the dip dip(J) is not restricted to the above-mentioned technique, and another technique may be employed.

Next, description will be made regarding another example of calculation of a feature amount having strong correlation with the subband power in the frequency expanding band.

[Yet Another Example of Calculation of Feature Amount Calculated by Feature Amount Calculating Circuit]

Of a certain input signal, with the frequency characteristic of an attack section which is a section including a music signal with attack, as described with reference to FIG. 2, the power spectrum on the high-frequency side is frequently generally flat. With the technique to calculate only low-frequency subband powers as feature amounts, the subband power of the frequency expand band is estimated without using a feature amount representing temporal fluctuation peculiar to the input signal including an attack section, and accordingly, it is difficult to estimate the subband power of the generally flat frequency expanding band viewed in an attack section, with high precision.

Therefore, hereinafter, description will be made regarding an example wherein temporal fluctuation of a low-frequency subband power is applied as a feature amount to be used for estimation of a high-frequency subband power of an attack section.

Temporal fluctuation $power_d(J)$ of a low-frequency subband power in a certain time frame J is obtained by the following Expression (8), for example.

[Mathematical Expression 8]

$$power_d(J) = \sum_{ib=sb-3}^{sb} \sum_{n=J*FSIZE}^{(J+1)FSIZE-1} (x(ib,n)^2) \Big/ \sum_{ib=sb-3}^{sb} \sum_{n=(J-1)FSIZE}^{J*FSIZE-1} (x(ib,n)^2) \quad (8)$$

According to Expression (8), the temporal fluctuation $power_d(J)$ of a low-frequency subband power represents a ratio between sum of four low-frequency subband powers in the time frame J, and sum of four low-frequency subband powers in time frame (J−1) which is one frame before the time frame J, and the greater this value is, the greater the temporal fluctuation of power between the frames is, i.e., it may be conceived that the signal included in the time frame J has strong attack nature.

Figure 1:
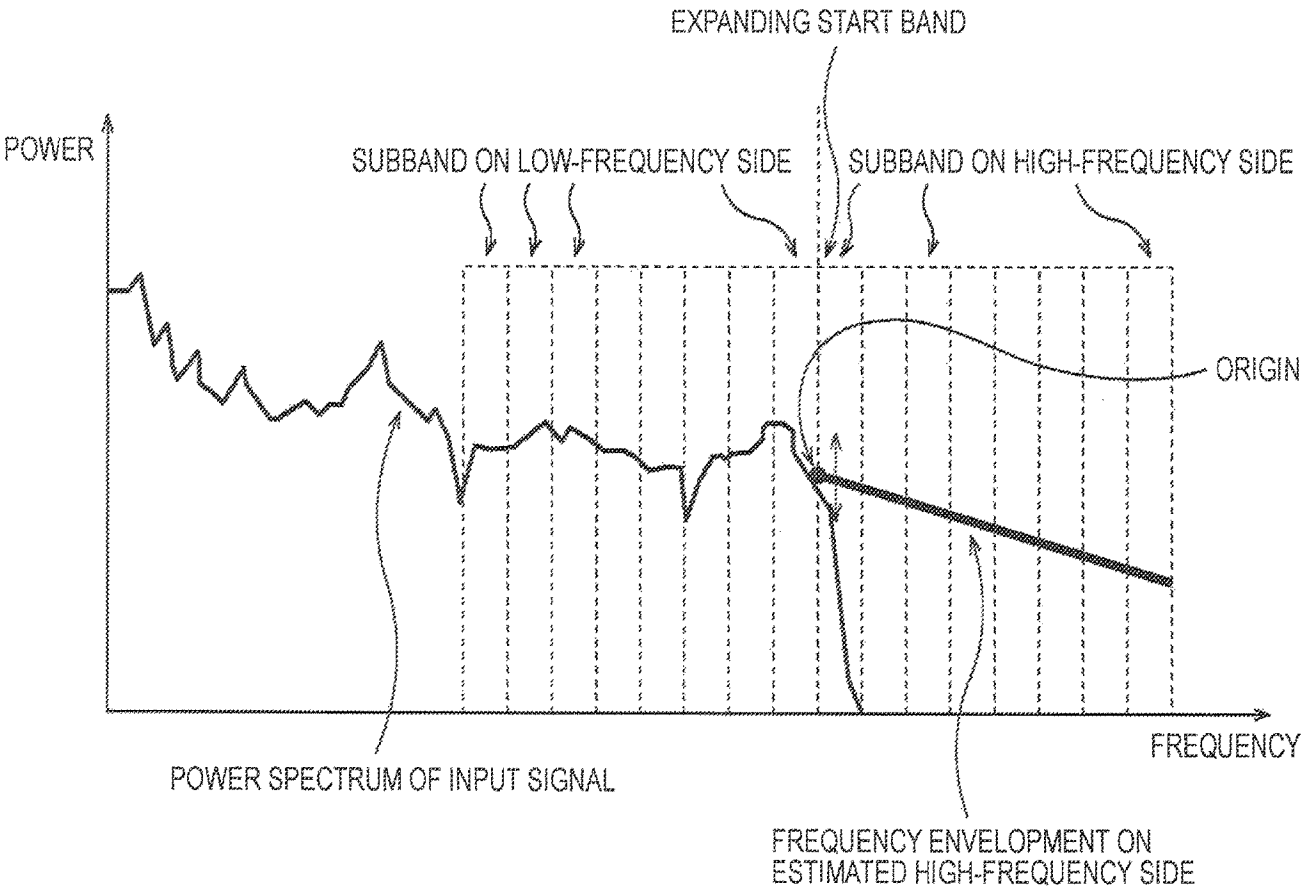
FIG. 1 is a diagram illustrating an example of low-frequency power spectrum after decoding serving as an input signal, and estimated high-frequency frequency envelopment.
Figure 2:
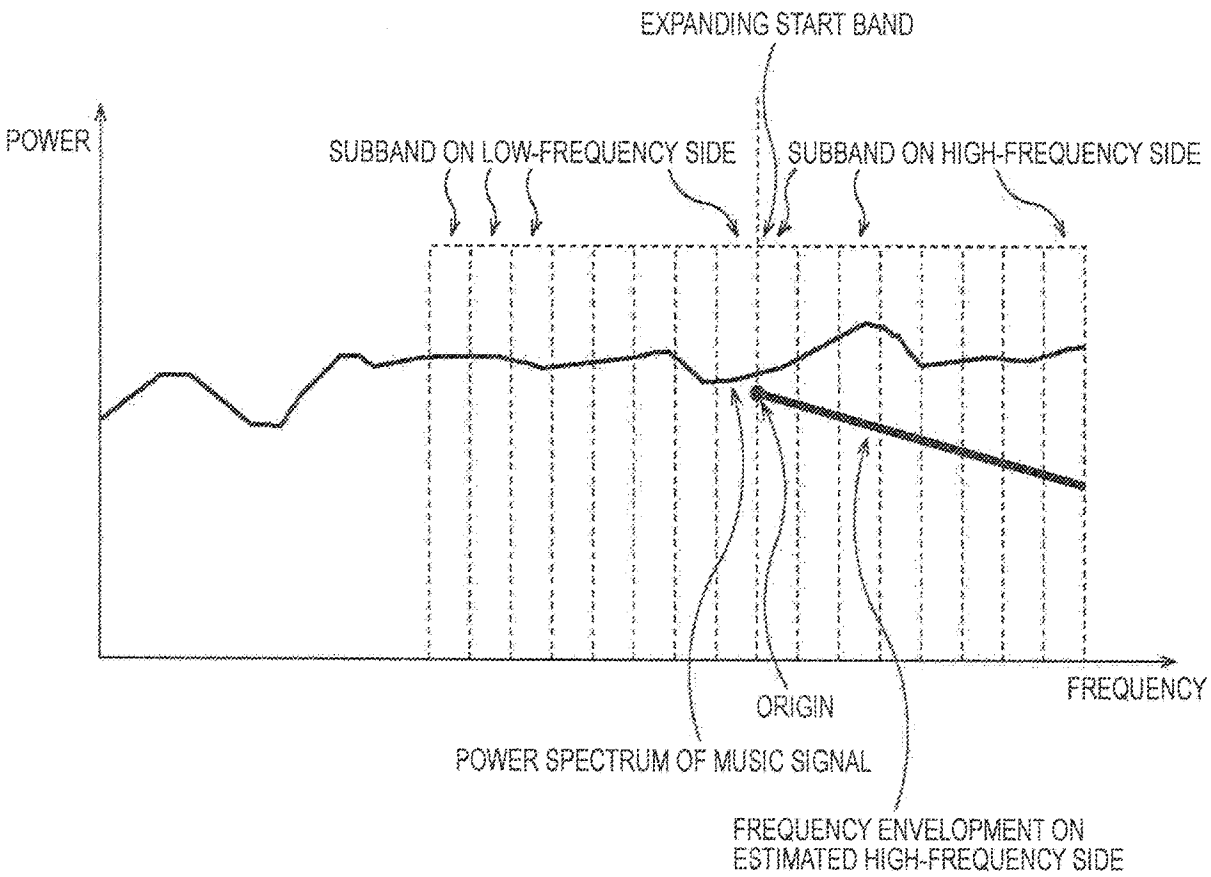
FIG. 2 is a diagram illustrating an example of the original power spectrum of a music signal with attack accompanying temporal rapid change.

Also, when comparing the statistically average power spectrum illustrated in FIG. 1 and the power spectrum of the attack section (music signal with attack) illustrated in FIG. 2, the power spectrum of the attack section increases toward the right at middle frequency. With the attack sections, such frequency characteristic is frequently exhibited.

Therefore, hereinafter description will be made regarding an example wherein as a feature amount to be used for estimation of a high-frequency subband power of an attack section, inclination in the middle frequency thereof is employed.

Inclination slope (J) of the middle frequency in a certain time frame J is obtained by the following Expression (9), for example.

[Mathematical Expression 9]

$$\text{slope}(J) = \sum_{ib=sb-3}^{sb} \sum_{n=J*FSIZE}^{(J+1)FSIZE-1} \{W(ib)*x(ib,n)^2)\} \Big/ \sum_{ib=sb-3}^{sb} \sum_{n=J*FSIZE}^{(J+1)FSIZE-1} (x(ib,n)^2) \quad (9)$$

In Expression (9), a coefficient w(ib) is a weighting coefficient adjusted so as to weight to high-frequency subband power. According to Expression (9), the slope (J) represents a ratio between sum of four low-frequency subband powers weighted to the high-frequency, and sum of the four low-frequency subband powers. For example, in the event that the four low-frequency subband powers have become power for the middle-frequency subband, when the middle-frequency power spectrum rises in the upper right direction, the slope (J) has a great value, and when the middle frequency power spectrum falls in the lower right direction, has a small value.

Also, the inclination of the middle-frequency frequently greatly fluctuates before and after an attack section, and accordingly, temporal fluctuation $slope_d(J)$ of inclination represented by the following Expression (10) may be taken as a feature amount to be used for estimation of a high-frequency subbed power of an attack section.

[Mathematical Expression 10]

$$slope_d(J) = slope(J)/slope(J-1)$$

$$(J*FSIZE \le n \le (J+1)FSIZE-1) \quad (10)$$

Also, similarly, temporal fluctuation $dip_d(J)$ of the above-mentioned dip(J) represented by the following Expression (11) may be taken as a feature amount to be used for estimation of a high-frequency subband power of an attack section.

[Mathematical Expression 11]

$$dip_d(J) = dip(J) - dip(J-1)$$

$$(J*FSIZE \le n \le (J+1)FSIZE-1) \quad (11)$$

According to the above-mentioned technique, a feature amount having a strong correlation with the subband power of the frequency expanding band is calculated, and accordingly, estimation of the subband power of the frequency expanding band at the high-frequency subband power estimating circuit 15 may be performed with higher precision.

Though description has made so far regarding an example wherein a feature amount with a strong correlation with the subband power of the frequency expanding band is calculated, hereinafter, description will be made regarding an example wherein a high-frequency subband power is estimated using the feature amount thus calculated.

[Details of Processing by High-Frequency Subband Power Estimating Circuit]

Now, description will be made regarding an example wherein a high-frequency subband power is estimated using the dip and low-frequency subband powers described with reference to FIG. 8 as feature amounts.

Figure 4:
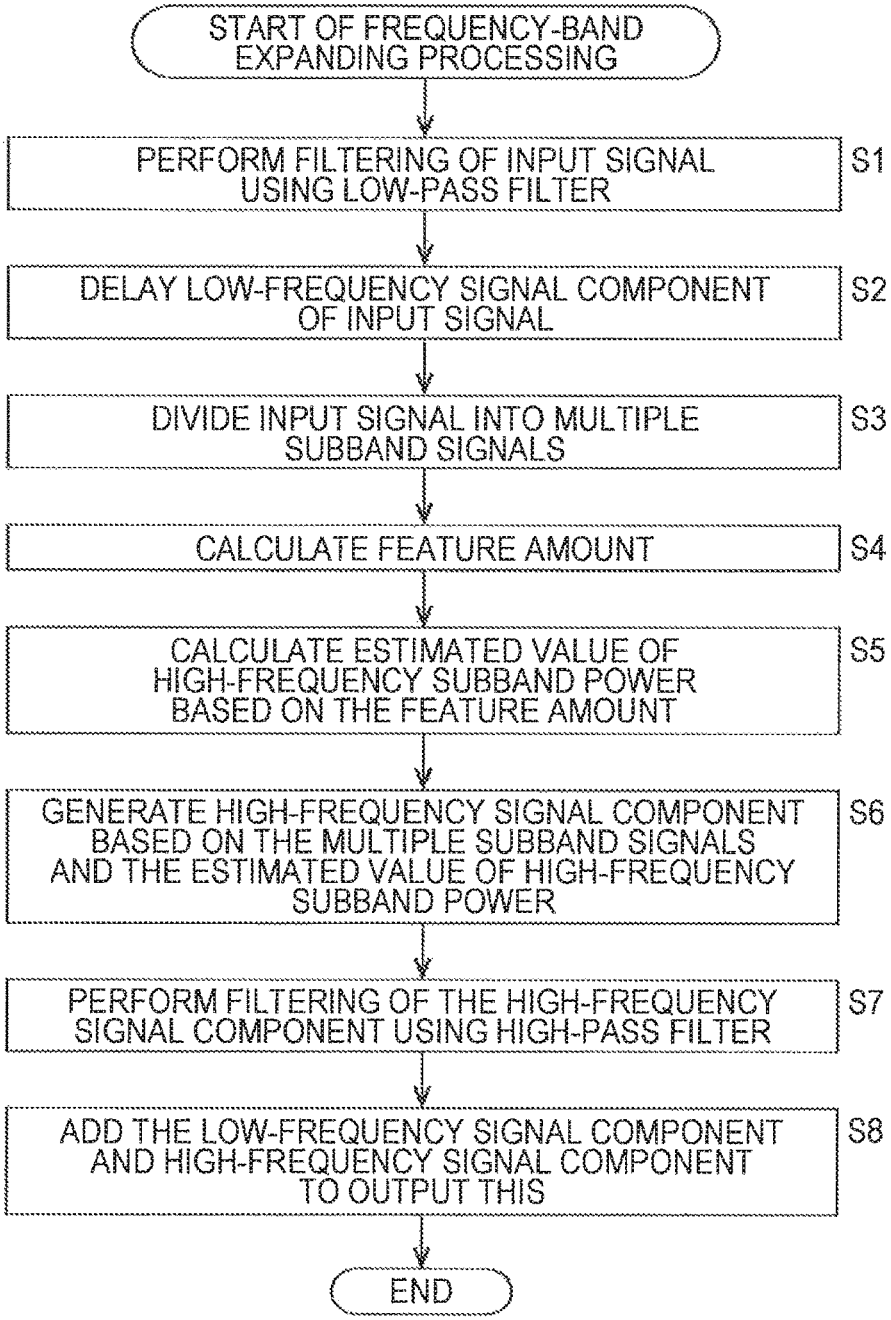
FIG. 4 is a flowchart for describing frequency band expanding processing by the frequency band expanding device in FIG. 3.

Specifically, in step S4 in the flowchart in FIG. 4, the feature amount calculating circuit 14 calculates a low-frequency subband power and dip from the four subband signals for each subband from the band pass filters 13 as feature amounts to supply to the high-frequency subband power estimating circuit 15.

In step S5, the high-frequency subband power estimating circuit 15 calculates an estimated value for a high-frequency subband power based on the four low-frequency subband powers and dip from the feature amount calculating circuit 14.

Here, between the subband powers and the dip, a range (scale) of a value to be obtained differs, and accordingly the high-frequency subband power estimating circuit 15 performs the following conversion on the value of the dip, for example.

The high-frequency subband power estimating circuit 15 calculates the highest-frequency subband power of the four low-frequency subband powers and the value of the dip regarding a great number of input signals and obtains a mean value and standard deviation regarding each thereof beforehand. Now, let us say that a mean value of the subband powers is $power_{ave}$, standard deviation of the subband powers is $power_{std}$, a mean value of the dip is $dip_{ave}$, and standard deviation of the dip is $dip_{std}$.

The high-frequency subband power estimating circuit 15 converts the value dip(J) of the dip using these values such as the following Expression (12) to obtain a dip $dip_s(J)$ after conversation.

[Mathematical Expression 12]

$$dip_s(J) = \frac{\mathrm{dip}(J) - dip_{ave}}{dip_{std}} power_{std} + power_{ave} \tag{12}$$

According to conversion indicated in Expression (12) being performed, the high-frequency subband power estimating circuit 15 may convert the dip value dip(J) into a variable (dip) $dip_s(J)$ statistically equal to the average and dispersion of the low-frequency subband powers, and accordingly, an average of a value that the dip has may be set generally equal to a range of a value that the subband powers have.

With the frequency expanding band, an estimated value $power_{est}(ib, J)$ of a subband power of which the index is ib is represented by the following Expression (13) using linear coupling between the four low-frequency subband powers power(id, J) from the feature amount calculating circuit 14, and the dip $dip_s(J)$ indicated in Expression (12), for example.

[Mathematical Expression 13]

$$\mathrm{power}_{est}(ib, J) = \left( \sum_{kb=sb-3}^{sb} \{C_{ib}(kb)\mathrm{power}(kb, J)\} \right) + D_{ib} dip_s(J) + E_{ib} \quad (J * FSIZE \le n \le (J+1)FSIZE - 1,\ sb + 1 \le ib \le eb) \tag{13}$$

Here, in Expression (13), coefficients $C_{ib}(kb)$, $D_{ib}$, and $E_{ib}$ are coefficients having a different value for each subband id. Let us say that the coefficients $C_{ib}(kb)$, $D_{ib}$, and $E_{ib}$ are coefficients to be suitably set so as to obtain a suitable value for various input signals. Also, according to change in the subband sb, the coefficients $C_{ib}(kb)$, $D_{id}$, and $E_{ib}$ are also changed to optimal values. Note that derivation of the coefficients $C_{ib}(kb)$, $D_{ib}$, and $E_{ib}$ will be described later.

In Expression (13), though an estimated value of a high-frequency subband power is calculated by the primary linear coupling, not restricted to this, and for example, may be calculated using linear couplings of multiple feature amounts of several frames before and after the time frame J, or may be calculated using a non-linear function.

According to the above-mentioned processing, the value of the dip peculiar to a vocal section is used for estimation of a high-frequency subband power, thereby as compared to a case where only the low-frequency subband powers are taken as feature amounts, improving estimation precision of a high-frequency subband power at a vocal section, and reducing unnatural sensations that are readily sensed by the human ear, caused by a high-frequency subband power spectrum being estimated greater then the high-frequency power spectrum of the original signal using the technique wherein only low-frequency subband powers are taken as feature amounts, and accordingly, music signals may be played with higher sound quality.

Incidentally, with regard to the dip (recessed degree in the frequency characteristic at a vocal section) calculated as a feature amount by the above-mentioned technique, in the event that the number of divisions of subband is 16, frequency resolution is low, and accordingly, this recessed degree cannot be expressed with only the low-frequency subband powers.

Therefore, the number of subband divisions is increased (e.g., 256 divisions equivalent to 16 times), the number of band divisions by the band pass filters 13 is increased (e.g., 64 equivalent to 16 times), and the number of low-frequency subband powers to be calculated by the feature amount calculating circuit 14 is increased (e.g., 64 equivalent to 16 times), thereby improving the frequency resolution, and enabling a recessed degree to be expressed with low-frequency subband powers alone.

Thus, it is thought that a high-frequency subband power may be estimated with generally the same precision as estimation of a high-frequency subband power using the above-mentioned dip as a feature amount, using low-frequency subband powers alone.

However, the calculation amount is increased by increasing the number of subband divisions, the number of band divisions, and the number of low-frequency subband powers. If we consider that any technique may estimate a high-frequency subband power with similar precision, it is thought that a technique to estimate a high-frequency subband power without increasing the number of subband divisions, using the dip as a feature amount is effective in an aspect of calculator amount.

Though description has been made so far regarding the techniques to estimate a high-frequency subband power using the dip and low-frequency subband powers, a feature amount to be used for estimation of a high-frequency subband power is not restricted to this combination, one or multiple feature amounts described above (low-frequency subband powers, dip, temporal fluctuation of low-frequency subband powers, inclination, temporal fluctuation of inclination, and temporal fluctuation of dip) may be employed. Thus, precision may further be improved with estimation of a high-frequency subband power.

Also, as described above, with an input signal, a parameter peculiar to a section where estimation of a high-frequency subband power is difficult is employed as a feature amount to be used for estimation of a high-frequency subband power, thereby enabling estimation precision of the section thereof to be improved. For example, temporal fluctuation of low-frequency subband powers, inclination, temporal fluctuation of inclination, and temporal fluctuation of dip are parameters peculiar to attack sections, and these parameters are employed as feature amounts, thereby enabling estimation precision of a high-frequency subband power at an attack section to be improved.

Note that in the event that feature amounts other than the low-frequency subband powers and dip, i.e., temporal fluctuation of low-frequency subband powers, inclination, temporal fluctuation of inclination, and temporal fluctuation of dip are employed to perform estimation of a high-frequency subband power as well, a high-frequency subband power may be estimated by the same technique as the above-mentioned technique.

Note that the calculating techniques of the feature amounts mentioned here are not restricted to the above-mentioned techniques, and another technique may be employed.

[How to Obtain Coefficients $C_{ib}$(Kb), $D_{ib}$, and $E_{ib}$]

Next, description will be made regarding how to obtain the coefficients $C_{ib}$(kb), $D_{ib}$, and $E_{ib}$ in the above-mentioned Expression (13).

As a method to obtain the coefficients $C_{ib}$(kb), $D_{ib}$, and $E_{ib}$, in order to obtain suitable coefficients the coefficients $C_{ib}$(kb), $D_{ib}$, and $E_{ib}$ for various input signals at the time of estimating the subband power of the frequency expanding band, a technique will be employed wherein learning is performed using a broadband supervisory signal (hereinafter, referred to as broadband supervisory signal) beforehand, and the coefficients $C_{ib}$(kb), $D_{ib}$, and $E_{ib}$ are determined based on the learning results thereof.

At the time of performing learning of the coefficients $C_{ib}$(kb), $D_{ib}$, and $E_{ib}$ a coefficient learning device will be applied wherein band pass filters having the same pass bandwidths as the band pass filters 13-1 to 13-14 described with reference to FIG. 5 are disposed in a higher frequency than the expanding start band. The coefficient learning device performs learning when a broadband supervisory signal is input.

[Functional Configuration Example of Coefficient Learning Device]

Figure 9:
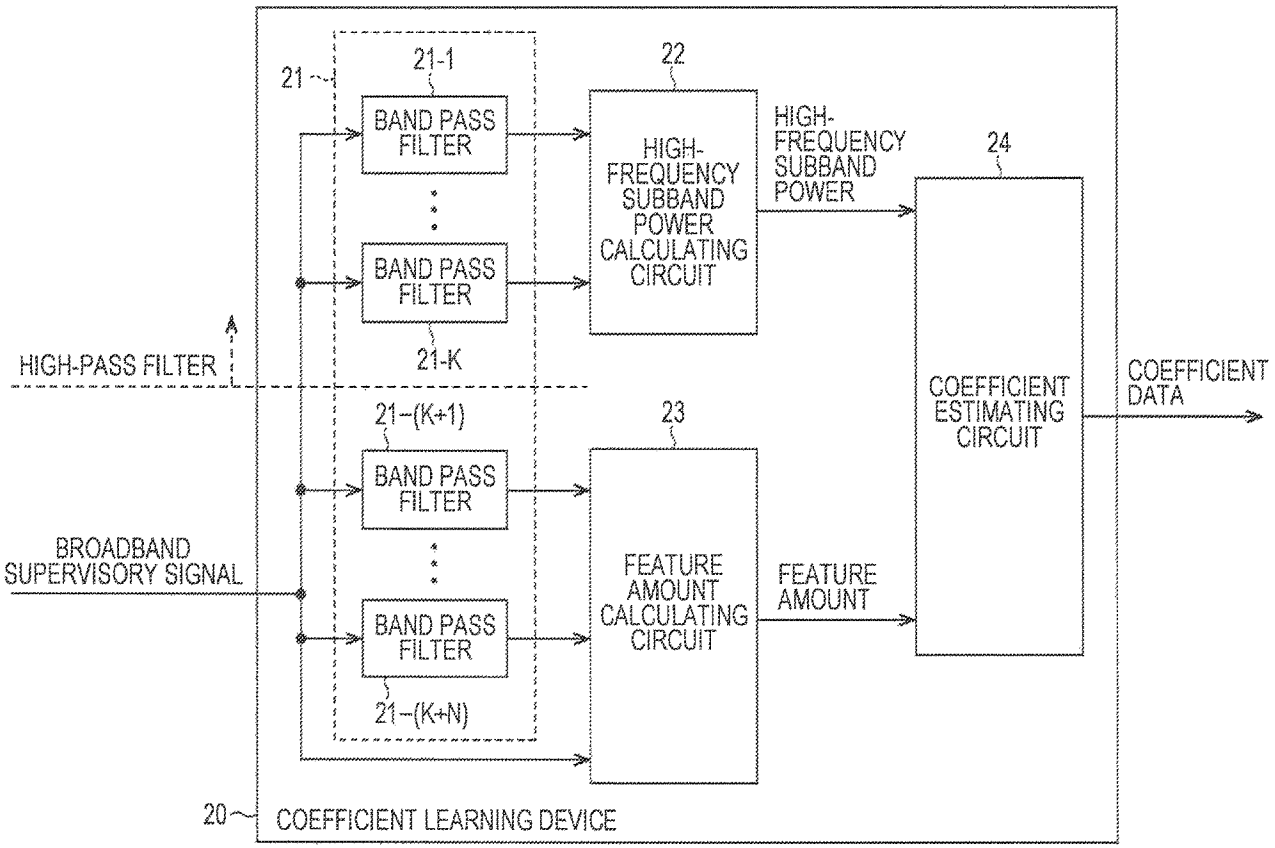
FIG. 9 is a block diagram illustrating a functional configuration example of a coefficient learning device for performing learning of a coefficient to be used at a high-frequency signal generating circuit of the frequency band expanding device in FIG. 3.

FIG. 9 illustrates a functional configuration example of a coefficient learning device to perform learning of the coefficients $C_{ib}$(kb), $D_{ib}$, and $E_{ib}$.

With regard to lower frequency signal components than the expanding start band of the broadband supervisory signal to be input to a coefficient learning device 20 in FIG. 9, it is desirable that an input signal band-restricted to be input to the frequency band expanding device 10 in FIG. 3 is a signal encoded by the same method as the encoding method subjected at the time of encoding.

The coefficient learning device 20 is configured of band pass filters 21, a high-frequency subband power calculating circuit 22, a feature amount calculating circuit 23, and a coefficient estimating circuit 24.

The band pass filters 21 are configured of band pass filters 21-1 to 21-(K+N) each having a different pass band. The band pass filter 21-$i$($1 \leq i \leq K+N$) passes a predetermined pass band signal of an input signal, and supplies this to the high-frequency subband power calculating circuit 22 or feature amount calculating circuit 23 as one of multiple subband signals. Note that, of the band pass filters 21-1 to 21-(K+N), the band pass filters 21-1 to 21-K pass a higher frequency signal than the expanding start band.

The high-frequency subband power calculating circuit 22 calculates a high-frequency subband power for each subband for each fixed time frame for high-frequency multiple subband signals from the band pass filters 21 to supply to the coefficient estimating circuit 24.

The feature amount calculating circuit 23 calculates the same feature amount as a feature amount calculated by the feature amount calculating circuit 14 of the frequency band expanding device 10 in FIG. 3 for each same frame as a fixed time frame where a high-frequency subband power is calculated by the high-frequency subband power calculation circuit 22. That is to say, the feature amount calculating circuit 23 calculates one or multiple feature amounts using at least one of the multiple subband signals from the band pass filters 21 and the broadband supervisory signal to supply to the coefficient estimating circuit 24.

The coefficient estimating circuit 24 estimates coefficients (coefficient data) to be used at the high-frequency subband power estimating circuit 15 of the frequency band expanding device 10 in FIG. 3 based on the high-frequency subband power from the high-frequency subband power calculating circuit 22, and the feature amounts from the feature amount calculating circuit 23 for each fixed time frame.

[Coefficient Learning Processing of Coefficient Learning Device]

Figure 10:
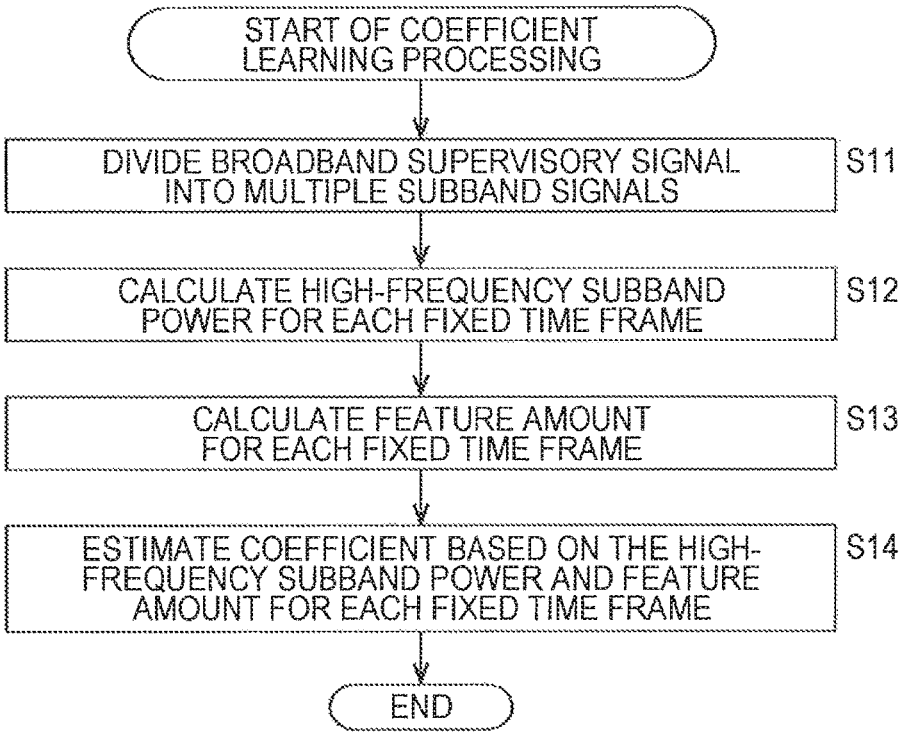
FIG. 10 is a flowchart for describing an example of coefficient learning processing by the coefficient learning device in FIG. 9.

Next, coefficient learning processing by the coefficient learning device in FIG. 9 will be described with reference to the flowchart in FIG. 10.

In step S11, the band pass filters 21 divide an input signal (broadband supervisory signal) into (K+N) subband signals. The band pass filters 21-1 to 21-K supply higher frequency multiple subband signals than the expanding start band to the high-frequency subband power calculating circuit 22. Also, the band pass filters 21-(K+1) to 21-(K+N) supply lower frequency multiple subband signals than the expanding start band to the feature amount calculating circuit 23.

In step S12, the high-frequency subband power circuit 22 calculates a high-frequency subband power power(ib, J) for each subband for each fixed time frame for high-frequency multiple subband signals from the band pass filters 21 (band pass filters 21-1 to 21-K). The high-frequency subband power power(ib, J) is obtained by the above-mentioned Expression (1). The high-frequency subband power calculating circuit 22 supplies the calculated high-frequency subband power to the coefficient estimating circuit 24.

In step S13, the feature amount calculating circuit 23 calculates a feature amount for each same time frame as a fixed time frame where a high-frequency subband power is calculated by the high-frequency subband power calculating circuit 22.

With the feature amount calculating circuit 14 of the frequency band expanding device 10 in FIG. 3, it has been assumed that low-frequency four subband powers and a dip are calculated as feature amounts, and similarly, with the feature amount calculating circuit 23 of the coefficient learning device 20 as well, description will be made assuming that the low-frequency four subband powers and dip are calculated.

Specifically, the feature amount calculating circuit 23 calculates four low-frequency subband powers using four subband signals having the same bands as four subband signals to be input to the feature amount calculating circuit 14 of the frequency band expanding device 10, from the band pass filters 21 (band pass filters 21-(K+1) to 21-(K+4)). Also, the feature amount calculating circuit 23 calculates a dip from the broadband supervisory signal, and calculates a dip $dip_s(J)$ based on the above-mentioned Expression (12). The feature amount calculating circuit 23 supplies the calculated four low-frequency subband powers and dip $dip_s(J)$ to the coefficient estimating circuit 24 as feature amounts.

In step S14, the coefficient estimating circuit 24 performs estimation of the coefficients $C_{ib}$(kb), $D_{ib}$, and $E_{ib}$ based on a great number of combinations between (eb−sb) high-frequency subband powers and the feature amounts (four low-frequency subband powers and dip $dip_s(J)$) supplied from the high-frequency subband power calculating circuit 22 and feature amount calculating circuit 23 at the time frame. For example, the coefficient estimating circuit 24 takes, regarding a certain high-frequency subband, five feature amounts (four low-frequency subband powers and dip $dip_s(J)$) as explanatory variables, and takes the high-frequency subband power power(ib, J) as an explained variable to perform regression analysis using the least square method, thereby deterring the coefficients $C_{ib}(kb)$, $D_{ib}$, and $E_{ib}$ in Expression (13).

Note that, it goes without saying that the estimating technique for the coefficients $C_{ib}(kb)$, $D_{ib}$, and $E_{ib}$ is not restricted to the above-mentioned technique, and common various parameter identifying methods may be employed.

According to the above-mentioned processing, learning of the coefficients to be used for estimation of a high-frequency subband power is performed using the broadband supervisory signal beforehand, and accordingly, suitable output results may be obtained for various input signals to be input to the frequency band expanding device 10, and consequently, music signals may be played with higher sound quality.

Note that the coefficients $A_{ib}(kb)$ and $B_{ib}$ in the above-mentioned Expression (2) may also be obtained by the above-mentioned coefficient learning method.

Description has been made so far regarding the coefficient learning processing assuming that, with the high-frequency subband power estimating circuit 15 of the frequency band expanding device 10, a promise that an estimated value of each high-frequency subband power is calculated by linear coupling between the four low-frequency subband powers and dip. However, the technique for estimating a high-frequency subband power at the high-frequency subband power estimating circuit 15 is not restricted to the above-mentioned example, and a high-frequency subband power may be calculated by the feature amount calculating circuit 14 calculating one or multiple feature amounts (temporal fluctuation of low-frequency subband power, inclination, temporal fluctuation of inclination, and temporal fluctuation of a dip) other than a dip, or linear coupling between multiple feature amounts of multiple frames before and after the time frame J may be employed, or a non-linear function may be employed. That is to say, with the coefficient learning processing, it is sufficient for the coefficient estimating circuit 24 to calculate (learn) the coefficients with the same conditions as conditions regarding feature amounts, time frame, and a function to be used at the time of a high-frequency subband power being calculated by the high-frequency subband power estimating circuit 15 of the frequency band expanding device 10.

2. Second Embodiment

With the second embodiment, the input signal is subjected to encoding processing and decoding processing in the high-frequency characteristic encoding technique by an encoding device and a decoding device.

[Functional Configuration Example of Encoding Device]

Figure 11:
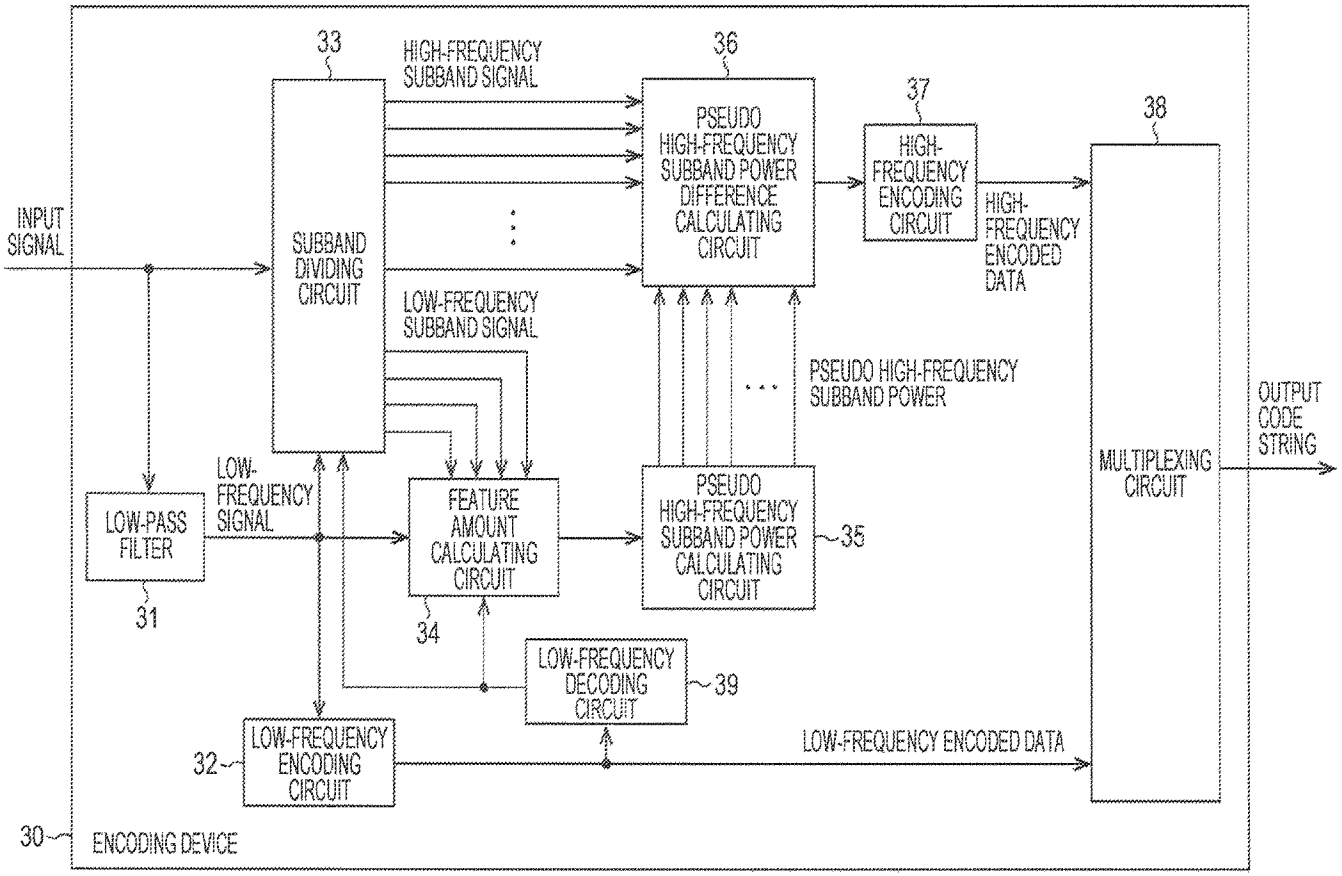
FIG. 11 is a block diagram illustrating a functional configuration example of an encoding device according to a second embodiment of the present invention.

FIG. 11 illustrates a functional configuration example of an encoding device to which the present invention has been applied.

An encoding device 30 is configured of a low-pass filter 31, a low-frequency encoding circuit 32, a subband dividing circuit 33, a feature amount calculating circuit 34, a pseudo high-frequency subband power calculating circuit 35, a pseudo high-frequency subband power difference calculating circuit 36, a high-frequency encoding circuit 37, a multiplexing circuit 38, and a low-frequency decoding circuit 39.

The low-pass filter 31 subjects an input signal to filtering with a predetermined cutoff frequency, and supplies a lower frequency signal (hereinafter, referred to as low-frequency signal) than the cutoff frequency to the low-frequency encoding circuit 32, subband dividing circuit 33 and feature amount calculating circuit 34 as a signal after filtering.

The low-frequency encoding circuit 32 encodes the low-frequency signal from the low-pass filter 31, and supplies low-frequency encoded data obtained as a result thereof to the multiplexing circuit 38 and low-frequency decoding circuit 39.

The subband dividing circuit 33 equally divides the input signal and the low-frequency signal from the low-pass filter 31 into multiple subband signals having predetermined bandwidth to supply to the feature amount calculating circuit 34 or pseudo high-frequency subband power difference calculating circuit 36. More specifically, the subband dividing circuit 33 supplies multiple subband signals (hereinafter, referred to as low-frequency subband signals) obtained with the low-frequency signals as input to the feature amount calculating circuit 34. Also, the subband dividing circuit 33 supplies, of multiple subband signals obtained with the input signal as input, higher frequency subband signals (hereinafter, refereed to as high-frequency subband signals) than a cutoff frequency set at the low-pass filter 31 to the pseudo high-frequency subband power difference calculating circuit 36.

The feature amount calculating circuit 34 calculates one or multiple feature amounts using at least any one of the multiple subband signals of the low-frequency subband signals from the subband dividing circuit 33, and the low-frequency signal from the low-pass filter 31 to supply to the pseudo high-frequency subband power calculating circuit 35.

The pseudo high-frequency subband power calculating circuit 35 generates a pseudo high-frequency subband power based on the one or multiple feature amounts from the feature amount calculating circuit 34 to supply to the pseudo high-frequency subband power difference calculating circuit 36.

The pseudo high-frequency subband power difference calculating circuit 36 calculates later-described pseudo high-frequency subband power difference based on the high-frequency subband signal from the subband dividing circuit 33, and the pseudo high-frequency subband power from the pseudo high-frequency subband power calculating circuit 35 to supply to the high-frequency encoding circuit 37.

The high-frequency encoding circuit 37 encodes the pseudo high-frequency subband power difference from the pseudo high-frequency subband power difference calculating circuit 36 to supply high-frequency encoded data obtained as a result thereof to the multiplexing circuit 38.

The multiplexing circuit 38 multiplexes the low-frequency encoded data from the low-frequency encoding circuit 32, and the high-frequency encoded data from the high-frequency encoding circuit 37 to output as an output code string.

The low-frequency decoding circuit 39 decodes the low-frequency encoded data from the low-frequency encoding circuit 32 as appropriate to supply decoded data obtained as a result thereof to the subband dividing circuit 33 and feature amount calculating circuit 34.

[Encoding Processing of Encoding Device]

Next, encoding processing by the encoding device 30 in FIG. 11 will be described with reference to the flowchart in FIG. 12.

In step S111, the low-pass filter 31 subjects an input signal to filtering with a predetermined cutoff frequency to supply a low-frequency signal serving as a signal after filtering to the low-frequency encoding circuit 32, subband dividing circuit 33 and feature amount calculating circuit 34.

In step S112, the low-frequency encoding circuit 32 encodes the low-frequency signal from the low-pass filter 31 to supply low-frequency encoded data obtained as a result thereof to the multiplexing circuit 38.

Note that, with regard to encoding of the low-frequency signal in step S112, it is sufficient for a suitable coding system to be selected according to encoding efficiency or a circuit scale to be requested, and the present invention does not depend on this coding system.

In step S113, the subband dividing circuit 33 equally divides the input signal and low-frequency signal into multiple subband signals having a predetermined bandwidth. The subband dividing circuit 33 supplies low-frequency subband signals obtained with the low-frequency signal as input to the feature amount calculating circuit 34. Also, the subband dividing circuit 33 supplies, of the multiple subband signals with the input signals as input, high-frequency subband signals having a higher band than the frequency of the band limit set at the low-pass filter 31 to the pseudo high-frequency subband power difference calculating circuit 36.

In step S114, the feature amount calculating circuit 34 calculates one or multiple feature amounts using at least any one of the multiple subband signals of the low-frequency subband signals from the subband dividing circuit 33, and the low-frequency signal from the low-pass filter 31 to supply to the pseudo high-frequency subband power calculating circuit 35. Note that the feature amount calculating circuit 34 in FIG. 11 has basically the same configuration and function as with the feature amount calculating circuit 14 in FIG. 3, and the processing in step S114 is basically the same as processing in step S4 in the flowchart in FIG. 4, and accordingly, detailed description thereof will be omitted.

In step S115, the pseudo high-frequency subband power calculating circuit 35 generates a pseudo high-frequency subband power based on one or multiple feature amounts from the feature amount calculating circuit 34 to supply to the pseudo high-frequency subband power difference calculating circuit 36. Note that the pseudo high-frequency subband power calculating circuit 35 in FIG. 11 has basically the same configuration and function as with the high-frequency subband power estimating circuit 15 in FIG. 3, and the processing in step S115 is basically the same as processing in step S5 in the flowchart in FIG. 4, and accordingly, detailed description thereof will be omitted.

In step S116, the pseudo high-frequency subband power difference calculating circuit 36 calculates pseudo high-frequency subband power difference based on the high-frequency subband signal from the subband dividing circuit 33, and the pseudo high-frequency subband power from the pseudo high-frequency subband power calculating circuit 35 to supply to the high-frequency encoding circuit 37.

More specifically, the pseudo high-frequency subband power difference calculating circuit 36 calculates a high-frequency subband power power(ib, J) in a certain fixed time frame J regarding the high-frequency subband signal from the subband dividing circuit 33. Now, with the present embodiment, let as say that all of the subband of the low-frequency subband signal and the subband of the high-frequency subband signal is identified using the index ib. The subband power calculating technique is the same technique as with the first embodiment, i.e., the technique using Expression (1) may be applied.

Next, the pseudo high-frequency subband power difference calculating circuit 36 obtains difference (pseudo high-frequency subband power difference) $\text{power}_{diff}(\text{ib, J})$ between the high-frequency subband power power(ib, J) and the pseudo high-frequency subband power $\text{power}_{lh}(\text{ib, J})$ from the pseudo high-frequency subband power calculating circuit 35 in the time frame J. The pseudo high-frequency subband power difference $\text{power}_{diff}(\text{ib, J})$ is obtained by the following Expression (14).

[Mathematical Expression 14]

$$\text{power}_{diff}(ib,J)=\text{power}(ib,J)-\text{power}_{lh}(ib,J)$$

$$(J*F\text{SIZE}\leq n\leq(J+1)F\text{SIZE}-1, sb+1\leq ib\leq eb) \quad (14)$$

In Expression (14), index sb+1 represents the index of the lowest-frequency subband of high-frequency subband signals. Also, index eb represents the index of the highest-frequency subband to be encoded of high-frequency subband signals.

In this manner, the pseudo high-frequency subband power difference calculated by the pseudo high-frequency subband power difference calculating circuit 36 is supplied to the high-frequency encoding circuit 37.

In step S117, the high-frequency encoding circuit 37 encodes the pseudo high-frequency subband power difference from the pseudo high-frequency subband power difference calculating circuit 36, to supply high-frequency encoded data obtained as a result thereof to the multiplexing circuit 38.

More specifically, the high-frequency encoding circuit 37 determines which cluster of multiple clusters in characteristic space of the pseudo high-frequency subband power difference set beforehand a vector converted from the pseudo high-frequency subband power difference from the pseudo high-frequency subband power difference calculating circuit 36 (hereinafter, referred to as pseudo high-frequency subband difference vector) belongs to. Here, the pseudo high-frequency subband power difference vector in a certain time frame J indicates a (eb−sb)-dimensional vector having the value of the pseudo high-frequency subband power difference $\text{power}_{diff}(\text{ib, j})$ for each index ib as each element. Also, the characteristic space of the pseudo high-frequency subband power difference is also the (eb−sb)-dimensional space.

The high-frequency encoding circuit 37 measures, with the characteristic space of the pseudo high-frequency subband power difference, distance between each representative vector of multiple clusters set beforehand and the pseudo high-frequency subband power difference vector, obtains an index of a cluster having the shortest distance (hereinafter, referred to as pseudo high-frequency subband power difference ID), and supplies this to the multiplexing circuit 38 as high-frequency encoded data.

In step S118, the multiplexing circuit 38 multiplexes the low-frequency encoded data output from the low-frequency encoding circuit 32, and the high-frequency encoded data output from the high-frequency encoding circuit 37, and outputs a output code string.

Incidentally, as an encoding device according to the high-frequency characteristic encoding technique, a technique, has been disclosed in Japanese Unexamined Patent Application Publication No. 2007-17908 wherein a pseudo high-frequency subband signal is generated from a low-frequency subband signal, the pseudo high-frequency subband signal, and the power of a high-frequency subband signal are compared for each subband, the gain of power for each subband is calculated so as to match the power of the pseudo high-frequency subband and the power of the high-frequency subband signal, and this is included in a code string as high-frequency characteristic information.

On the other hand, according to the above-mentioned processing, as information for estimating a high-frequency subband power at the time of decoding, it is sufficient for the pseudo high-frequency subband power difference ID alone to be included in the output code string. Specifically, for example, in the event that the number of clusters set beforehand is 64, as information for restoring a high-frequency signal at the decoding device, it is sufficient for 6-bit information alone per one time frame to be added to the code string, and as compared to a technique disclosed in Japanese Unexamined Patent Application Publication No. 2007-17908, information volume to be included in the code string may be reduced, and accordingly, encoding efficiency may be improved, and consequently, music signals may be played with higher sound quality.

Also, with the above-mentioned processing, if there is room for computation volume, a low-frequency signal obtained by the low-frequency decoding circuit 39 decoding the low-frequency encoded data from the low-frequency encoding circuit 32 may be input to the subband dividing circuit 33 and feature amount calculating circuit 34. With decoding processing by the decoding device, a feature amount is calculated from the low-frequency signal decoded from the low-frequency encoded data, and the power of a high-frequency subband is estimated based on the feature amount thereof. Therefore, with the encoding processing as well, in the event that the pseudo high-frequency subband power difference ID to be calculated based on the feature amount calculated from the decoded low-frequency signal is included in the code string, with the decoding processing by the decoding device, a high-frequency subband power may be estimated with higher precision. Accordingly, music signals may be played with higher sound quality.

[Functional Configuration Example of Decoding Device]

Next, a functional configuration example of a decoding device corresponding to the encoding device 30 in FIG. 11, will be described with reference to FIG. 13.

A decoding device 40 is configured of a demultiplexing circuit 41, a low-frequency decoding circuit 42, a subband dividing circuit 43, a feature amount calculating circuit 44, a high-frequency decoding circuit 45, a decoded high-frequency subband power calculating circuit 46, a decoded high-frequency signal generating circuit 47, and a synthesizing circuit 48.

The demultiplexing circuit 41 demultiplexes an input code string into high-frequency encoded data and low-frequency encoded data, supplies the low-frequency encoded data to the low-frequency decoding circuit 42, and supplies the high-frequency encoded data to the high-frequency decoding circuit 45.

The low-frequency decoding circuit 42 performs decoding of the low-frequency encoded data from the demultiplexing circuit 41. The low-frequency decoding circuit 42 supplies a low-frequency signal obtained as a result of decoding (hereinafter, referred to as decoded low-frequency signal) to the subband dividing circuit 43, feature amount calculating circuit 44, and synthesizing circuit 48.

The subband dividing circuit 43 equally divides the decoded low-frequency signal from the low-frequency decoding circuit 42 into multiple subband signals having a predetermined bandwidth, and supplies the obtained subband signals (decoded low-frequency subband signals) to the feature amount calculating circuit 44 and decoded high-frequency signal generating circuit 47.

The feature amount calculating circuit 44 calculates one or multiple feature amounts using at least any one of multiple subband signals of the decoded low-frequency subband signals from the subband diving circuit 43, and the decoded low-frequency signal to supply to the decoded high-frequency subband power calculating circuit 46.

The high-frequency decoding circuit 45 performs decoding of the high-frequency encoded data from the demultiplexing circuit 41, and uses a pseudo high-frequency subband power difference ID obtained as a result thereof to supply a coefficient for estimating the power of a high-frequency subband (hereinafter, referred to as decoded high-frequency subband power estimating coefficient) prepared beforehand for each ID (index) to the decoded high-frequency subband power calculating circuit 46.

The decoding high-frequency subband power calculating circuit 46 calculates a decoded high-frequency subband power based on the one or multiple feature amounts, and the decoded high-frequency subband power estimating coefficient from the high-frequency decoding circuit 45 to supply to the decoded high-frequency signal generating circuit 47.

The decoded high-frequency signal generating circuit 47 generates a decoded high-frequency signal based on the decoded low-frequency subband signals from the subband dividing circuit 43, and the decoded high-frequency subband power from the decoded high-frequency subband power calculating circuit 46 to supply to the synthesizing circuit 48.

The synthesizing circuit 48 synthesizes the decoded low-frequency signal from the low-frequency decoding circuit 42, and the decoded high-frequency signal from the decoded high-frequency signal generating circuit 47, and output this as an output signal.

[Decoding Processing of Decoding Device]

Next, decoding processing by the decoding device in FIG. 13 will be described with reference to the flowchart in FIG. 14.

In step S131, the demultiplexing circuit 41 demultiplexes an input code string into high-frequency encoded data and low-frequency encoded data, supplies the low-frequency encoded data to the low-frequency circuit 42, and supplies the high-frequency encoded data to the high-frequency decoding circuit 45.

In step S132, the low-frequency decoding circuit 42 performs decoding of the low-frequency encoded data from the demultiplexing circuit 41, and supplies a decoded low-frequency signal obtained as a result thereof to the subband dividing circuit 43, feature amount calculating circuit 44, and synthesizing circuit 48.

In step S133, the subband dividing circuit 43 equally divides the decoded low-frequency signal from the low-frequency decoding circuit 42 into multiple subband signals having a predetermined bandwidth, and supplies the obtained decoded low-frequency subband signals to the feature amount calculating circuit 44 and decoded high-frequency signal generating circuit 47.

In step S134, the feature amount calculating circuit 44 calculates one or multiple feature amounts from at least any one of multiple subband signals, of the decoded low-frequency subband signals from the subband dividing circuit 43, and the decoded low-frequency signal from the low-frequency decoding circuit 42 to supply to the decoded high-frequency subband power calculating circuit 46. Note that the feature amount calculating circuit 44 in FIG. 13 has basically the same configuration and function as with the feature amount calculating circuit 14 in FIG. 3, and the processing in the step S134 is basically the same as the processing in step S4 in the flowchart in FIG. 4, and accordingly, detailed description thereof will be omitted.

In step S135, the high-frequency decoding circuit 45 performs decoding of the high-frequency encoded data from the demultiplexing circuit 41, uses a pseudo high-frequency subband power difference ID obtained as a result thereof to supply a decoded high-frequency subband power estimating coefficient prepared beforehand for each ID (index) to the decoded high-frequency subband power calculating circuit 46.

In step S136, the decoded high-frequency subband power calculating circuit 46 calculates a decoded high-frequency subband power based on the one or multiple feature amounts from the feature amount calculating circuit 44, and the decoded high-frequency subband power estimating coefficient from the high-frequency decoding circuit 45 to supply to the decoded high-frequency signal generating circuit 47. Note that the decoded high-frequency subband power calculating circuit 46 in FIG. 13 has basically the same configuration and function as with the high-frequency subband power estimating circuit 15 in FIG. 3, and the processing in step S136 is basically the same as the processing in step S5 in the flowchart in FIG. 4, and accordingly, detailed description thereof will be omitted.

In step S137, the decoded high-frequency signal generating circuit 47 outputs a decoded high-frequency signal based on the decoded low-frequency subband signal from the subband dividing circuit 43, and the decoded high-frequency subband power from the decoded high-frequency subband power calculating circuit 46. Note that the decoded high-frequency signal generating circuit 47 in FIG. 13 has basically the same configuration and function as with the high-frequency signal generating circuit 16 in FIG. 3, and the processing in step S137 is basically the same as the processing in step S6 in the flowchart in FIG. 4, and accordingly, detailed description thereof will be omitted.

In step S138, the synthesizing circuit 48 synthesizes the decoded low-frequency signal from the low-frequency decoding circuit 42, and the decoded high-frequency signal from the decoded high-frequency signal generating circuit 47 to output this as an output signal.

According to the above-mentioned processing, there is employed the high-frequency subband power estimating coefficient at the time of decoding, according to features of difference between the pseudo high-frequency subband power calculated beforehand at the time of encoding, and the actual high-frequency subband power, and accordingly, estimation precision of a high-frequency subband power at the time of decoding may be improved, and consequently, music signals may be played with higher sound quality.

Also, according to the above-mentioned processing, information for generating a high-frequency signal included in the code string is just the pseudo high-frequency subband power difference ID alone, and accordingly, the decoding processing may effectively be performed.

Though description has been made regarding the encoding processing and decoding processing to which the present invention has been applied, hereinafter, description will be made regarding a technique to calculate the representative vector of each of the multiple clusters in the characteristic space of the pseudo high-frequency subband power difference set beforehand at the high-frequency encoding circuit 37 of the encoding device 30 in FIG. 11, and a decoded high-frequency subband power estimating coefficient to be output by the high-frequency decoding circuit 45 of the decoding device 40 in FIG. 13.

[Calculation Technique of Representative Vectors of Multiple Clusters in Characteristic Space of Pseudo High-Frequency Subband Power Difference, and Decoded High-Frequency Subband Power Estimating Coefficient Corresponding to Each Cluster]

As a method for obtaining representative vectors of the multiple clusters and a decoded high-frequency subband power estimating coefficient of each cluster, a coefficient needs to be prepared so as to estimate a high-frequency subband power at the time of decoding with high precision according to a pseudo high-frequency subband power difference vector to be calculated at the time of encoding. Therefore, there will be applied a technique to perform learning using a broadband supervisory signal beforehand, and to determine these based on learning results thereof.

[Functional Configuration Example of Coefficient Learning Device]

Figure 15:
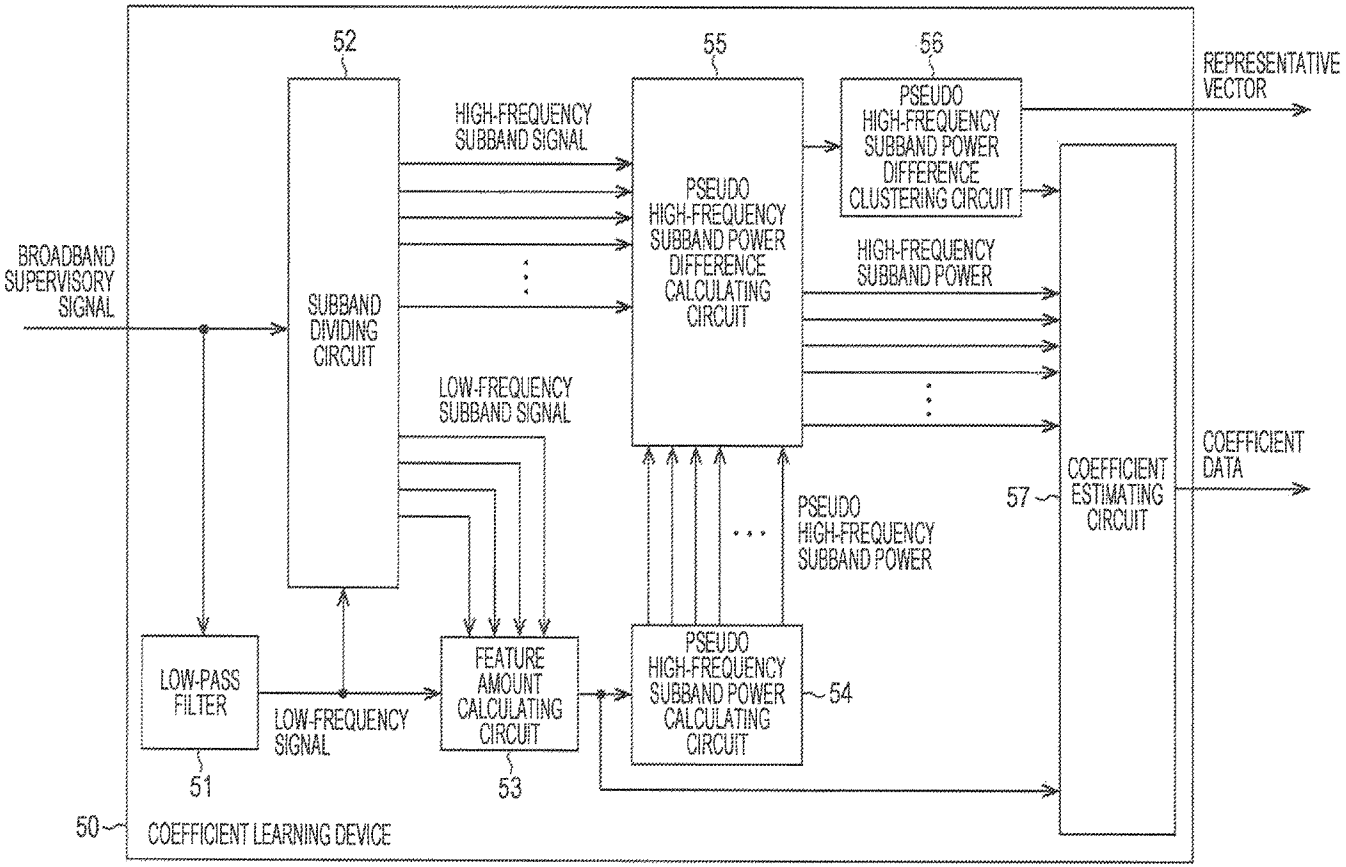
FIG. 15 is a block diagram illustrating a functional configuration example of a coefficient learning device for performing learning of a representative vector to be used at a high-frequency encoding circuit of the encoding device in FIG. 11, and a decoded high-frequency subband power estimating coefficient to be used at the high-frequency decoding circuit of the decoding device in FIG. 13.

FIG. 15 illustrates a functional configuration example of a coefficient learning device to perform learning of representative vectors of the multiple clusters, and a decoded high-frequency subband power estimating coefficient of each cluster.

It is desirable that of a broadband supervisory signal to be input to the coefficient learning device 50 in FIG. 15, a signal component equal to or smaller than a cutoff frequency to be set at the low-pass filter of the encoding device 30 is a decoded low-frequency signal obtained by an input signal to the encoding device 30 passing through the low-pass filter 31, encoded by the low-frequency encoding circuit 32, and further decoded by the low-frequency decoding circuit 42 of the decoding device 40.

The coefficient learning device 50 is configured of a low-pass filter 51, a subband dividing circuit 52, a feature amount calculating circuit 53, a pseudo high-frequency subband power calculating circuit 54, a pseudo high-frequency subband power difference calculating circuit 55, a pseudo high-frequency subband power difference clustering circuit 56, and a coefficient estimating circuit 57.

Note that the low-pass filter 51, subband dividing circuit 52, feature amount calculating circuit 53, and pseudo high-frequency subband power calculating circuit 54 of the coefficient learning device 50 in FIG. 15 have basically the same configuration and function as the low-pass filter 31, subband dividing circuit 33, feature amount calculating circuit 34, and pseudo high-frequency subband power calculating circuit 35 in FIG. 11 respectively, and accordingly, description thereof will be omitted.

Specifically, the pseudo high-frequency subband power difference calculating circuit 55 has the same configuration and function as with the pseudo high-frequency subband power difference calculating circuit 36 in FIG. 11, and not only supplies the calculated pseudo high-frequency subband power difference to the pseudo high-frequency subband power difference clustering circuit 56 but also supplies a high-frequency subband power to be calculated at the time of calculating pseudo high-frequency subband power difference to the coefficient estimating circuit 57.

The pseudo high-frequency subband power difference clustering circuit 56 subjects a pseudo high-frequency subband power difference vector obtained from the pseudo high-frequency subband power difference from the pseudo high-frequency subband power difference calculating circuit 55 to clustering to calculate a representative vector at each cluster.

The coefficient estimating circuit 57 calculates a high-frequency subband power estimating coefficient for each cluster, subjected to clustering by the pseudo high-frequency subband power difference clustering circuit 56, based on the high-frequency subband power from the pseudo high-frequency subband power difference calculating circuit 55, and the one or multiple feature amounts from the feature amount calculating circuit 53.

[Coefficient Learning Processing of Coefficient Learning Device]

Next, coefficient learning processing by the coefficient learning device 50 in FIG. 15 will be described with reference to the flowchart in FIG. 16.

Figure 12:
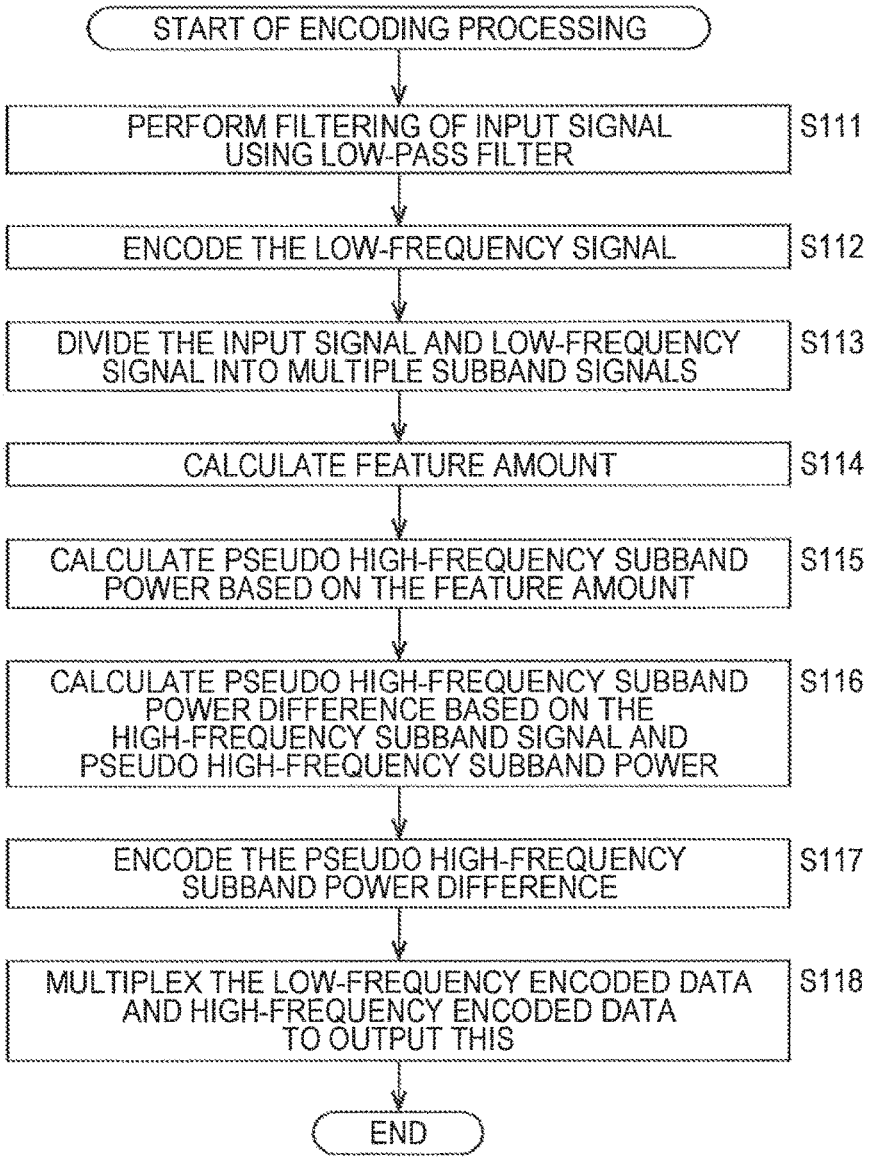
FIG. 12 is a flowchart for describing an example of encoding processing by the encoding device in FIG. 11.
Figure 16:
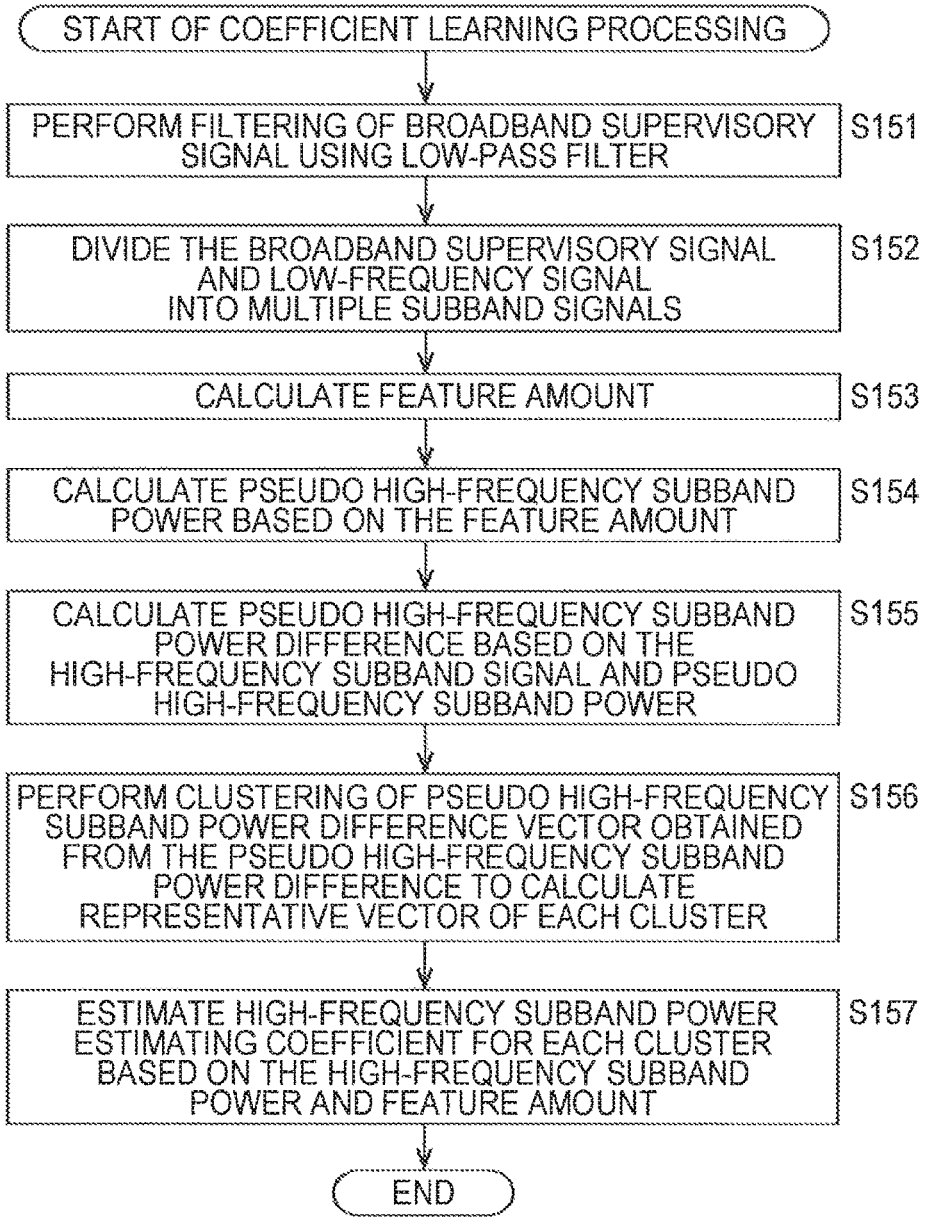
FIG. 16 is a flowchart for describing an example of coefficient learning processing by the coefficient learning device in FIG. 15.

Note that processing in steps S151 to S155 in the flowchart in FIG. 16 is the same as the processing in steps S111, and S113 to S116 in the flowchart in FIG. 12 except that a signal to be input to the coefficient learning device 50 is a broadband supervisory signal, and accordingly, description thereof will be omitted.

Specifically, in step S156, the pseudo high-frequency subband power difference clustering circuit 56 calculates the representative vector of each cluster by a great number of pseudo high-frequency subband power difference vectors (a lot of time frames) obtained from the pseudo high-frequency subband power difference from the pseudo high-frequency subband power difference calculating circuit 55 being subjected to clustering to 64 clusters for example. As an example of a clustering technique, clustering according to the k-means method may be applied, for example. The pseudo high-frequency subband power difference clustering circuit 56 takes the center-of-gravity vector of each cluster obtained as a result of performing clustering according to the k-means method as the representative vector of each cluster. Note that a technique for clustering and the number of clusters are not restricted to those mentioned above, and another technique may be employed.

Also, the pseudo high-frequency subband power difference clustering circuit 56 measures distance with the 64 representative vectors using a pseudo high-frequency subband power difference vector obtained from the pseudo high-frequency subband power difference from the pseudo high-frequency subband power difference calculating circuit 55 in the time frame J to determine an index CID(J) of a cluster to which a representative vector to provide the shortest distance belongs. Now, let us say that the index CID(J) takes an integer from 1 to the number of clusters (64 in this example). The pseudo high-frequency subband power difference clustering circuit 56 outputs a representative vector in this manner, and also supplies the index CID(J) to the coefficient estimating circuit 57.

In step S157, the coefficient estimating circuit 57 performs, of a great number of combinations between (eb−sb) high-frequency subband powers and feature amounts supplied from the pseudo high-frequency subband power difference calculating circuit 55 and feature amount calculating circuit 53 in the same time frame, calculation of a decoded high-frequency subband power estimating coefficient at each cluster for each group (belonging to the same cluster) having the same index CID(J). Now, let us say that the technique to calculate a coefficient by the coefficient estimating circuit 57 is the same as the technique by the coefficient estimating circuit 24 in the coefficient learning device 20 in FIG. 9, but it goes without saying that another technique may be employed.

Figure 13:
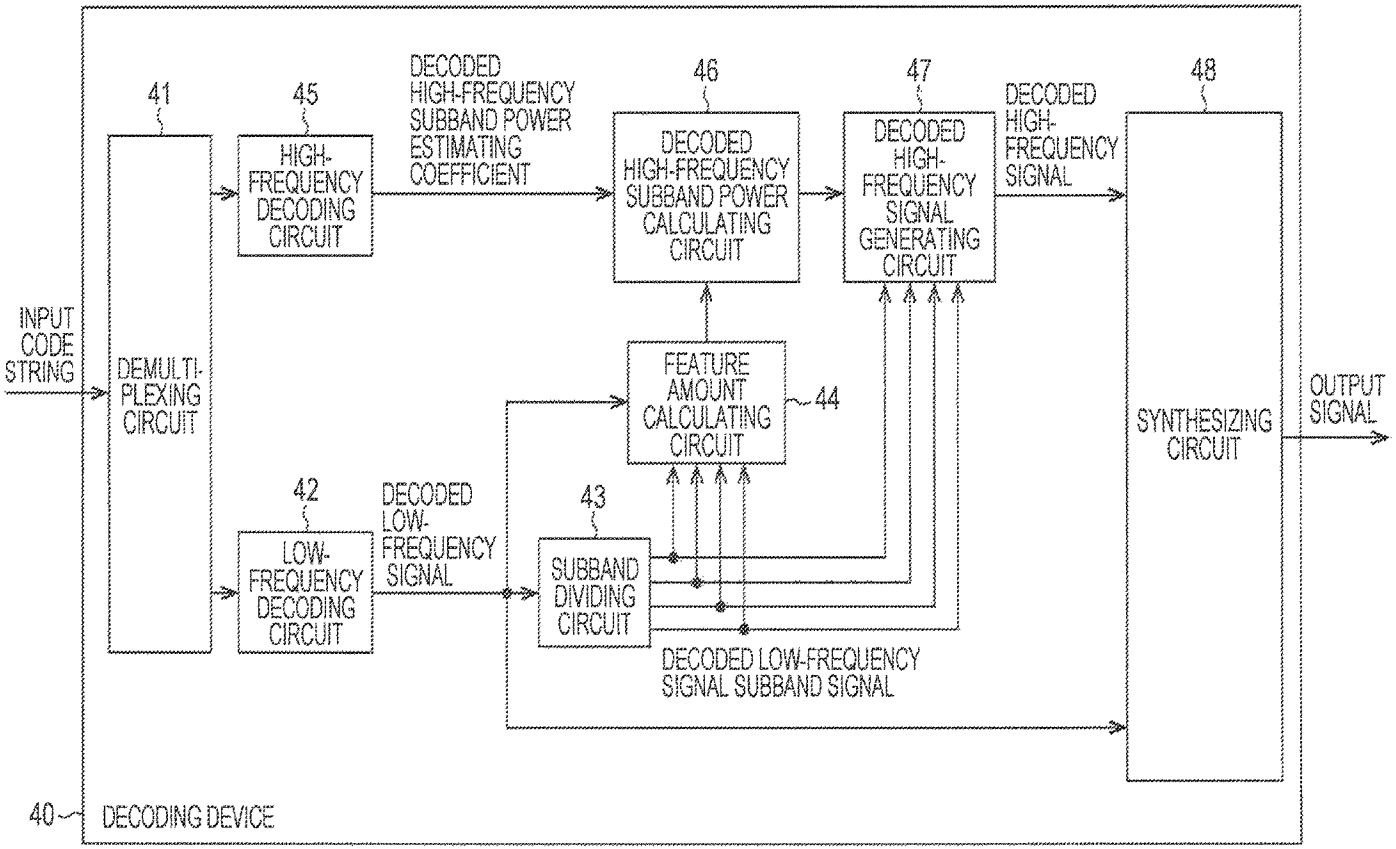
FIG. 13 is a block diagram illustrating a functional configuration example of a decoding device according to the second embodiment of the present invention.
Figure 14:
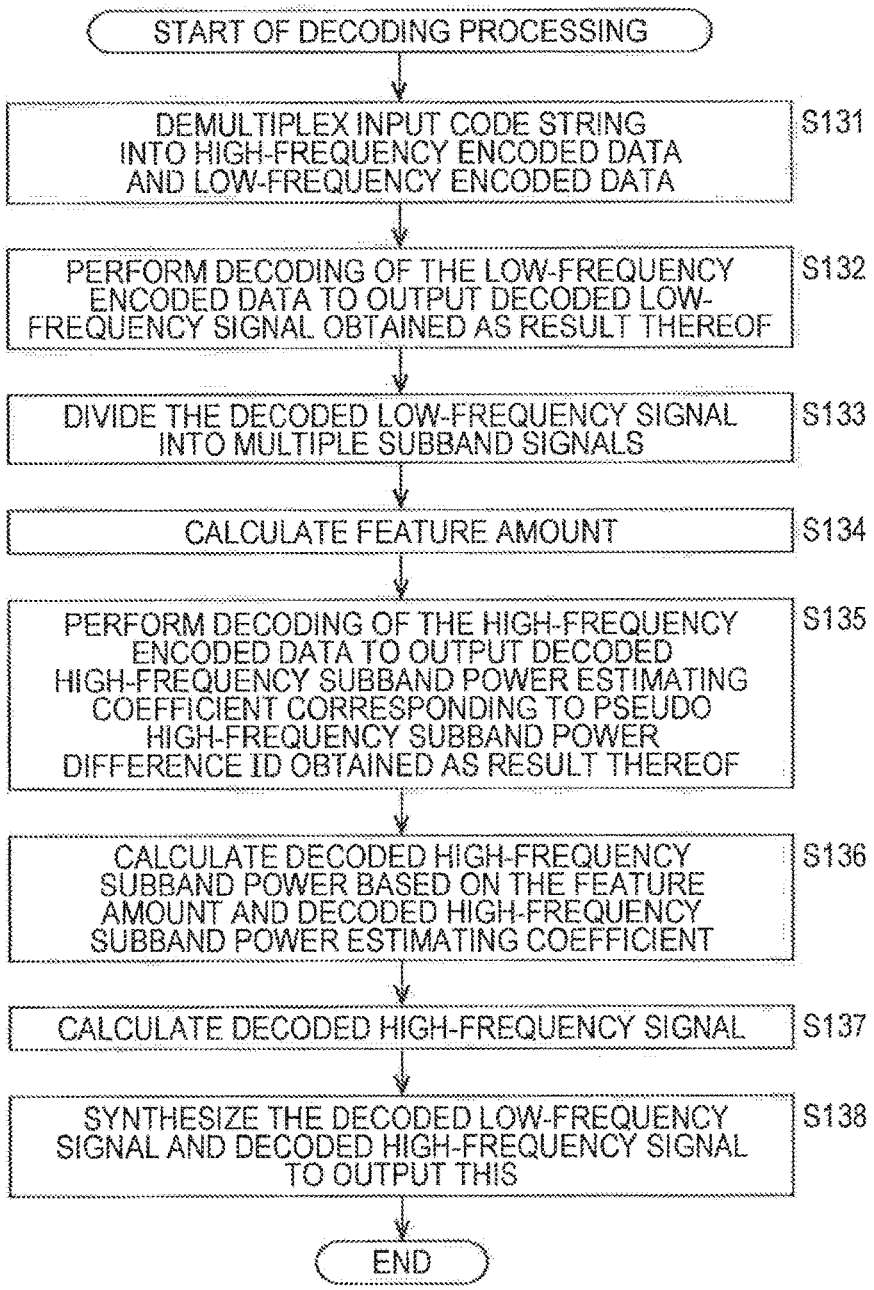
FIG. 14 is a flowchart for describing an example of decoding processing by the decoding device in FIG. 13.

According to the above-mentioned processing, learning of the representative vector of each of the multiple clusters in the characteristic space of the pseudo high-frequency subband power difference set beforehand at the high-frequency encoding circuit 37 of the encoding device 30 in FIG. 11, and a decoded high-frequency subband power estimating coefficient to be output by the high-frequency decoding circuit 45 of the decoding device 40 in FIG. 13, and accordingly, suitable output results may be obtained for various input signals to be input to the encoding device 30, and various input code strings to be input to the decoding device 40, and consequently, music signals may be played with higher sound quality.

Further, with regard to encoding and decoding for signals, coefficient data for calculating a high-frequency subband power at the pseudo high-frequency subband power calculating circuit 35 of the encoding device 30 or the decoded high-frequency subband power calculating circuit 46 of the decoding device 40 may be treated as follows. Specifically, assuming that different coefficient data is employed according to the type of an input signal, and the coefficient thereof may also be recorded in the head of a code string.

For example, improvement in encoding efficiency may be realized by changing the coefficient data using a signal such as speech or jazz or the like.

Figure 17:
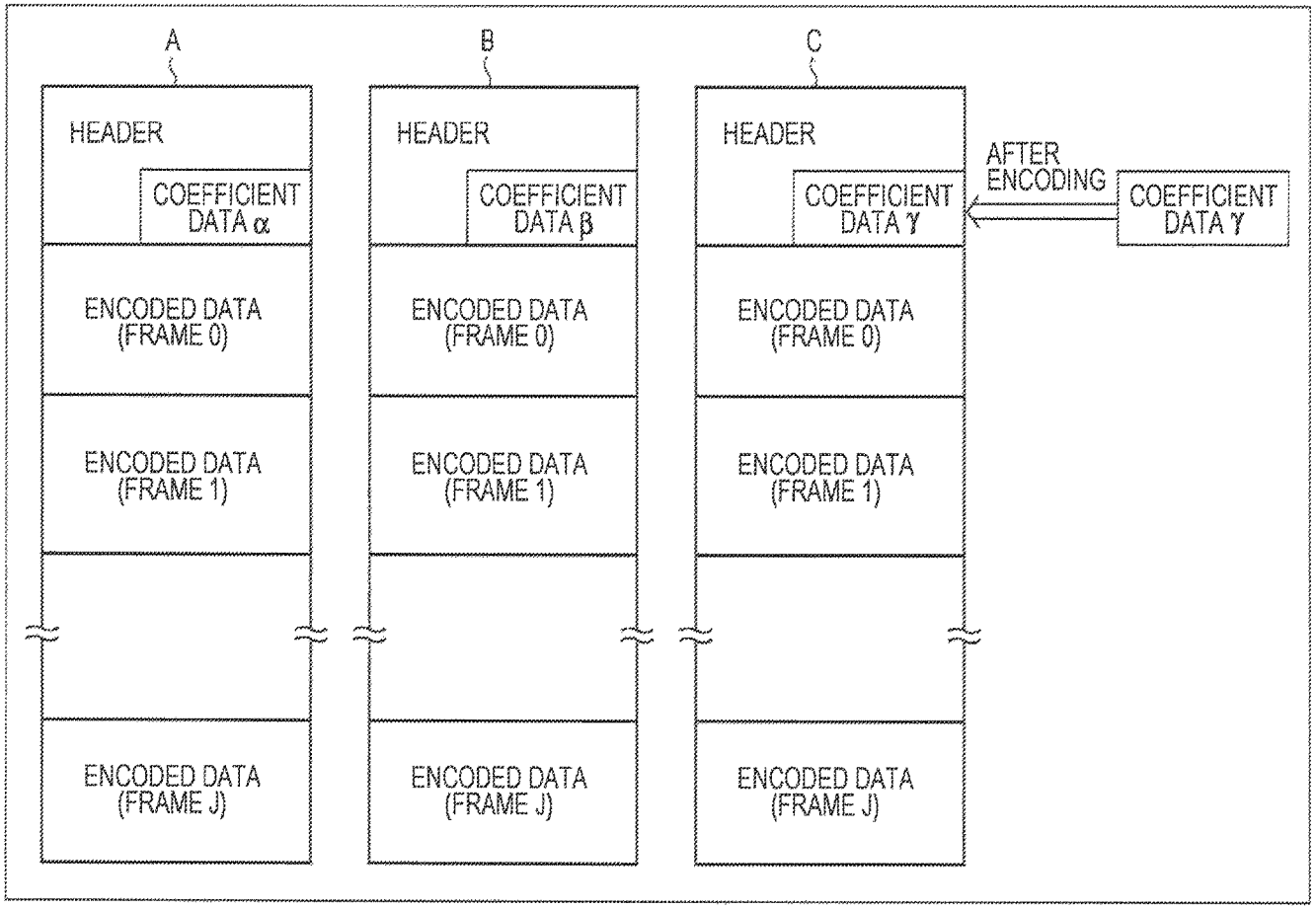
FIG. 17 is a diagram illustrating an example of a code string that the encoding device in FIG. 11 outputs.

FIG. 17 illustrates a code string thus obtained.

A code string A in FIG. 17 is encoded speech, where coefficient data $\alpha$ optimal for speech is recorded in a header.

On the other hand, code string B in FIG. 17 is encoded jazz, coefficient data $\beta$ optimal for jazz is recorded in the header.

An arrangement may be made wherein such multiple coefficient data are prepared by learning with the same type of music signals, with the encoding device 30, the coefficient data thereof is selected with genre information recorded in the header of an input signal. Alternatively, a genre may be determined by performing signal waveform analysis to select coefficient data. That is to say, the signal genre analyzing technique is not restricted to a particular technique.

Also, if computation time permits, an arrangement may be made wherein the above-mentioned learning device is housed in the encoding device 30, processing is performed using a coefficient dedicated to signals, and as illustrated in a code string C in FIG. 17, the coefficient thereof is finally recording in the header.

Advantages for employing this technique will be described below.

With regard to the shape of a high-frequency subband power, there are many similar portions within one input signal. Learning of a coefficient for estimating a high-frequency subband power is individually performed for each input signal using this characteristic that many input signals have, and accordingly, redundancy due to existence of similar portions of a high-frequency subband power may be reduced, and encoding efficiency may be improved. Also, estimation of a high-frequency subband power may be performed with higher precision as compared to statistically learning of a coefficient for estimating a high-frequency subband power using multiple signals.

Also, in this manner, an arrangement may be made wherein coefficient data to be learned from an input signal at the time of encoding is inserted once for several frames.

3. Third Embodiment

[Functional Configuration Example of Encoding Device]

Note that, though description has been mage wherein the pseudo high-frequency subband power difference ID is output from the encoding device 30 to the decoding device 40 as high-frequency encoded data, a coefficient index for obtaining a decoded high-frequency subband power estimating coefficient may be taken as high-frequency encoded data.

Figure 18:
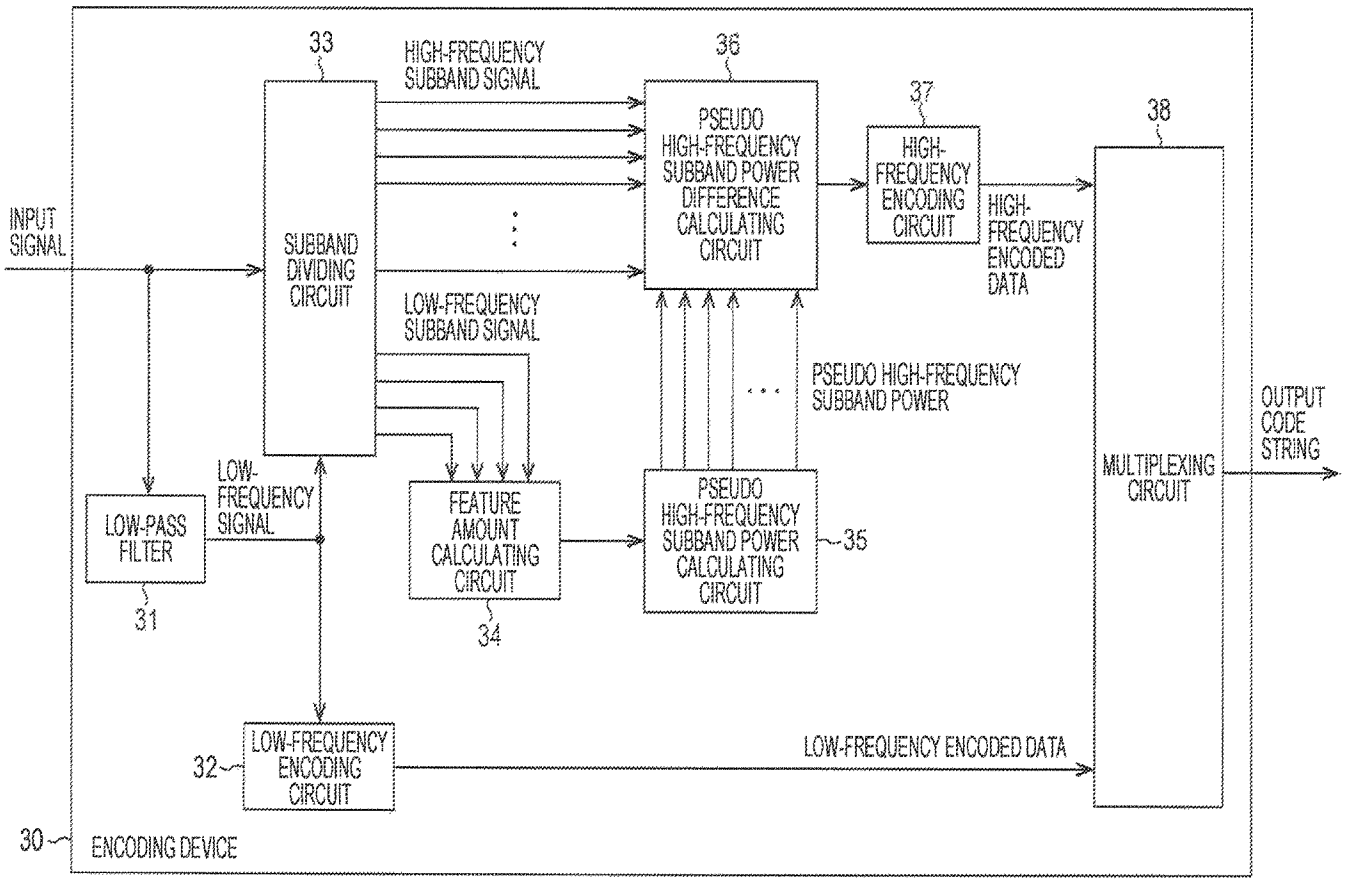
FIG. 18 is a block diagram illustrating a functional configuration example of an encoding device.

In such a case, the encoding device 30 is configured as illustrated in FIG. 18, for example. Note that, in FIG. 18, a portion corresponding to the case in FIG. 11 is denoted with the same reference numeral, and description thereof will be omitted as appropriate.

The encoding device 30 in FIG. 18 differs from the encoding device 30 in FIG. 11 in that a low-frequency decoding circuit 39 is not provided, and other points are the same.

With the encoding device 30 in FIG. 18, the feature amount calculating circuit 34 calculates a low-frequency subband power as a feature amount using the low-frequency subband signal supplied from the subband dividing circuit 33 to supply to the pseudo high-frequency subband power calculating circuit 35.

Also, with the pseudo high-frequency subband power calculating circuit 55, multiple decoded high-frequency subband power estimating coefficients obtained by regression analysis beforehand, and coefficient indexes for identifying these decoded high-frequency subband power estimating coefficients are recorded in a correlated manner.

Specifically, multiple sets of a coefficient $A_{ib}$(kb) and a coefficient $B_{ib}$ of each subband used for calculation of the above-mentioned Expression (2) are prepared beforehand as multiple decoded high-frequency subband power estimating coefficients. For example, these coefficients $A_{ib}$(kb) and $B_{ib}$ have already obtained by regression analysis using the least-square method with a low-frequency subband power as an explained variable and with a high-frequency subband power as a non-explanatory variable. With regression analysis, an input signal made up of a low-frequency subband signal and a high-frequency subband signal is employed as a broadband supervisory signal.

The pseudo high-frequency subband power calculating circuit 35 calculates the pseudo high-frequency subband power of each subband on the high-frequency side is calculated using the decoded high-frequency subband power estimating coefficient and the feature amount from the feature amount calculating circuit 34 to supply to the pseudo high-frequency subband power difference calculating circuit 36.

The pseudo high-frequency subband power difference calculating circuit 36 compares a high-frequency subband power obtained from the high-frequency subband signal supplied from the subband dividing circuit 33, and the pseudo high-frequency subband power from the pseudo high-frequency subband power calculating circuit 35.

As a result of the comparison, the pseudo high-frequency subband power difference calculating circuit 36 supplies of the multiple decoded high-frequency subband power estimating coefficients, a coefficient index of a decoded high-frequency subband power estimating coefficient whereby a pseudo high-frequency subband power approximate to the highest frequency subband power has been obtained, to the high-frequency encoding circuit 37. In other words, there is selected a coefficient index of a decoded high-frequency subband power estimating coefficient whereby a decoded high-frequency signal most approximate to a high-frequency signal of an input signal to be reproduced at the time of decoding, i.e., a true value is obtained.

[Encoding Processing of Encoding Device]

Next, encoding processing to be performed by the encoding device 30 in FIG. 18 will be described with reference to the flowchart in FIG. 19. Note that processing in steps S181 to S183 is the same processing as the processing in steps S111 to S113 in FIG. 12, and accordingly, description thereof will be omitted.

In step S184, the feature amount calculating circuit 34 calculates a feature amount using the low-frequency subband signal from the subband dividing circuit 33 to supply to the pseudo high-frequency subband power calculating circuit 35.

Specifically, the feature amount calculating circuit 34 performs calculation of the above-mentioned Expression (1) to calculate, regarding each subband ib (however, sb−3≤ib≤sb), a low-frequency subband power power(ib, J) of the frame J (however, 0≤J) as a feature amount. That is to say, the low-frequency subband power power(ib, J) is calculated by converting a square mean value of the sample value of each sample of a low-frequency subband signal making up the frame J, into a logarithm.

In step S185, the pseudo high-frequency subband power calculating circuit 35 calculates a pseudo high-frequency subband power based on the feature amount supplied from the feature amount calculating circuit 34 to supply to the pseudo high-frequency subband power difference calculating circuit 36.

For example, the pseudo high-frequency subband power calculating circuit 35 performs calculation of the above-mentioned Expression (2) using the coefficient $A_{ib}$(kb) and coefficient $B_{ib}$ recorded beforehand as decoded high-frequency subband poser estimating coefficients, and the low-frequency subband power power(kb, J) (however, sb−3≤kb≤sb) to calculate a pseudo high-frequency subband power $power_{est}$(ib, J).

Specifically, the low-frequency subband power power(kb, J) of each subband on the low-frequency side supplied as a feature amount is multiplied by the coefficient $A_{ib}$(kb) for each subband, the coefficient $B_{ib}$ is further added to the sum of low-frequency subband powers multiplied by the coefficient, and is taken as a pseudo high-frequency subband power $power_{est}$(ib, J). This pseudo high-frequency subband power is calculated regarding each subband on the high-frequency side of which the index is sb+1 to eb.

Also, the pseudo high-frequency subband power calculating circuit 35 performs calculation of a pseudo high-frequency subband power for each decoded high-frequency subband power estimating coefficient recorded beforehand. For example, let us say that K decoded high-frequency subband power estimating coefficients of which the indexes are 1 to K (however, 2≤K) have been prepared beforehand. In this case, the pseudo high-frequency subband power of each subband is calculated for every K decoded high-frequency subband power estimating coefficients.

In step S186, the pseudo high-frequency subband power difference calculating circuit 36 calculates pseudo high-frequency subband power difference based on the high-frequency subband signal from the subband dividing circuit 33, and the pseudo high-frequency subband power from the pseudo high-frequency subband power calculating circuit 35.

Specifically, the pseudo high-frequency subband power difference calculating circuit 36 performs the same calculation as with the above-mentioned Expression (1) regarding the high-frequency subband signal from the subband dividing circuit 33 to calculate a high-frequency subband power power(ib, J) in the frame J. Note that, with the present embodiment, let us say that all of the subband of a low-frequency subband signal and the subband of a high-frequency subband signal are identified with an index ib.

Next, the pseudo high-frequency subband power difference calculating circuit 36 performs the same calculation as with the above-mentioned Expression (14) to obtain difference between the high-frequency subband power power(ib, J) and pseudo high-frequency subband power $power_{est}$(ib, J) in the frame J. Thus, the pseudo high-frequency subband power $power_{est}$(ib, J) is obtained regarding each subband on the high-frequency side of which the index is sb+1 to eb for each decoded high-frequency subband power estimating coefficient.

In step S187, the pseudo high-frequency subband power difference calculating circuit 36 calculates the following Expression (15) for each decoded high-frequency subband power estimating coefficient to calculate the sum of squares of pseudo high-frequency subband power difference.

[Mathematical Expression 15]

$$E(J, id) = \sum_{ib=sb+1}^{eb} \{power_{diff}(ib, J, id)\}^2 \tag{15}$$

Note that, in Expression (15), difference sum of squares E(J, id) indicates sum of squares of pseudo high-frequency subband power difference of the frame J obtained regarding a decoded high-frequency subband power estimating coefficient which the coefficient index is id. Also, in Expression (15), $power_{diff}$(ib, J, id) indicates pseudo high-frequency subband power difference $power_{diff}$(ib, J) of the frame J of a subband of which the index is ib obtained regarding a decoded high-frequency subband power estimating coefficient of which the coefficient index is id. The difference sum of squares E(J, id) is calculated regarding the K decoded high-frequency subband power estimating coefficients.

The difference sum of squares E(J, id) thus obtained indicates a similarity degree between the high-frequency subband power calculated from the actual high-frequency signal and the pseudo high-frequency subband power calculated using a decoded high-frequency subband power estimating coefficient of which the coefficient index is id.

Specifically, the difference sum of squares E(J, id) indicates error of an estimated value as to a true value of a pseudo high-frequency subband power. Accordingly, the smaller the difference sum of squares E(J, id) is, a decoded high-frequency signal more approximate to the actual high-frequency signal is obtained by calculation using a decoded high-frequency subband power estimating coefficient. In other words, it may be said that a decoded high-frequency subband power estimating coefficient whereby the difference sum of squares E(J, id) becomes the minimum is an estimating coefficient most suitable for frequency band expanding processing to be performed at the time of decoding the output code string.

Therefore, the pseudo high-frequency subband power difference calculating circuit 36 selects, of the K difference sum of squares E(J, id), difference sum of squares whereby the value becomes the minimum, and supplies a coefficient index that indicates a decoded high-frequency subband power estimating coefficient corresponding to the difference sum of squares thereof to the high-frequency encoding circuit 37.

In step S188, the high-frequency encoding circuit 37 encodes the coefficient index supplied from the pseudo high-frequency subband power difference calculating circuit 36, and supplies high-frequency encoded data obtained as a result thereof to the multiplexing circuit 38.

For example, in step S188, entropy encoding is performed on the coefficient index. Thus, information volume of the high-frequency encoded data output to the decoding device 40 may be compressed. Note that the high-frequency encoded data may be any information as long as the optimal decoded high-frequency subband power estimating coefficient is obtained from the information, e.g., the coefficient index may become high-frequency encoded data without change.

In step S189, the multiplexing circuit 38 multiplexes the high-frequency encoded data obtained from the low-frequency encoding circuit 32 and the high-frequency encoded data supplied from the high-frequency encoding circuit 37, outputs an output code string obtained as a result thereof, and the encoding processing is ended.

In this manner, the high-frequency encoded data obtained by encoding the coefficient index is output as an output code string along with the low-frequency encoded data, and accordingly, a decoded high-frequency subband power estimating coefficient most suitable for the frequency band expanding processing may be obtained at the decoding device 40 which receives input of this output code string. Thus, signals with higher sound quality may be obtained.

[Functional Configuration Example of Decoding Device]

Figure 20:
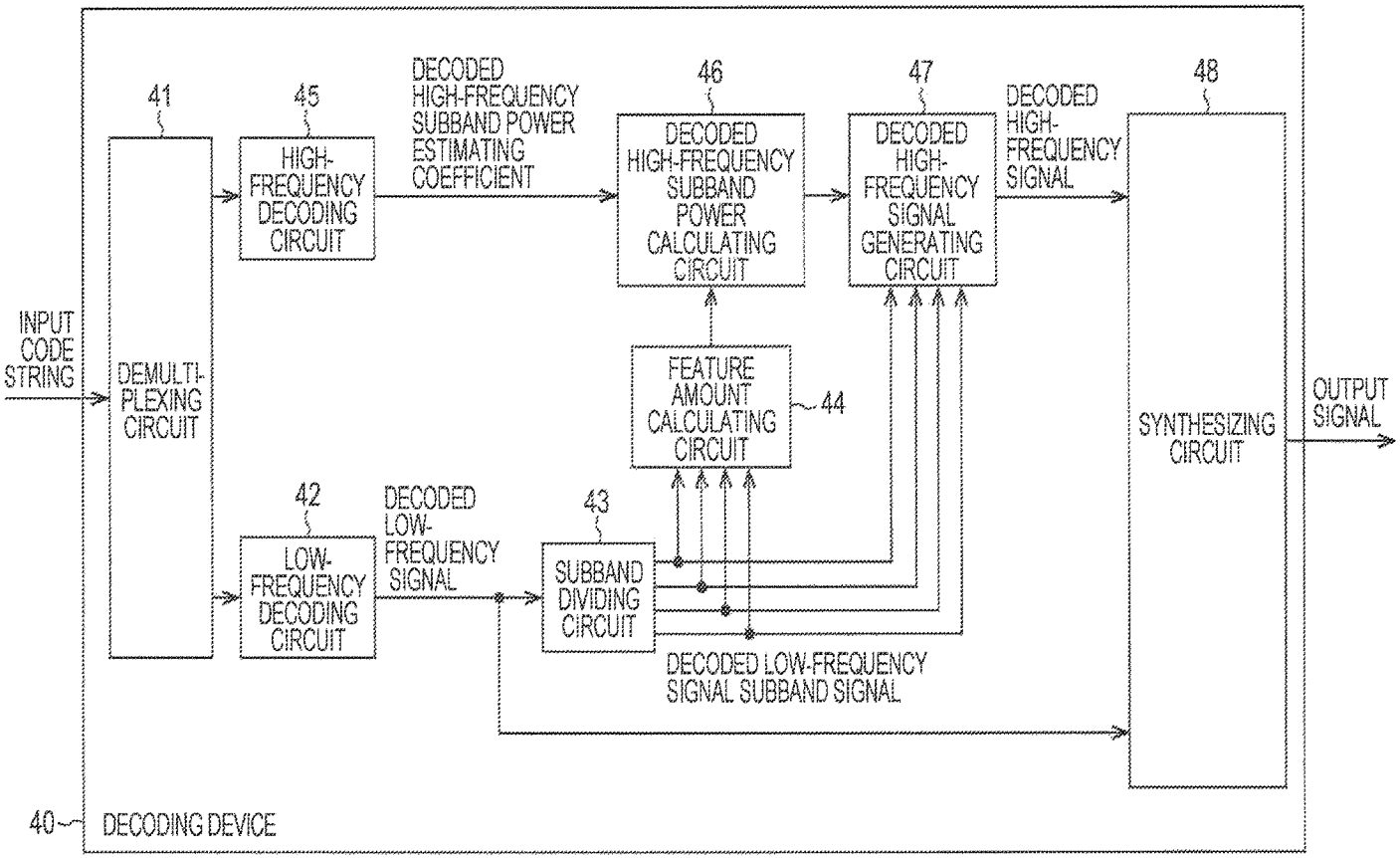
FIG. 20 is a block diagram illustrating a functional configuration example of a decoding device.

Also, the decoding device 40 which inputs the output code string output from the encoding device 30 in FIG. 18 as an input code string, and decodes this is configured as illustrated in FIG. 20, for example. Note that, in FIG. 20, a portion corresponding to the case in FIG. 20 is denoted with the same reference numeral, and description thereof will be omitted.

The decoding device 40 in FIG. 20 is the same as the decoding device 40 in FIG. 13 in that the decoding device 40 is configured of the demultiplexing circuit 41 to synthesizing circuit 48, but differs from the decoding device 40 in FIG. 13 in that the decoded low-frequency signal from the low-frequency decoding circuit 42 is not supplied to the feature amount calculating circuit 44.

With the decoding device 40 in FIG. 20, the high-frequency decoding circuit 45 has beforehand recorded the same decoded high-frequency subband estimating coefficient as the decoded high-frequency subband estimating coefficient that the pseudo high-frequency subband power calculating circuit 35 in FIG. 18 records. Specifically, the set of the coefficient $A_{ib}$(kb) and coefficient $B_{ib}$ serving as decoded high-frequency subband power estimating coefficients obtained by regression analysis beforehand have been recorded in a manner with a coefficient index.

The high-frequency decoding circuit 45 decodes the high-frequency encoded data supplied from the demultiplexing circuit 41, and supplies a decoded high-frequency subband power estimating coefficient indicated by the coefficient index obtained as a result thereof to the decoded high-frequency subband power calculating circuit 46.

[Decoding Processing of Decoding Device]

Next, decoding processing to be performed by the decoding device 40 in FIG. 20 will be described with reference to the flowchart in FIG. 21.

This decoding processing is started when the output code string output from the encoding device 30 is supplied to the decoding device 40 as an input code string. Note that processing in steps S211 to S213 is the same as the processing in steps S131 to S133 in FIG. 14, and accordingly, description thereof will be omitted.

In step S214, the feature amount calculating circuit 44 calculates a feature amount using the decoded low-frequency subband signal from the subband dividing circuit 43, and supplies this to the decoded high-frequency subband power calculating circuit 46. Specifically, the feature amount calculating circuit 44 performs the calculation of the above-mentioned Expression (1) to calculate the low-frequency subband power power(ib, J) in the frame J (however, 0≤J) regarding each subband ib on the low-frequency side as a feature amount.

In step S215, the high-frequency decoding circuit 45 performs decoding of the high-frequency encoded data supplied from the demultiplexing circuit 41, and supplies a decoded high-frequency subband power estimating coefficient indicated by a coefficient index obtained as a result thereof to the decoded high-frequency subband power calculating circuit 46. That is to say, of the multiple decoded high-frequency subband power estimating coefficients recorded beforehand in the high-frequency decoding circuit 45, a decoded high-frequency subband power estimating coefficient indicated by the coefficient index obtained by the decoding is output.

In step S216, the decoded high-frequency subband power calculating circuit 46 calculates a decoded high-frequency subband power based on the feature amount supplied from the feature amount calculating circuit 44 and the decoded high-frequency subband power estimating coefficient supplied from the high-frequency decoding circuit 45, and supplies this to the decoded high-frequency signal generating circuit 47.

Specifically, the decoded high-frequency subband power calculating circuit 46 performs the calculation of the above-mentioned Expression (2) using the coefficient $A_{ib}$(kb) and coefficient $B_{ib}$ serving as decoded high-frequency subband power estimating coefficients, and the low-frequency subband power power(kb, J) (however, sb−3≤kb≤sb) serving as a feature amount to calculate a decoded high-frequency subband power. Thus, a decoded high-frequency subband power is obtained regarding each subband on the high-frequency side of which the index is sb+1 to eb.

In step S217, the decoded high-frequency signal generating circuit 47 generates a decoded high-frequency signal based on the decoded low-frequency subband signal supplied from the subband dividing circuit 43, and the decoded high-frequency subband power supplied from the decoded high-frequency subband power calculating circuit 46.

Specifically, the decoded high-frequency signal generating circuit 47 performs the calculation of the above-mentioned Expression (1) using the decoded low-frequency subband signal to calculate a low-frequency subband power regarding each subband on the low-frequency side. The decoded high-frequency signal generating circuit 47 performs the calculation of the above-mentioned Expression (3) using the obtained low-frequency subband power and decoded high-frequency subband power to calculate the gain amount G(ib, J) for each subband on the high-frequency side.

Further, the decoded high-frequency signal generating circuit 47 performs the calculations of the above-mentioned Expression (5) and Expression (6) using the gain amount G(ib, J) and the decoded low-frequency subband signal to generate a high-frequency subband signal x3(ib, n) regarding each subband on the high-frequency side.

Specifically, the decoded high-frequency signal generating circuit 47 subjects a decoded low-frequency subband signal x(ib, n) to amplitude modulation according to a ratio between a low-frequency subband power and a decoded high-frequency subband power, and further subjects a decoded low-frequency subband signal x2(ib, n) obtained as a result thereof to frequency modulation. Thus, a frequency component signal in a subband on the low-frequency side is converted into a frequency component signal in a subband on the high-frequency side to obtain a high-frequency subband signal x3(ib, n).

In this manner, processing to obtain a high-frequency subband signal in each subband is, in more detail, the following processing.

Let us say that four subbands consecutively arrayed in a frequency region will be referred to as a band block, and the frequency band has been divided so that one band block (hereinafter, particularly referred to as low-frequency block) is configured of four subbands of which the indexes are sb to sb−3 on the low-frequency side. At this time, for example, a band made up of subbands of which the indexes on the high-frequency side are sb+1 to sb+4 is taken as one band block. Now, hereinafter, the high-frequency side, i.e., a band block made up of a subband of which the index is equal to or greater than sb+1 will particularly be referred to as a high-frequency block.

Now, let us say that attention is paid to one subband making up a high-frequency block to generate a high-frequency subband signal of the subband thereof (hereinafter, referred to as subband of interest). First, the decoded high-frequency signal generating circuit 47 identifies a subband of a low-frequency block having the same position relation as with a position of the subband of interest in the high-frequency block.

For example, in the event that the index of the subband of interest is sb+1, the subband of interest is a band having the lowest frequency of the high-frequency block, and accordingly, the subband of a low-frequency block having the same position relation as with the subband of interest is a subband of which the index is sb−3.

In this manner, in the event that the subband of a low-frequency block having the same position relation as with the subband of interest has been identified, a high-frequency subband signal of the subband of interest is generated using the low-frequency subband power of the subband thereof, the decoded low-frequency subband signal, and the decoded high-frequency subband power of the subband of interest.

Specifically, the decoded high-frequency subband power and low-frequency subband power are substituted for Expression (3), and a gain amount according to a ration of these powers is calculated. The decoded low-frequency subband signal is multiplied by the calculated gain amount, and further, the decoded low-frequency subband signal multiplied by the gain amount is subjected to frequency modulation by the calculation of Expression (6), and is taken as a high-frequency subband signal of the subband of interest.

According to the above-mentioned processing, the high-frequency subband signal of each subband on the high-frequency side is obtained. In response to this, the decoded high-frequency signal generating circuit 47 further performs the calculation of the above-mentioned Expression (7) to obtain sum of the obtained high-frequency subband signals and to generate a decoded high-frequency signal. The decoded high-frequency signal generating circuit 47 supplies the obtained decoded high-frequency signal to the synthesizing circuit 48, and the processing proceeds from step S217 to step S218.

In step S218, the synthesizing circuit 48 synthesizes the decoded low-frequency signal from the low-frequency decoding circuit 42 and the decoded high-frequency signal from the decoded high-frequency signal generating circuit 47 to output this as an output signal. Thereafter, the decoding processing is ended.

As described above, according to the decoding device 40, a coefficient index is obtained from high-frequency encoded data obtained by demultiplexing of the input code string, and a decoded high-frequency subband power is calculated using a decoded high-frequency subband power estimating coefficient indicated by the coefficient index thereof, and accordingly, estimation precision of a high-frequency subband power may be improved. Thus, music signals may be played with higher sound quality.

4. Fourth Embodiment

[Encoding Processing of Encoding Device]

Also, though description has been made so far regarding a case where a coefficient index alone is included in high-frequency encoded data as an example, other information may be included in high-frequency encoded data.

For example, if an arrangement is made wherein a coefficient index is included high-frequency encoded data, there may be known on the decoding device 40 side a decoded high-frequency subband power estimating coefficient whereby a decoded high-frequency subband power most approximate to a high-frequency subband power of the actual high-frequency signal is obtained.

However, difference is caused between the actual high-frequency subband power (true value) and the decoded high-frequency subband power (estimated value) obtained on the decoding device 40 side by generally the same value as with the pseudo high-frequency subband power difference powerdiff(ib, J) calculated by the pseudo high-frequency subband power difference calculating circuit 36.

Therefore, if an arrangement is made wherein not only a coefficient index but also pseudo high-frequency subband power difference between the subbands are included in high-frequency encoded data, rough error thereof of a decoded high-frequency subband power for the actual high-frequency subband power may be known on the decoding device 40 side. Thus, estimation precision for a high-frequency subband power may be improved using this error.

Figure 22:
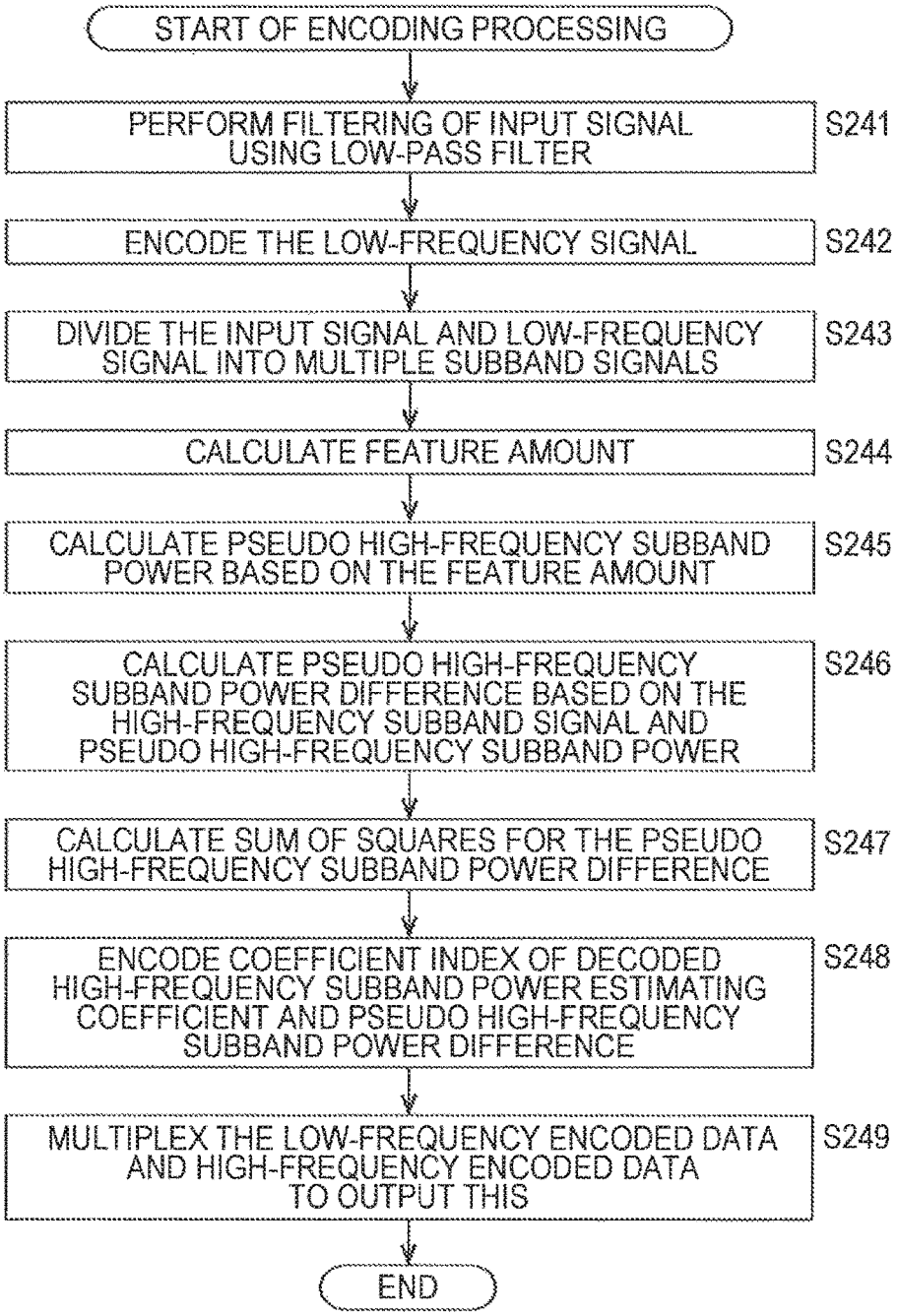
FIG. 22 is a flowchart for describing encoding processing.
Figure 23:
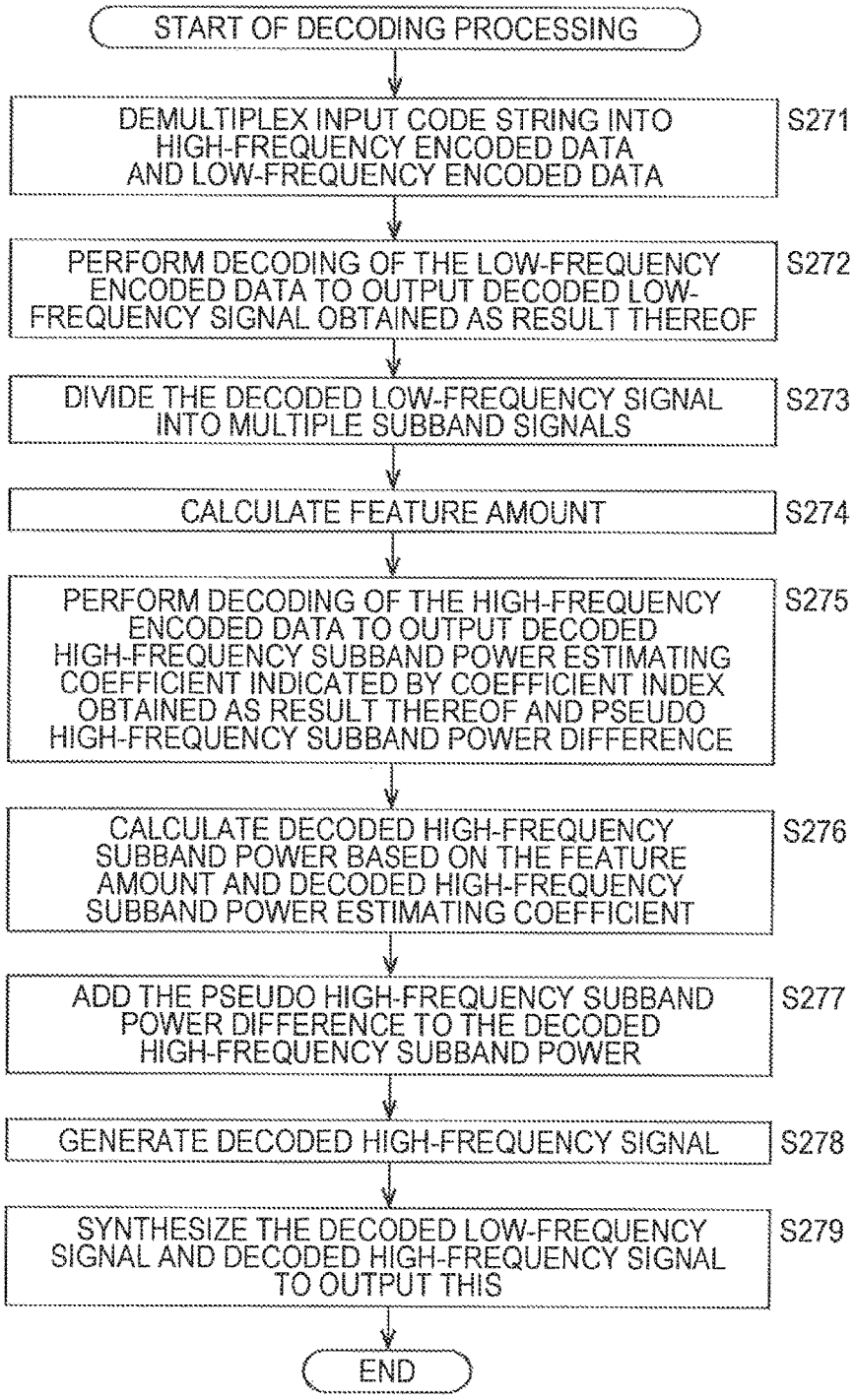
FIG. 23 is a flowchart for describing decoding processing.

Hereinafter, description will be made regarding encoding processing and decoding processing in the event that pseudo high-frequency subband power difference is included in high-frequency encoded data, with reference to the flowcharts in FIG. 22 and FIG. 23.

First, encoding processing to be performed by the encoding device 30 in FIG. 18 will be described with reference to the flowchart in FIG. 22. Note that processing in step S241 to step S246 is the same as the processing in step S181 to step S186 in FIG. 19, and accordingly, description thereof will be omitted.

In step S247, the pseudo high-frequency subband power difference calculating circuit 36 performs the calculation of Expression (15) to calculate the difference sum of squares E(J, id) for each decoded high-frequency subband power estimating coefficient.

The pseudo high-frequency subband power difference calculating circuit 36 selects, of the difference sum of squares E(J, id), difference sum of squares whereby the value becomes the minimum, and supplies a coefficient index indicating a decoded high-frequency subband power estimating coefficient corresponding to the difference sum of squares thereof to the high-frequency encoding circuit 37.

Further, the pseudo high-frequency subband power difference calculating circuit 36 supplies the pseudo high-frequency subband power difference $power_{diff}$(ib, J) of the subbands, obtained regarding a decoded high-frequency subband power estimating coefficient corresponding to the selected difference sum of squares, to the high-frequency encoding circuit 37.

In step S248, the high-frequency encoding circuit 37 encodes the coefficient index and pseudo high-frequency subband power difference supplied from the pseudo high-frequency subband power difference calculating circuit 36, and supplies high-frequency encoded data obtained as a result thereof to the multiplexing circuit 38.

Thus, the pseudo high-frequency subband power difference of the subbands on the high-frequency side of which the indexes are sb+11 to eb, i.e., estimation error of a high-frequency subband power is supplied to the decoding device 40 as high-frequency encoded data.

Figure 19:
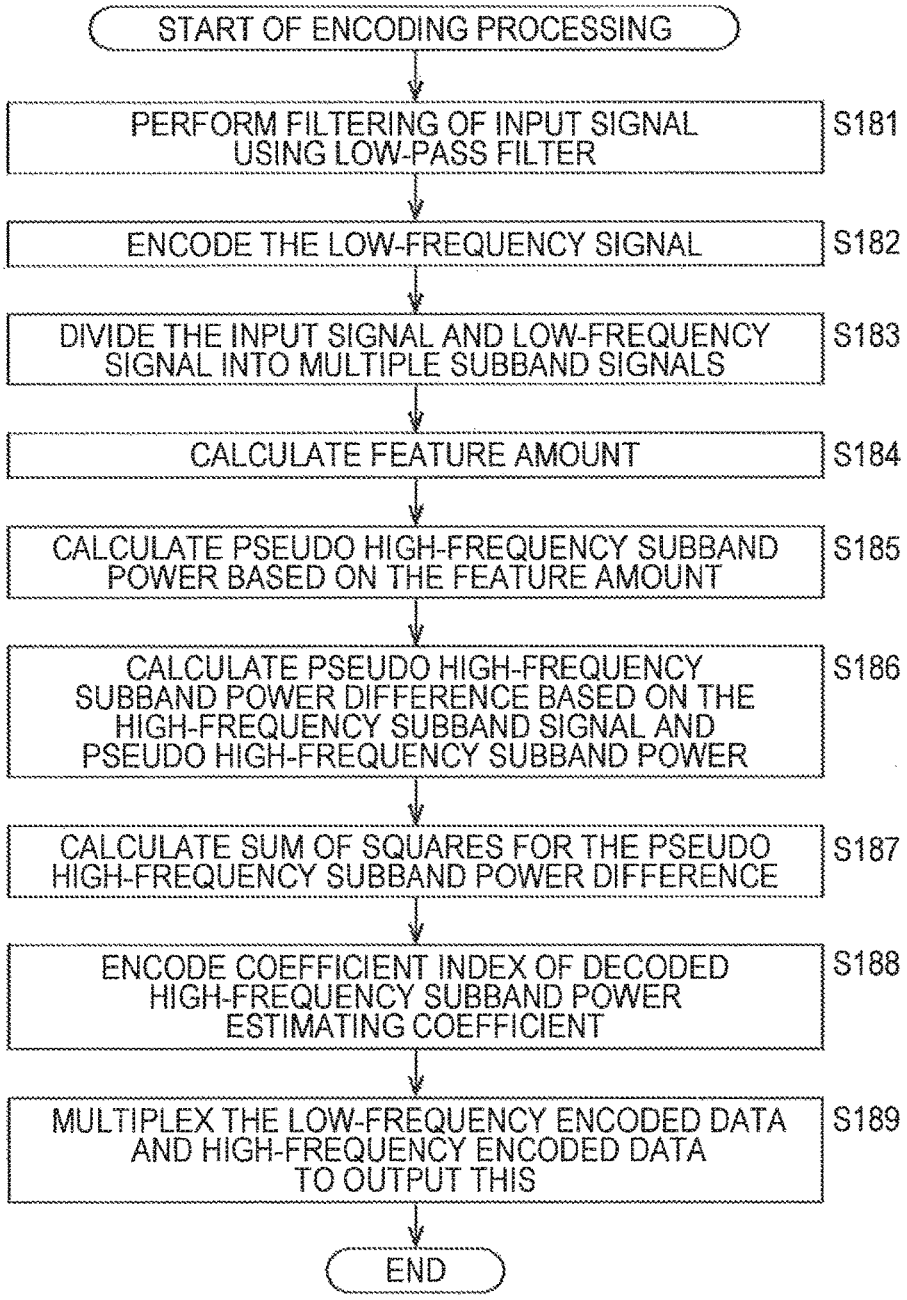
FIG. 19 is a flowchart for describing encoding processing.

In the event that the high-frequency encoded data has been obtained, thereafter, processing in step S249 is performed, and the encoding processing is ended, but the processing in step S249 is the same as the processing in step S189 in FIG. 19, and accordingly, description thereof will be omitted.

As described above, if an arrangement is made wherein pseudo high-frequency subband power difference is included in the high-frequency encoded data, with the decoding device 40, estimation precision of a high-frequency subband power may further be improved, and music signals with higher sound quality may be obtained.

[Decoding Processing of Decoding Device]

Next, decoding processing to be performed by the decoding device 40 in FIG. 20 will be described with reference to the flowchart in FIG. 23. Note that processing in step S271 to step S274 is the same as the processing in step S211 to step S214, and accordingly, description thereof will be omitted.

In step S275, the high-frequency decoding circuit 45 performs decoding of the high-frequency encoded data supplied the demultiplexing circuit 41. The high-frequency decoding circuit 45 then supplies a decoded high-frequency subband power estimating coefficient indicated by a coefficient index obtained by the decoding, and the pseudo high-frequency subband power difference of the subbands obtained by the decoding to the decoded high-frequency subband power calculating circuit 46.

In step S276, the decoded high-frequency subband power calculating circuit 46 calculates a decoded high-frequency subband power based on the feature amount supplied from the feature amount calculating circuit 44, and the decoded high-frequency subband power estimating coefficient supplied from the high-frequency decoding circuit 45. Note that, in step S276, the same processing as step S216 in FIG. 21 is performed.

In step S277, the decoded high-frequency subband power calculating circuit 46 adds the pseudo high-frequency subband power difference supplied from the high-frequency decoding circuit 45 to the decoded high-frequency subband power, supplies this to the decoded high-frequency signal generating circuit 47 as the final decoded high-frequency subband power. That is to say, the pseudo high-frequency subband power difference of the same subband is added to the calculated decoded high-frequency subband power of each subband.

Figure 21:
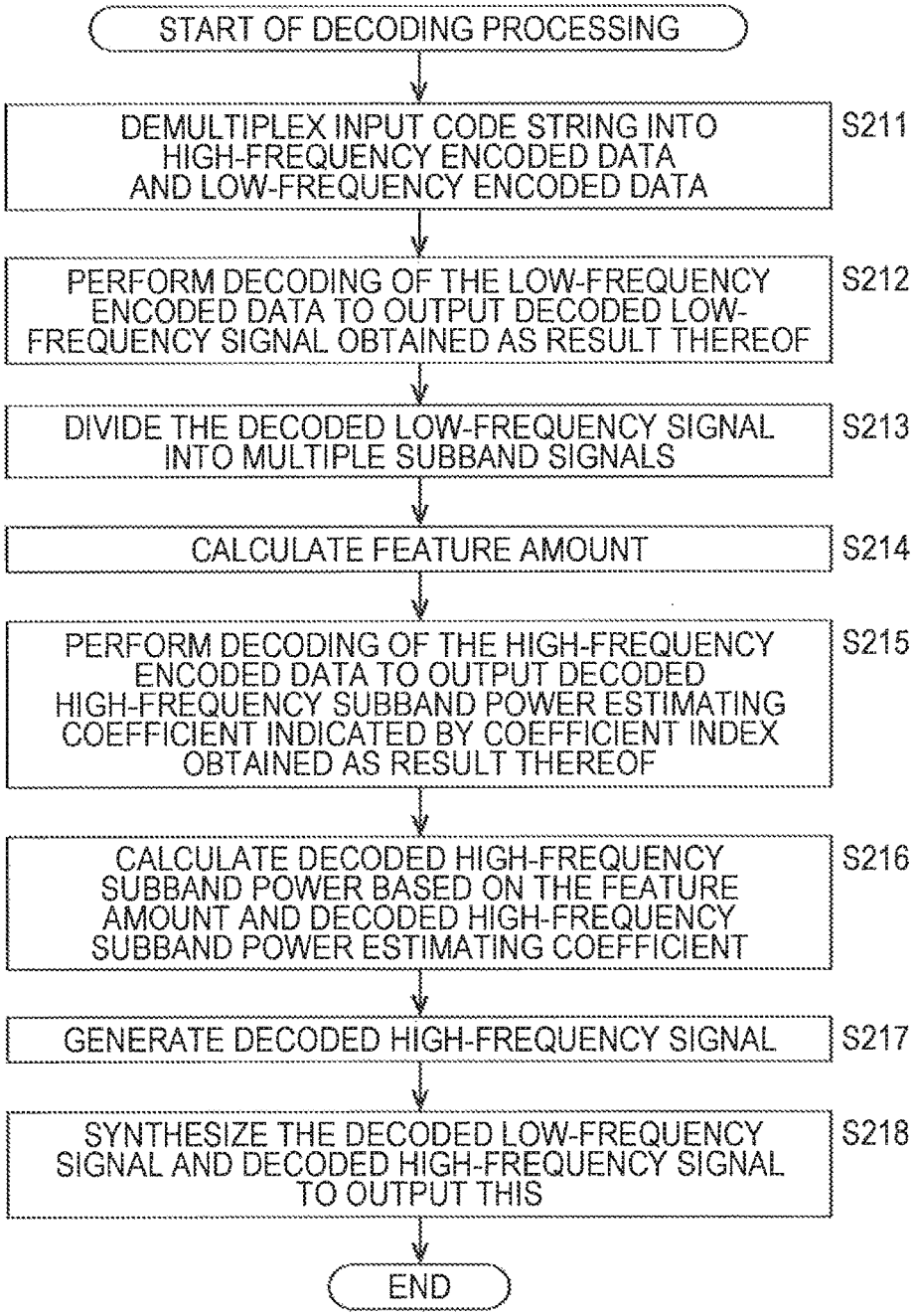
FIG. 21 is a flowchart for describing decoding processing.

Thereafter, processing in step S278 to step S279 is performed, and the decoding processing is ended, but these processes are the same as steps S217 and S218 in FIG. 21, and accordingly, description thereof will be omitted.

In this manner, the decoding device 40 obtains a coefficient index and pseudo high-frequency subband power difference from the high-frequency encoded data obtained by demultiplexing of the input code string. The decoding device 40 then calculates a decoded high-frequency subband power using the decoded high-frequency subband power estimating coefficient indicated by the coefficient index, and the pseudo high-frequency subband power difference. Thus, estimation precision for a high-frequency subband power may be improved, and music signals may be played with higher sound quality.

Note that difference between high-frequency subband power estimated values generated between the encoding device 30 and decoding device 40, i.e., difference between the pseudo high-frequency subband power and decoded high-frequency subband power (hereinafter, referred to as estimated difference between the devices) may be taken into consideration.

In such a case, for example, pseudo high-frequency subband power difference serving as high-frequency encoded data is corrected with the estimated difference between the devices, or the pseudo high-frequency subband power difference is included in high-frequency encoded data, and with the decoding device 40 side, the pseudo high-frequency subband power difference is corrected with the estimated difference between the devices. Further, an arrangement may be made wherein with the decoding device 40 side, the estimated difference between the devices is recorded, and the decoding device 40 adds the estimated difference between the devices to the pseudo high-frequency subband power difference to perform correction. Thus, a decoded high-frequency signal more approximate to the actual high-frequency signal may be obtained.

5. Fifth Embodiment

Note that description has been made wherein, with the encoding device 30 in FIG. 18, the pseudo high-frequency subband power difference calculating circuit 36 selects the optimal one from multiple coefficient indexes with the difference sum of squares E(J, id) as an index, but a coefficient index may be selected using an index other than difference sum of squares.

For example, there may be employed an evaluated value in which residual square mean value, maximum value, mean value, and so forth between a high-frequency subband power and a pseudo high-frequency subband power are taken into consideration. In such a case, the encoding device 30 in FIG. 18 performs encoding processing illustrated in the flowchart in FIG. 24.

Hereinafter, encoding processing by the encoding device 30 will be described with reference to the flowchart in FIG. 24. Note that processing in step S301 to step S305 is the same as the processing in step S181 to step S185 in FIG. 19, and description thereof will be omitted. In the event that the processing in step S301 to step S305 has been performed, the pseudo high-frequency subband power of each subband has been calculated for every K decoded high-frequency subband power estimating coefficients.

In step S306, the pseudo high-frequency subband power difference calculating circuit 36 calculates evaluated value Res(id, J) with the current frame J serving as an object to be processed being employed for every K decoded high-frequency subband power estimating coefficients.

Specifically, the pseudo high-frequency subband power difference calculating circuit 36 performs the same calculation as with the above-mentioned Expression (1) using the high-frequency subband signal of each subband supplied from the subband dividing circuit 33 to calculate the high-frequency subband power power(ib, J) in the frame J. Note that, with the present embodiment, all of the subband of a low-frequency subband signal and the subband of a high-frequency subband signal may be identified using the index ib.

In the event of the high-frequency subband power power (ib, J) being obtained, the pseudo high-frequency subband power difference calculating circuit 36 calculates the following Expression (16) to calculate a residual square mean value $Res_{std}$(id, J).

[Mathematical Expression 16]

$$Res_{std}(id, J) = \sum_{ib=sb+1}^{eb} \{\text{power}(ib, J) - \text{power}_{est}(ib, id, J)\}^2 \tag{16}$$

Specifically, difference between the high-frequency subband power power(ib, J) and pseudo high-frequency subband power $\text{power}_{est}$(ib, id, J) in the frame J is obtained regarding each subband on the high-frequency side of which the index is sb+1 to eb, and sum of squares of the difference thereof is taken as the residual square mean value $Res_{std}$(id, J). Note that the pseudo high-frequency subband power $\text{power}_{est}$(ib, id, J) indicates a pseudo high-frequency subband power in the frame J of a subband of which the index is ib, obtained regarding the decoded high-frequency subband power estimating coefficient of which the coefficient index is id.

Next, the pseudo high-frequency subband power difference calculating circuit 36 calculates the following Expression (17) to calculate the residual maximum value $Res_{max}$ (id, J).

[Mathematical Expression 17]

$$Res_{max}(id,J)=\max_{ib}\{|\text{power}(ib,J)-\text{power}_{est}(ib,id,J)|\} \tag{17}$$

Note that, in Expression (17), $\max_{ib}\{|\text{power}(ib, J)-\text{power}_{est}(ib, id, J)|\}$ indicates the maximum one of difference absolute values between the high-frequency subband power power(ib, J) of each subband of which the index is sb+1 to eb, and the pseudo high-frequency subband power $\text{power}_{est}$ (ib, id, J). Accordingly, the maximum value of the difference absolute values between the high-frequency subband power power(ib, J) and pseudo high-frequency subband power $\text{power}_{est}$(ib, id, J) in the frame J is taken as a residual maximum value $Res_{max}$(id, J)

Also, the pseudo high-frequency subband power difference calculating circuit 36 calculates the following Expression (18) to calculate the residual mean value $Res_{ave}$ (id, J)

[Mathematical Expression 18]

$$Res_{ave}(id, J) = \left|\left(\sum_{ib=sb+1}^{eb} \{\text{power}(ib, J) - \text{power}_{est}(ib, id, J)\}\right) \Big/ (eb - sb)\right| \tag{18}$$

Specifically, difference between the high-frequency subband power power(ib, J) and pseudo high-frequency subband power $\text{power}_{est}$(ib, id, J) in the frame J is obtained regarding each subband on the high-frequency side of which index is sb+1 to eb, and difference sum thereof is obtained.

The absolute value of a value obtained by dividing the obtained difference sum by the number of subbands (eb−sb) on the high-frequency side is taken as a residual mean value $Res_{ave}(id, J)$. This residual mean value $Res_{ave}(id, J)$ indicates the magnitude of a mean value of estimated error of the subbands with the sign being taken into consideration.

Further, in the event that the residual square mean value $Res_{std}(id, J)$, residual maximum value $Res_{max}(id, J)$, and residual mean value $Res_{ave}(id, J)$ have been obtained, the pseudo high-frequency subband power difference calculating circuit 36 calculates the following Expression (19) to calculate the final evaluated value Res(id, J).

[Mathematical Expression 19]

$$Res(id,J)=Res_{std}(id,J)+W_{max}\times Res_{max}(id,J)+W_{ave}\times Res_{ave}(id,J) \quad (19)$$

Specifically, the residual square mean value $Res_{std}(id, J)$, residual maximum value $Res_{max}(id, J)$, and residual mean value $Res_{ave}(id, J)$ are added with weight to obtain the final evaluated value Res(id, J). Note that, in Expression (19), $W_{max}$ and $W_{ave}$ are weights determined beforehand, and examples of these are $W_{max}=0.5$ and $W_{ave}=0.5$.

The pseudo high-frequency subband power difference calculating circuit 36 performs the above-mentioned processing to calculate the evaluated value Res(id, J) for every K decoded high-frequency subband power estimating coefficients, i.e., for every K coefficient indexes id.

In step S307, the pseudo high-frequency subband power difference calculating circuit 36 selects the coefficient index id based on the evaluated value Res(id, J) for each obtained coefficient index id.

The evaluated value Res(id, J) obtained in the above-mentioned processing indicates a similarity degree between the high-frequency subband power calculated from the actual high-frequency signal and the pseudo high-frequency subband power calculated using a decoded high-frequency subband power estimating coefficient of which the coefficient index is id, i.e., indicates the magnitude of estimated error of a high-frequency component.

Accordingly, the smaller the evaluated value Res(id, J) is, the more approximate to the actual high-frequency signal is a decoded high frequency signal obtained by calculation with a decoded high-frequency subband power estimating coefficient. Therefore, the pseudo high-frequency subband power difference calculating circuit 36 selects, of the K evaluated values Res(id, J), an evaluated value whereby the value becomes the minimum, and supplies a coefficient index indicating a decoded high-frequency subband power estimating coefficient corresponding to the evaluated value thereof to the high-frequency encoding circuit 37.

In the event that the coefficient index has been output to the high-frequency encoding circuit 37, thereafter, processes in step S308 and step S309 are performed, and the encoding processing is ended, but these processes are the same as step S188 and step S189 in FIG. 19, and accordingly, description thereof will be omitted.

As described above, with the encoding device 30, the evaluated value Res(id, J) calculated from the residual square mean value $Res_{std}(id, J)$, residual maximum value $Res_{max}(id, J)$, and residual mean value $Res_{ave}(id, J)$ is employed, and a coefficient index of the optimal decoded high-frequency subband power estimating coefficient is selected.

In the event of the evaluated value Res(id, J) being employed, as compared to the case of employing difference sum of squares, estimation precision of a high-frequency subband power may be evaluated using many more evaluation scales, and accordingly, a more suitable decoded high-frequency subband power estimating coefficient may be selected. Thus, with the decoding device 40 which receives input of an output code string, a decoded high-frequency subband power estimating coefficient most adapted to the frequency band expanding processing may be obtained, and signals with higher sound quality may be obtained.

<Modification 1>

Also, in the event that the encoding processing described above has been performed for each frame of an input signal, with a constant region where there is little temporal fluctuation regarding the high-frequency subband powers of the subbands on the high-frequency side of the input signal, a different coefficient index may be selected for every continuous frames.

Specifically, with consecutive frames making up a constant region of the input signal, the high-frequency subband powers of the frames are almost the same, and accordingly, the same coefficient index has continuously to be selected with these frames. However, with a section of these continuous frames, the coefficient index to be selected changes for each frame, and as a result thereof, audio high-frequency components to be played on the decoding device 40 side may not be stationary. Consequently, with audio to be played, unnatural sensations are perceptually caused.

Therefore, in the event of selecting a coefficient index at the encoding device 30, estimation results of high-frequency components in the temporally previous frame may be taken into consideration. In such a case, the encoding device 30 in FIG. 18 performs encoding processing illustrated in the flowchart in FIG. 25.

Hereinafter, encoding processing by the encoding device 30 will be described with reference to the flowchart in FIG. 25. Note that processing in step S331 to step S336 is the same as the processing in step S301 to step S306 in FIG. 24, and accordingly, description thereof will be omitted.

In step S337, the pseudo high-frequency subband power difference calculating circuit 36 calculates an evaluated value ResP(id, J) using the past frame and the current frame.

Specifically, the pseudo high-frequency subband power difference calculating circuit 36 records, regarding the temporally previous frame (J−1) after the frame J to be processed, a pseudo high-frequency subband power of each subband, obtained by using a decoded high-frequency subband power estimating coefficient having the finally selected coefficient index. The finally selected coefficient index mentioned here is a coefficient index encoded by the high-frequency encoding circuit 37 and output to the decoding device 40.

Hereinafter, let us say that the coefficient index id selected in the frame (J−1) is particularly $id_{selected}(J-1)$. Also, assuming that a pseudo high-frequency subband power of a subband of which the index is ib (however, $sb+1 \leq ib \leq eb$), obtained by using a decoded high-frequency subband power estimating coefficient of the coefficient index $id_{selected}(J-1)$ is $power_{est}(ib, id_{selected}(J-1), J-1)$, description will be continued.

The pseudo high-frequency subband power difference calculating circuit 36 first calculates the following Expression (20) to calculate an estimated residual square mean value $ResP_{std}(id, J)$

[Mathematical Expression 20]

$$ResP_{std}(id, J) = \sum_{ib=sb+1}^{eb} \{power_{est}(ib, id_{selected}(J-1), J-1) - power_{est}(ib, id, J)\}^2 \quad (20)$$

Specifically, with regard to each subband on the high-frequency side of which the index is sb+1 to eb, difference between the pseudo high-frequency subband power $power_{est}$ (ib, $id_{selected}$(J−1), J−1) of the frame (J−1) and the pseudo high-frequency subband power $power_{est}$(ib, id, J) of the frame J is obtained. Sum of squares of the difference thereof is taken as the estimated residual square mean value $ResP_{std}$ (id, J). Note that the pseudo high-frequency subband power $power_{est}$(ib, id, J) indicates a pseudo high-frequency subband power of the frame J of a subband of which the index is ib, obtained regarding a decoded high-frequency subband power estimating coefficient of which the coefficient index is id.

This estimated residual square mean value $ResP_{std}$(id, J) is difference sum of squares of pseudo high-frequency subband powers between temporally consecutive frames, and accordingly, the smaller the estimated residual square mean value $ResP_{std}$(id, J) is, the smaller temporal change of an estimated value of a high-frequency component is.

Next, the pseudo high-frequency subband power difference calculating circuit 36 calculates the following Expression (21) to calculate the estimated residual maximum value $ResP_{max}$(id, J).

[Mathematical Expression 21]

$$ResP_{max}(id,J)=\max_{ib}\{|power_{est}(ib,id_{selected}(J-1),J-1)-power_{est}(ib,id,J)|\} \quad (21)$$

Note that, in Expression (21), $\max_{ib}\{|power_{est}(ib, id_{selected}(J-1), J-1)-power_{est}(ib, id, J)|\}$ indicates the maximum one of difference absolute values between the pseudo high-frequency subband power $power_{est}$(ib, $id_{selected}$(J−1), J−1) of each subband of which the index is sb+1 to eb, and the pseudo high-frequency subband power $power_{est}$(ib, id, J). Accordingly, the maximum value of the difference absolute values of pseudo high-frequency subband powers between temporally consecutive frames is taken as the estimated residual maximum value $ResP_{max}$(id, J).

The estimated residual maximum value $ResP_{max}$(id, J) indicates that the smaller the value thereof is, the more the estimated results of high-frequency components between consecutive frames approximate.

In the event of the estimated residual maximum value $ResP_{max}$(id, J) being obtained, next, the pseudo high-frequency subband power difference calculating circuit 36 calculates the following Expression (22) to calculate the estimated residual mean value $ResP_{ave}$(id, J).

[Mathematical Expression 22]

$$ResP_{av}(id, J) = \left|\left(\sum_{ib=sb+1}^{eb} \{power_{est}(ib, id_{selected}(J-1), J-1) - power_{est}(ib, id, J)\}\right) \Big/ (eb-sb)\right| \quad (22)$$

Specifically, with regard to each subband on the high-frequency side of which the index is sb+1 to eb, difference between the pseudo high-frequency subband power $power_{est}$ (ib, $id_{selected}$(J−1), J−1) of the frame (J−1) and the pseudo high-frequency subband power $power_{est}$(ib, id, J) of the frame J is obtained. The absolute value of a value obtained by dividing the difference sum of the subbands by the number of subbands (eb−sb) on the high-frequency side is taken as the estimated residual mean value $ResP_{ave}$(id, J). This estimated residual mean value $ResP_{ave}$(id, J) indicates the magnitude of a mean value of estimated difference of the subbands between frames, taking the sign in to consideration.

Further, in the event that the estimated residual square mean value $ResP_{std}$(id, J), estimated residual maximum value $ResP_{max}$(id, J), and estimated residual mean value $ResP_{ave}$(id, J) have been obtained, the pseudo high-frequency subband power difference calculating circuit 36 calculates the following Expression (23) to calculate an evaluated value ResP(id, J).

[Mathematical Expression 23]

$$ResP(id,J)=ResP_{std}(id,J)+W_{max}\times ResP_{max}(id,J)+W_{ave}\times ResP_{ave}(id,J) \quad (23)$$

Specifically, the estimated residual square mean value $ResP_{std}$(id, J), estimated residual maximum value $ResP_{max}$ (id, J), and estimated residual mean value $ResP_{ave}$(id, J) are added with weight to obtain an evaluated value ResP(id, J). Note that, in Expression (23), $W_{max}$ and $W_{ave}$ are weights determined beforehand, and examples of these are $W_{max}$=0.5 and $W_{ave}$=0.5.

In this manner, after the evaluated value ResP(id, J) is calculated using the past frame and the current frame, the processing proceeds from step S337 to step S338.

In step S338, the pseudo high-frequency subband power difference calculating circuit 36 calculates the following Expression (24) to calculate the final evaluated value $Res_{all}$ (id, J).

[Mathematical Expression 24]

$$Res_{all}(id,J)=Res(id,J)+W_p(J)\times ResP(id,J) \quad (24)$$

Specifically, the obtained evaluated value Res(id, J) and evaluated value ResP(id, J) are added with weight. Note that, in Expression (24), $W_p$(J) is weight to be defined by the following Expression (25), for example.

[Mathematical Expression 25]

$$W_p(J) = \begin{cases} \dfrac{-power_r(J)}{50} + 1 & (0 \le power_r(J) \le 50) \\ 0 & (\text{otherwise}) \end{cases} \quad (25)$$

Also, $power_r$(J) in Expression (25) is a value to be determined by the following Expression (26).

[Mathematical Expression 26]

$$power_r(J) = \sqrt{\left(\sum_{ib=sb+1}^{eb} \{power(ib, J) - power(ib, J-1)\}^2\right) \Big/ (eb-sb)} \quad (26)$$

This $power_r(J)$ indicates difference mean of high-frequency subband powers of the frame (J−1) and frame J. Also, according to Expression (25), when the $power_r(J)$ is a value in a predetermined range near 0, the smaller the $power_r(J)$ is, $W_p(J)$ becomes a value approximate to 1, and when the $power_r(J)$ is greater than a value in a predetermined range, becomes 0.

Here, in the event that the $power_r(J)$ is a value in a predetermined range near 0, a difference mean of high-frequency subband powers between consecutive frames is small to some extent. In other words, temporal fluctuation of a high-frequency component of the input signal is small, and consequently, the current frame of the input signal is a constant region.

The more constant the high-frequency component of the input signal is, the weight $W_p(J)$ becomes a value more approximate to 1, and conversely, the more non-constant the high-frequency component of the input signal is, the weight $W_p(J)$ becomes a value more approximate to 0. Accordingly, with the evaluated value $Res_{all}(id, J)$ indicated in Expression (24), the less temporal fluctuation of a high-frequency component of the input signal is, the greater a contribution ratio of the evaluated value ResP(id, J) with a comparison result for an estimation result of a high-frequency component in a latter frame as an evaluation scale.

As a result thereof, with a constant region of the input signal, a decoded high-frequency subband power estimating coefficient whereby a high-frequency component approximate to an estimation result of a high-frequency component in the last frame is obtained is selected, and even with the decoding device 40 side, audio with more natural high sound quality may be played. Conversely, with a non-constant region of the input signal, the term of the evaluated value ResP(id, J) in the evaluated value $Res_{all}(id, J)$ becomes 0, and a decoded high-frequency signal more approximate to the actual high-frequency signal is obtained.

The pseudo high-frequency subband power difference calculating circuit 36 performs the above-mentioned processing to calculate the evaluated value $Res_{all}(id, J)$ for every K decoded high-frequency subband power estimating coefficients.

In step S339, the pseudo high-frequency subband power difference calculating circuit 36 selects the coefficient index id based on the evaluated value $Res_{all}(id, J)$ for each obtained decoded high-frequency subband power estimating coefficient.

The evaluated value $Res_{all}(id, J)$ obtained in the above-mentioned processing is an evaluated value by performing linear coupling on the evaluated value Res(id, J) and the evaluated value ResP(id, J) using weight. As described above, the smaller the value of the evaluated value Res(id, J) is, the more approximate to the actual high-frequency signal a decoded high-frequency signal is obtained. Also, the smaller the value of the evaluated value ResP(id, J) is, the more approximate to the decoded high-frequency signal of the last frame a decoded high-frequency signal is obtained.

Accordingly, the smaller the evaluated value $Res_{all}(id, J)$ is, the more suitable decoded high-frequency signal is obtained. Therefore, the pseudo high-frequency subband power difference calculating circuit 36 selects, of the K evaluated value $Res_{all}(id, J)$, an evaluated value whereby the value becomes the minimum, and supplies a coefficient index indicating a decoded high-frequency subband power estimating coefficient corresponding to the evaluated value thereof to the high-frequency encoding circuit 37.

Figure 24:
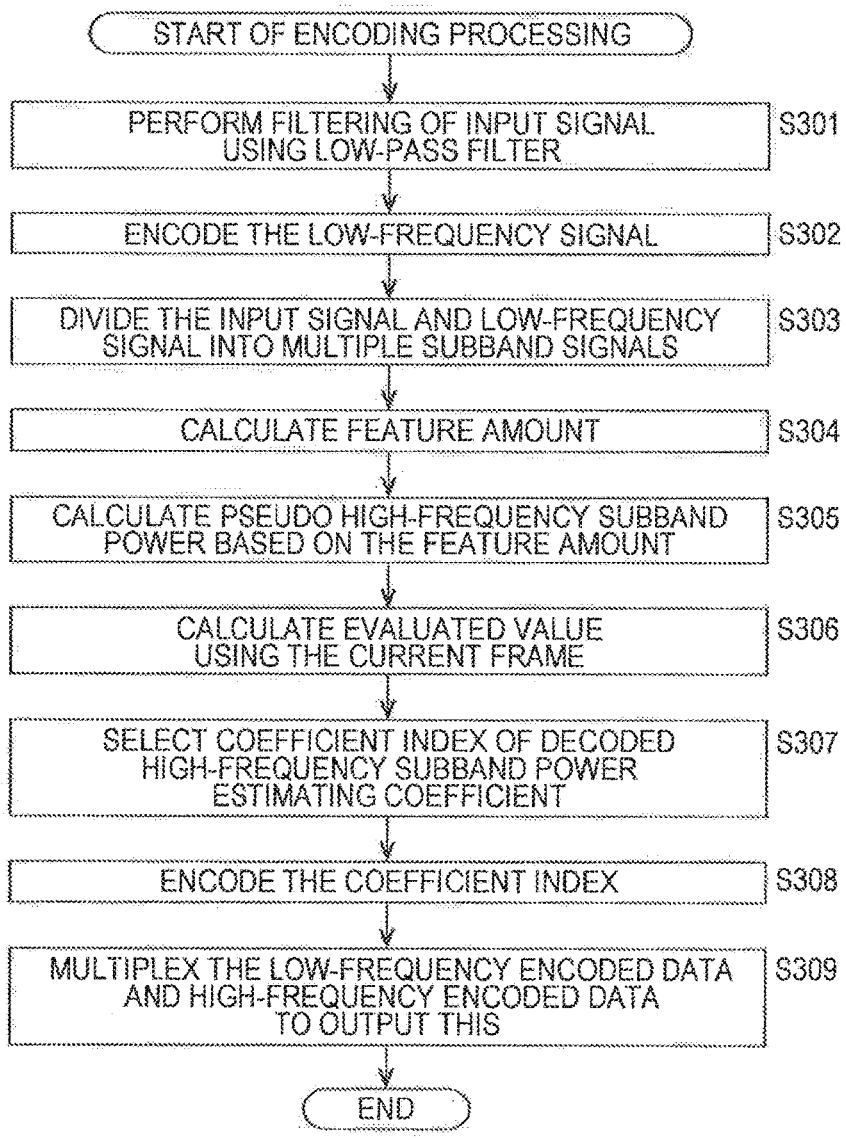
FIG. 24 is a flowchart for describing encoding processing.

After the coefficient index is selected, the processes in step S340 and step S341 are performed, and the encoding processing is ended, but these processes are the same as step S308 and step S309 in FIG. 24, and accordingly, description thereof will be omitted.

As described above, with the encoding device 30, the evaluated value $Res_{all}(id, J)$ obtained by performing linear coupling on the evaluated value Res(id, J) and evaluated value ResP(id, J) is employed, and the coefficient index of the optimal decoded high-frequency subband power estimating coefficient is selected.

In the event of employing the evaluated value $Res_{all}(id, J)$, in the same way as with the case of employing the evaluated value Res(id, J), a more suitable decoded high-frequency subband power estimating coefficient may be selected by many more evaluation scales. Moreover, if the evaluated value $Res_{all}(id, J)$ is employed, with the decoding device 40 side, temporal fluctuation in a constant region of a high-frequency component of a signal to be played may be suppressed, and signals with higher sound quality may be obtained.

<Modification 2>

Incidentally, with the frequency band expanding processing, when attempting to obtain audio with higher sound quality, subbands on lower frequency side become important regarding listenability. Specifically, of the subbands on the high-frequency side, the higher estimation precision of a subband more approximate to the lower-frequency side is, the higher sound quality audio may be played with.

Therefore, in the event that an evaluated value regarding each of the decoded high-frequency subband power estimating coefficients is calculated, weight may be placed on a subband on a lower frequency side. In such a case, the encoding device 30 in FIG. 18 performs encoding processing illustrated in the flowchart in FIG. 26.

Hereinafter, the encoding processing by the encoding device 30 will be described with reference to the flowchart in FIG. 26. Note that processing in step S371 to step S375 is the same as the processing in step S331 to step S335 in FIG. 25, and accordingly, description thereof will be omitted.

In step S376, the pseudo high-frequency subband power difference calculating circuit 36 calculates the evaluated value $ResW_{band}(id, J)$ with the current frame J serving as an object to be processing being employed, for every K decoded high-frequency subband power estimating coefficients.

Specifically, the pseudo high-frequency subband power difference calculating circuit 36 performs the same calculation as with the above-mentioned Expression (1) using the high-frequency subband signal of each subband supplied from the subband dividing circuit 33 to calculate the high-frequency subband power power(ib, J) in the frame J.

In the event of the high-frequency subband power power (ib, J) being obtained, the pseudo high-frequency subband power difference calculating circuit 36 calculates the following Expression (27) to calculate a residual square mean value $Res_{std}W_{band}(id, J)$.

[Mathematical Expression 27]

$$Res_{std}W_{band}(ib, J) = \sum_{ib=sb+1}^{eb} \{W_{band}(ib) \times \{power(ib, J) - power_{est}(ib, id, J)\}\}^2 \quad (27)$$

Specifically, regarding each subband on the high-frequency side of which the index is sb+1 to eb, difference between the high-frequency subband power power(ib, J) and the pseudo high-frequency subband power $power_{est}$(ib, id, J) in the frame J is obtained, and the difference thereof is multiplied by weight $W_{band}$(ib) for each subband. Sum of squares of the difference multiplied by the weight $W_{band}$(ib) is taken as the residual square mean value $Res_{std}W_{band}$(id, J).

Here, the weight $W_{band}$(ib) (however, sb+1≤ib≤eb) is defined by the following Expression (28), for example. The value of this weight $W_{band}$(ib) increases in the event that a subband thereof is in a lower frequency side.

[Mathematical Expression 28]

$$W_{band}(ib) = \frac{-3 \times ib}{7} + 4 \tag{28}$$

Next, the pseudo high-frequency subband power difference calculating circuit 36 calculates the residual maximum value $Res_{max}W_{band}$(id, J). Specifically, the maximum value of the absolute value of values obtained by multiplying difference between the high-frequency subband power power(ib, J) of which the index is sb+1 to eb and pseudo high-frequency subband power $power_{est}$(ib, id, J) of each subband by the weight $W_{band}$(ib) is taken as the residual maximum value $Res_{max}W_{band}$(id, J).

Also, the pseudo high-frequency subband power difference calculating circuit 36 calculates the residual mean value $Res_{ave}W_{band}$(id, J).

Specifically, regarding each subband of which the index is sb+1 to eb, difference between the high-frequency subband power power(ib, J) and the pseudo high-frequency subband power $power_{est}$(ib, id, J) is obtained, and is multiplied by the weight $W_{band}$(ib), and sum of the difference multiplied by the weight $W_{band}$(ib) is obtained. The absolute value of a value obtained by dividing the obtained difference sum by the number of subbands (eb−sb) on the high-frequency side is then taken as the residual mean value $Res_{ave}W_{band}$(id, J).

Further, the pseudo high-frequency subband power difference calculating circuit 36 calculates the evaluated value $ResW_{band}$(id, J). Specifically, sum of the residual square mean value $Res_{std}W_{band}$(id, J), residual maximum value $Res_{max}W_{band}$(id, J) multiplied by the weight $W_{max}$, and residual mean value $Res_{ave}W_{band}$(id, J) multiplied by the weight $W_{ave}$ is taken as the evaluated value $ResW_{band}$(id, J).

In step S377, the pseudo high-frequency subband power difference calculating circuit 36 calculates the evaluated value $ResPW_{band}$(id, J) with the past frame and the current frame being employed.

Specifically, the pseudo high-frequency subband power difference calculating circuit 36 records, regarding the temporally previous frame (J−1) after the frame J to be processed, a pseudo high-frequency subband power of each subband, obtained by using a decoded high-frequency subband power estimating coefficient having the finally selected coefficient index.

The pseudo high-frequency subband power difference calculating circuit 36 first calculates an estimated residual square mean value $ResP_{std}W_{band}$(id, J). Specifically, regarding each subband on the high-frequency side of which the index is sb+1 to eb, difference between the pseudo high-frequency subband power $power_{est}$(ib, $id_{selected}$(J−1), J−1) and the pseudo high-frequency subband power $power_{est}$(ib, id, J) is obtained, and is multiplied by the weight $W_{band}$(ib). Sum of squares of difference multiplied by the weight $W_{band}$(ib) is then taken as the estimated residual square mean value $ResP_{std}W_{band}$(id, J).

Next, the pseudo high-frequency subband power difference calculating circuit 36 calculates an estimated residual maximum value $ResP_{max}W_{ban}$(id, J). Specifically, the maximum value of the absolute value of values obtained by multiplying difference between the pseudo high-frequency subband power $power_{est}$ (ib, $id_{selected}$(J−1), J−1) and the pseudo high-frequency subband power $power_{est}$(ib, id, J) of each subband of which the index is sb+1 to eb by the weight $W_{band}$(ib) is taken as the estimated residual maximum value $ResP_{max}W_{band}$(id, J).

Next, the pseudo high-frequency subband power difference calculating circuit 36 calculates an estimated residual mean value $ResP_{ave}W_{band}$(id, J). Specifically, regarding each subband of which the index is sb+1 to eb, difference between the pseudo high-frequency subband power $power_{est}$ (ib, $id_{selected}$(J−1), J−1) and the pseudo high-frequency subband power $power_{est}$(ib, id, J) is obtained, and is multiplied by the weight $W_{band}$(ib). The absolute value of a value obtained by dividing Sum of difference multiplied by the weight $W_{band}$(ib) by the number of subbands on the high-frequency side is then taken as the estimated residual mean value $ResP_{ave}W_{band}$(id, J).

Further, the pseudo high-frequency subband power difference calculating circuit 36 obtains sum of the estimated residual square mean value $ResP_{std}W_{band}$(id, J), estimated residual maximum value $ResP_{max}W_{band}$(id, J) multiplied by the weight Wax, and estimated residual mean value $ResP_{ave}W_{band}$(id, J) multiplied by the weight $W_{ave}$, and takes this as an evaluated value $ResPW_{band}$(id, J).

In step S378, the pseudo high-frequency subband power difference calculating circuit 36 adds the evaluated value $ResW_{band}$(id, J) and the evaluated value $ResPW_{band}$(id, J) multiplied by the weight $W_p$(J) in Expression (25) to calculate the final evaluated value $Res_{all}W_{band}$(id, J). This evaluated value $Res_{all}W_{band}$(id, J) is calculated for every K decoded high-frequency subband power estimating coefficients.

Figure 25:
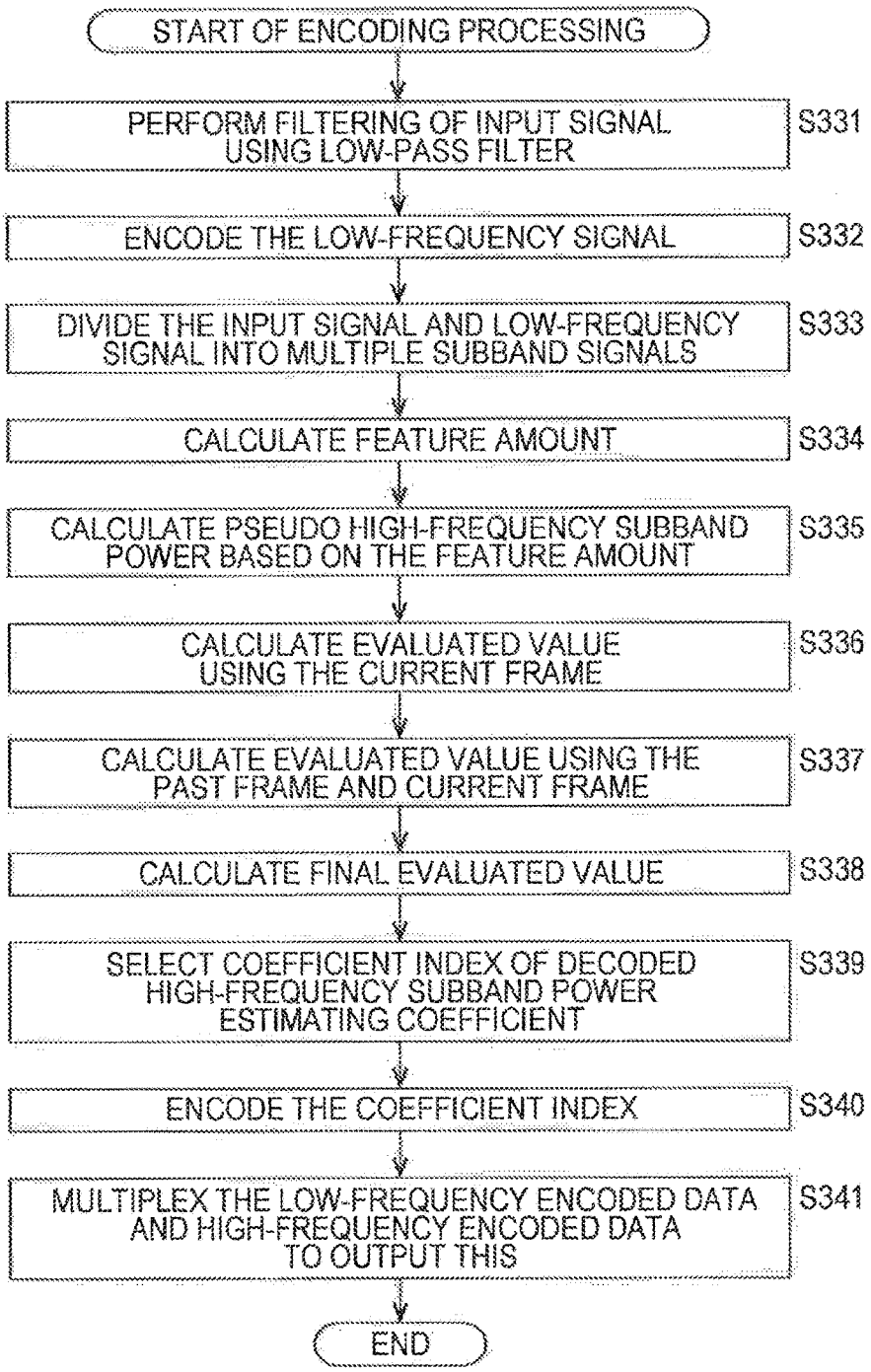
FIG. 25 is a flowchart for describing encoding processing.
Figure 26:
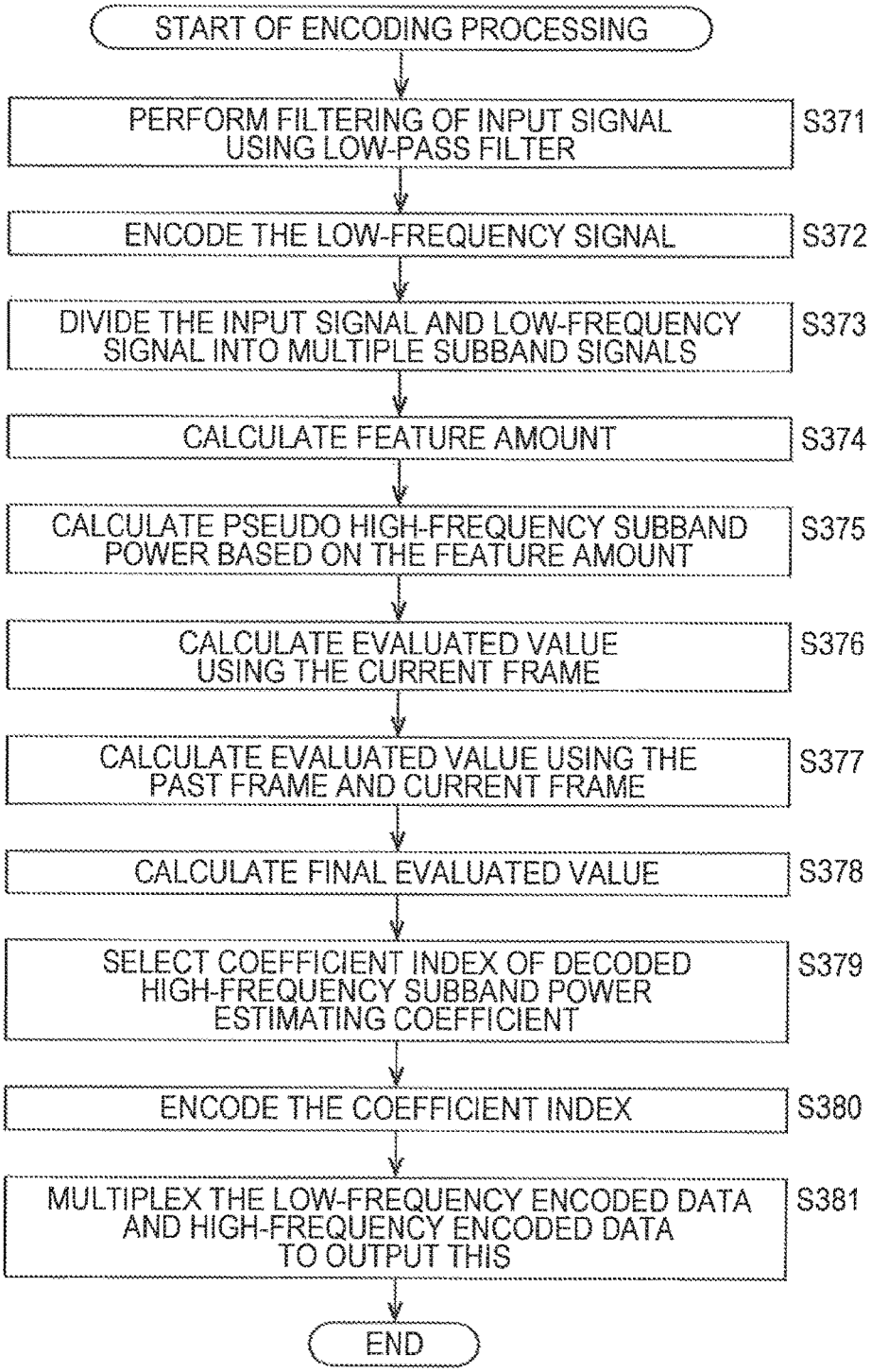
FIG. 26 is a flowchart for describing encoding processing.

Thereafter, processes in step S379 to step S381 are performed, and the encoding processing is ended, but these processes are the same as the processes in step S339 to step S341 in FIG. 25, and accordingly, description thereof will be omitted. Note that, in step S379, of the K coefficient indexes, a coefficient index whereby the evaluated value $Res_{all}W_{band}$ (id, J) becomes the minimum is selected.

In this manner, weighting is performed for each subband so as to put weight on a subband on a lower frequency side, thereby enabling audio with higher sound quality to be obtained at the decoding device 40 side.

Note that while description has been made above that decoded high-frequency subband power estimating coefficients are selected based on the evaluated value $Res_{all}W_{band}$ (id, J), decoded high-frequency subband power estimating coefficients may be selected based on the evaluated value $ResW_{band}$(id, J).

<Modification 3>

Further, the human auditory perception has a characteristic to the effect that the greater a frequency band has amplitude (power), the more the human auditory perception senses this, and accordingly, an evaluated value regarding each decoded high-frequency subband power estimating coefficient may be calculated so as to put weight on a subband with greater power.

Figure 27:
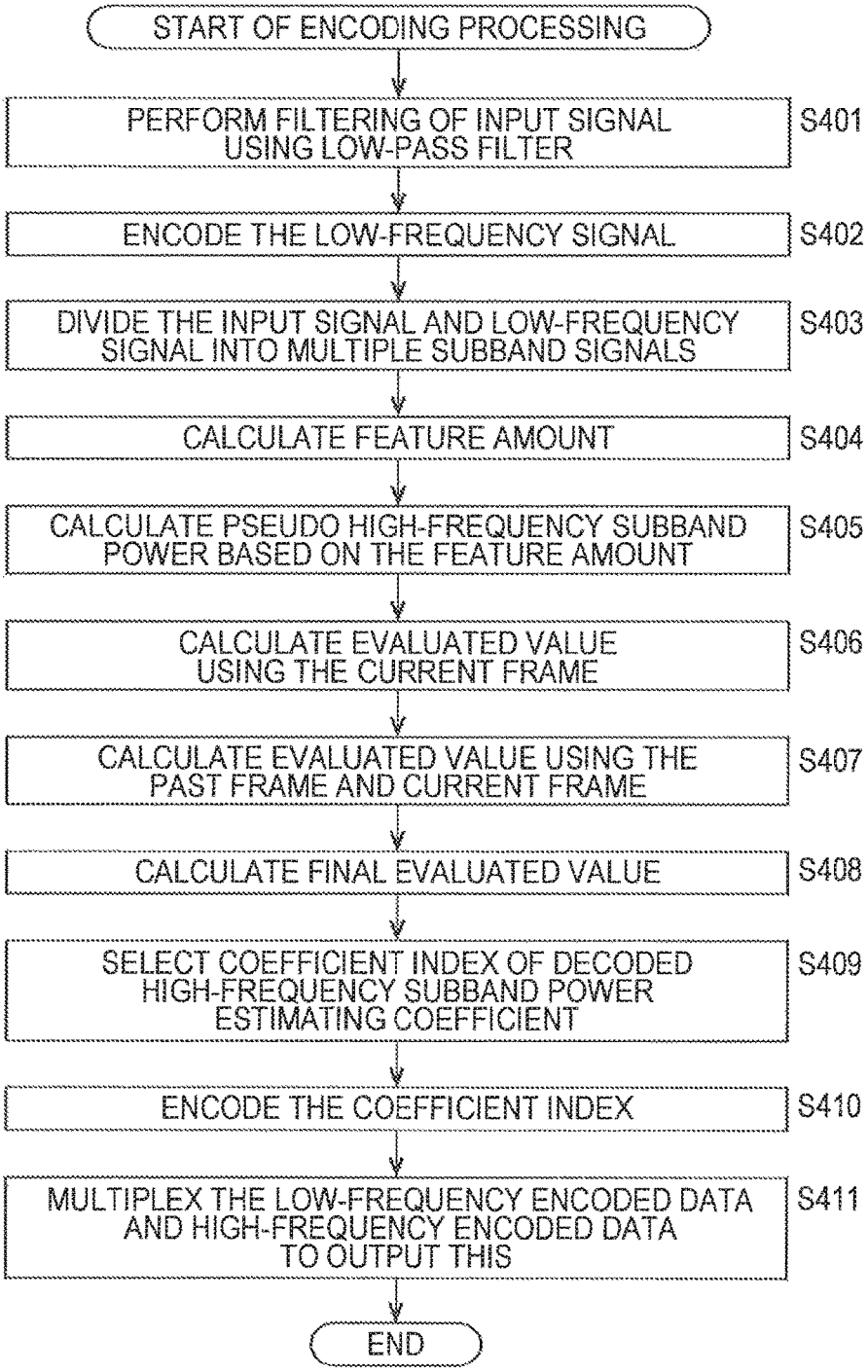
FIG. 27 is a flowchart for describing encoding processing.

In such a case, the decoding device 30 in FIG. 18 performs encoding processing illustrated in the flowchart in FIG. 27. Hereinafter, the encoding processing by the encoding device 30 will be described with reference to the flowchart in FIG. 27. Note that processes in step S401 to step S405 are the same as the processes in step S331 to step S335 in FIG. 25, and accordingly, description thereof will be omitted.

In step S406, the pseudo high-frequency subband power difference calculating circuit 36 calculates an evaluated value $ResW_{power}$(id, J) with the current frame J serving as an object to be processed being employed, for every K decoded high-frequency subband power estimating coefficients.

Specifically, the pseudo high-frequency subband power difference calculating circuit 36 performs the same calculation as with the above-mentioned Expression (1) to calculate a high-frequency subband power power(ib, J) in the frame J using the high-frequency subband signal of each subband supplied from the subband dividing circuit 33.

In the event of the high-frequency subband power power (ib, J) being obtained, the pseudo high-frequency subband power difference calculating circuit 36 calculates the following Expression (29) to calculate a residual square mean value $Res_{std}W_{power}$(id, J)

[Mathematical Expression 29]

$$Res_{std}W_{power}(id, J) = \sum_{ib=sb+1}^{eb} \{W_{power}(\text{power}(ib, J)) \times \{\text{power}(ib, J) - power_{est}(ib, id, J)\}\}^2 \quad (29)$$

Specifically, regarding each subband on the high-frequency side of which the index is sb+1 to eb, difference between the high-frequency subband power power(ib, J) and the pseudo high-frequency subband power $power_{est}$(ib, id, J) is obtained, and the difference thereof is multiplied by weight $W_{power}$(power(ib, J)) for each subband. Sum of squares of the difference multiplied by the weight $W_{power}$ (power(ib, J)) is then taken as a residual square mean value $Res_{std}W_{power}$(id, J).

Here, the weight $W_{power}$(power(ib, J)) (however, sb+1≤ib≤eb) is defined by the following Expression (30), for example. The value of this weight $W_{power}$(power(ib, J)) increases in the event that the greater the high-frequency subband power power(ib, J) of a subband thereof is.

[Mathematical Expression 30]

$$W_{power}(\text{power}(ib, J)) = \frac{3 \times \text{power}(ib, J)}{80} + \frac{35}{8} \quad (30)$$

Next, the pseudo high-frequency subband power difference calculating circuit 36 calculates a residual maximum value $Res_{max}W_{power}$(id, J). Specifically, the maximum value of the absolute value of values obtained by multiplying difference between the high-frequency subband power power(ib, J) and pseudo high-frequency subband power $power_{est}$ (ib, id, J) of each subband of which the index is sb+1 to eb by the weight $W_{power}$(power(ib, J)) is taken as the residual maximum value $Res_{max}W_{power}$(id, J).

Also, the pseudo high-frequency subband power difference calculating circuit 36 calculates a residual mean value $Res_{ave}W_{power}$(id, J).

Specifically, regarding each subband of which the index is sb+1 to eb, difference between the high-frequency subband power power(ib, J) and the pseudo high-frequency subband power $power_{est}$(ib, id, J) is obtained, and is multiplied by the weight $W_{power}$(power(ib, J)), and sum of the difference multiplied by the weight $W_{power}$(power(ib, J)) is obtained. The absolute value of a value obtained by dividing the obtained difference sum by the number of subbands (eb−sb) on the high-frequency side is then taken as the residual mean value $Res_{ave}W_{power}$(id, J).

Further, the pseudo high-frequency subband power difference calculating circuit 36 calculates an evaluated value $ResW_{power}$(id, J). Specifically, sum of the residual square mean value $Res_{std}W_{power}$(id, J), residual maximum value $Res_{max}W_{power}$(id, J) multiplied by the weight $W_{max}$, and residual mean value $Res_{ave}W_{power}$(id, J) multiplied by the weight $W_{ave}$ is taken as the evaluated value $ResW_{power}$(id, J).

In step S407, the pseudo high-frequency subband power difference calculating circuit 36 calculates an evaluated value $ResPW_{power}$(id, J) with the past frame and the current frame being employed.

Specifically, the pseudo high-frequency subband power difference calculating circuit 36 records, regarding the temporally previous frame (J−1) after the frame J to be processed, a pseudo high-frequency subband power of each subband, obtained by using a decoded high-frequency subband power estimating coefficient having the finally selected coefficient index.

The pseudo high-frequency subband power difference calculating circuit 36 first calculates an estimated residual square mean value $ResP_{std}W_{power}$(id, J). Specifically, regarding each subband on the high-frequency side of which the index is sb+1 to eb, difference between the pseudo high-frequency subband power $power_{est}$(ib, $id_{selected}$(J−1), J−1) and the pseudo high-frequency subband power $power_{est}$ (ib, id, J) is obtained, and is multiplied by the weight $W_{power}$(power(ib, J)). Sum of squares of difference multiplied by the weight $W_{power}$(power(ib, J)) is then taken as the estimated residual square mean value $ResP_{std}W_{power}$(id, J).

Next, the pseudo high-frequency subband power difference calculating circuit 36 calculates an estimated residual maximum value $ResP_{max}W_{power}$(id, J). Specifically, the maximum value of the absolute value of values obtained by multiplying difference between the pseudo high-frequency subband power $power_{est}$(ib, $id_{selected}$(J−1), J−1) and the pseudo high-frequency subband power $power_{est}$(ib, id, J) of each subband of which the index is sb+1 to eb by the weight $W_{power}$(power(ib, J)) is taken as the estimated residual maximum value $ResP_{max}W_{power}$(id, J).

Next, the pseudo high-frequency subband power difference calculating circuit 36 calculates an estimated residual mean value $ResP_{ave}W_{power}$(id, J). Specifically, regarding each subband of which the index is sb+1 to eb, difference between the pseudo high-frequency subband power $power_{est}$ (ib, $id_{selected}$(J−1), J−1) and the pseudo high-frequency subband power $power_{est}$(ib, id, J) is obtained, and is multiplied by the weight $W_{power}$(power(ib, J)). The absolute value of a value obtained by dividing Sum of difference multiplied by the weight $W_{power}$(power(ib, J)) by the number of subbands (eb−sb) on the high-frequency side is then taken as the estimated residual mean value $ResP_{ave}W_{power}$(id, J).

Further, the pseudo high-frequency subband power difference calculating circuit 36 obtains sum of the estimated residual square mean value $ResP_{std}W_{power}$(id, J), estimated residual maximum value $ResP_{max}W_{power}$(id, J) multiplied by the weight $W_{max}$, and estimated residual mean value $ResP_{ave}W_{power}$(id, J) multiplied by the weight $W_{ave}$, and takes this as an evaluated value $ResPW_{power}$(id, J).

In step S408, the pseudo high-frequency subband power difference calculating circuit 36 adds the evaluated value $ResW_{power}$(id, J) and the evaluated value $ResPW_{power}$(id, J) multiplied by the weight $W_p$(J) in Expression (25) to calculate the final evaluated value $Res_{all}W_{power}$(id, J). This evaluated value $Res_{all}W_{power}$(id, J) is calculated for every K decoded high-frequency subband power estimating coefficients.

Thereafter, processes in step S409 to step S411 are performed, and the encoding processing is ended, but these processes are the same as the processes in step S339 to step S341 in FIG. 25, and accordingly, description thereof will be omitted. Note that, in step S409, of the K coefficient indexes, a coefficient index whereby the evaluated value $Res_{all}W_{power}$(id, J) becomes the minimum is selected.

In this manner, weighting is performed for each subband so as to put weight on a subband having great power, thereby enabling audio with higher sound quality to be obtained at the decoding device 40 side.

Note that description has been made so far wherein selection of a decoded high-frequency subband power estimating coefficient is performed based on the evaluated value $Res_{all}W_{power}$(id, J), but a decoded high-frequency subband power estimating coefficient may be selected based on the evaluated value $ResW_{power}$(id, J).

6. Sixth Embodiment

[Configuration of Coefficient Learning Device]

Incidentally, the set of the coefficient $A_{ib}$(kb) and coefficient $B_{ib}$ serving as decoded high-frequency subband power estimating coefficients have been recorded in the decoding device 40 in FIG. 20 in a manner correlated with a coefficient index. For example, in the event that the decoded high-frequency subband power estimating coefficients of 128 coefficient indexes are recorded in the decoding device 40, a great region needs to be prepared as a recording region such as memory to record these decoded high-frequency subband power estimating coefficients, or the like.

Figure 28:
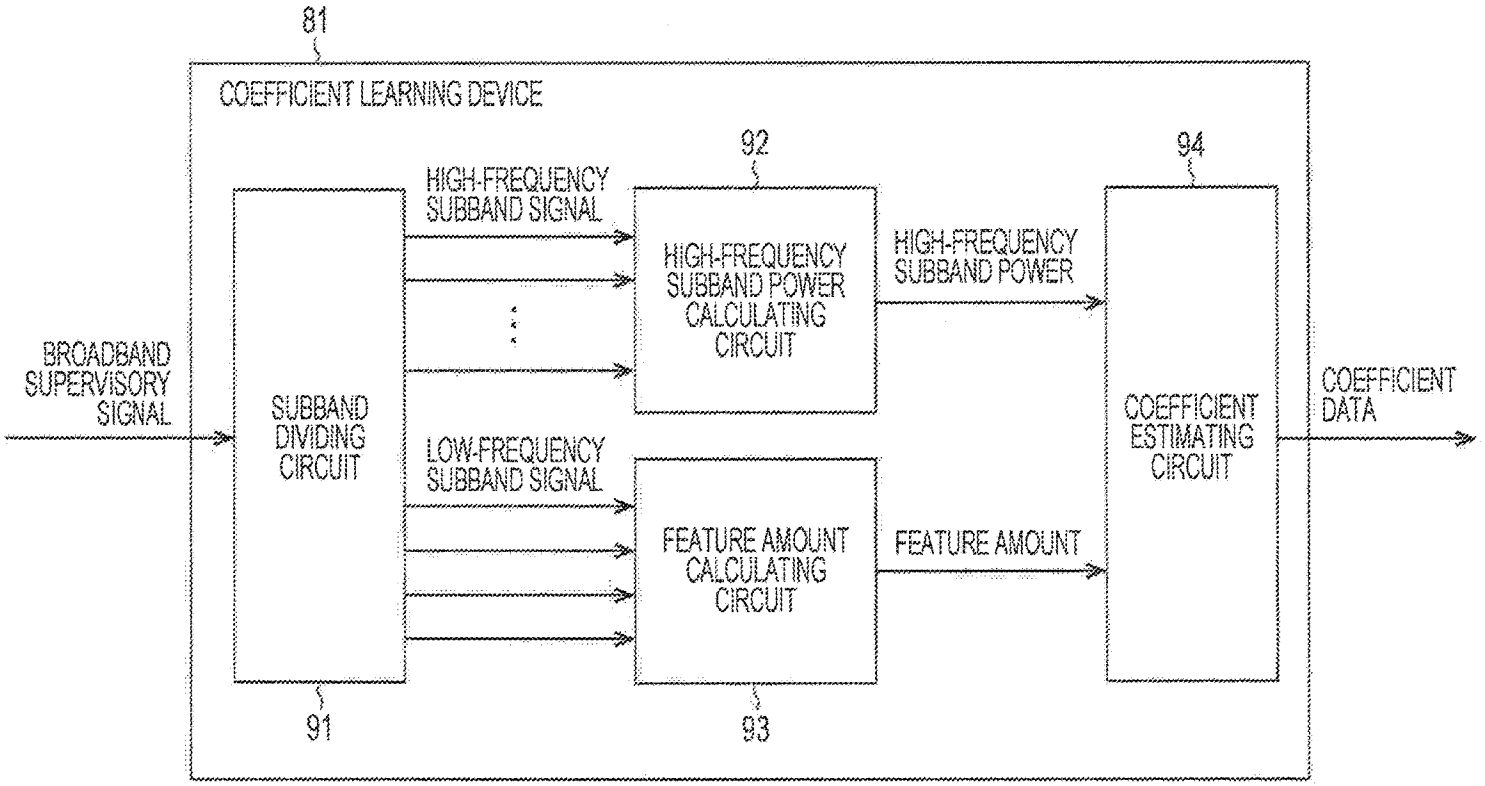
FIG. 28 is a diagram illustrating a configuration example of a coefficient learning processing.

Therefore, an arrangement may be made wherein a part of several decoded high-frequency subband power estimating coefficients are taken as common coefficients, and accordingly, the recording region used for recording the decoded high-frequency subband power estimating coefficients is reduced. In such a case, a coefficient learning device which obtains decoded high-frequency subband power estimating coefficients by learning is configured as illustrated in FIG. 28, for example.

A coefficient learning device 81 is configured of a subband dividing circuit 91, a high-frequency subband power calculating circuit 92, a feature amount calculating circuit 93, and a coefficient estimating circuit 94.

Multiple music data to be used for learning, and so forth are supplied to this coefficient learning device 81 as broadband supervisory signals. The broadband supervisory signals are signals in which multiple high-frequency subband components and multiple low-frequency subband components are included.

The subband dividing circuit 91 is configured of a band pass filter and so forth, divides a supplied broadband supervisory signal into multiple subband signals, and supplied to the high-frequency subband power calculating circuit 92 and feature amount calculating circuit 93. Specifically, the high-frequency subband signal of each subband on the high-frequency side of which the index is sb+1 to eb is supplied to the high-frequency subband power calculating circuit 92, and the low-frequency subband signal of each subband on the low-frequency side of which the index is sb−3 to sb is supplied to the feature amount calculating circuit 93.

The high-frequency subband power calculating circuit 92 calculates the high-frequency subband power of each high-frequency subband signal supplied from the subband dividing circuit 91 to supply to the coefficient estimating circuit 94. The feature amount calculating circuit 93 calculates a low-frequency subband power as a feature amount based on each low-frequency subband signal supplied from the subband dividing circuit 91 to supply to the coefficient estimating circuit 94.

The coefficient estimating circuit 94 generates a decoded high-frequency subband power estimating coefficient by performing regression analysis using the high-frequency subband power from the high-frequency subband power calculating circuit 92 and the feature amount from the feature amount calculating circuit 93 to output to the decoding device 40.

[Description of Coefficient Learning Device]

Next, coefficient learning processing to be performed by the coefficient learning device 81 will be described with reference to the flowchart in FIG. 29.

In step S431, the subband dividing circuit 91 divides each of the supplied multiple broadband supervisory signals into multiple subband signals. The subband dividing circuit 91 then supplies the high-frequency subband signal of a subband of which the index is sb+1 to eb to the high-frequency subband power calculating circuit 92, and supplies the low-frequency subband signal of a subband of which the index is sb−3 to sb to the feature amount calculating circuit 93.

In step S432, the high-frequency subband power calculating circuit 92 performs the same calculation as with the above-mentioned Expression (1) on each high-frequency subband signal supplied from the subband dividing circuit 91 to calculate a high-frequency subband power to supply to the coefficient estimating circuit 94.

In step S433, the feature amount calculating circuit 93 performs the calculation of the above-mentioned Expression (1) on each low-frequency subband signal supplied from the subband dividing circuit 91 to calculate a low-frequency subband power as a feature amount to supply to the coefficient estimating circuit 94.

Thus, the high-frequency subband power and the low-frequency subband power regarding each frame of the multiple broadband supervisory signals are supplied to the coefficient estimating circuit 94.

In step S434, the coefficient estimating circuit 94 performs regression analysis using the least square method to calculate a coefficient $A_{ib}$(kb) and a coefficient $B_{ib}$ for each subband ib (however, sb+1≤ib≤eb) of which the index is sb+1 to eb.

Note that, with the regression analysis, the low-frequency subband power supplied from the feature amount calculating circuit 93 is taken as an explanatory variable, and the high-frequency subband power supplied from the high-frequency subband power calculating circuit 92 is taken as an explained variable. Also, the regression analysis is performed by the low-frequency subband powers and high-frequency subband powers of all of the frames making up all of the broadband supervisory signals supplied to the coefficient learning device 81 being used.

In step S435, the coefficient estimating circuit 94 obtains the residual vector of each frame of the broadband supervisory signals using the obtained coefficient $A_{ib}$(kb) and coefficient $B_{ib}$ for each subband ib.

For example, the coefficient estimating circuit 94 subtracts sum of the total sum of the low-frequency subband power power(kb, J) (however, sb−3≤kb≤sb) multiplied by the coefficient $A_{ib}$(kb), and the coefficient $B_{ib}$ from the high-frequency subband power power(ib, J) for each subband ib (however, sb+1≤ib≤eb) of the frame J to obtain residual. A vector made up of the residual of each subband ib of the frame J is taken as a residual vector.

Note that the residual vector is calculated regarding all of the frames making up all of the broadband supervisory signals supplied to the coefficient learning device 81.

In step S436, the coefficient estimating circuit 94 normalizes the residual vector obtained regarding each of the frames. For example, the coefficient estimating circuit 94 obtains, regarding each subband ib, residual dispersion values of the subbands ib of the residual vectors of all of the frames, and divides the residual of the subband ib in each residual vector by the square root of the dispersion values thereof, thereby normalizing the residual vectors.

In step S437, the coefficient estimating circuit 94 performs clustering on the normalized residual vectors of all of the frames by the k-means method or the like.

For example, let us say that an average frequency envelopment of all of the frames obtained at the time of performing estimation of a high-frequency subband power using the coefficient $A_{ib}$(kb) and coefficient $B_{ib}$ will be referred to as an average frequency envelopment SA. Also, let us say that predetermined frequency envelopment of which the power is greater than that of the average frequency envelopment SA will be referred to as a frequency envelopment SH, and predetermined frequency envelopment of which the power is smaller than that of the average frequency envelopment SA will be referred to as a frequency envelopment SL.

At this time, clustering of the residual vectors is performed so that the residual vectors of coefficients whereby frequency envelopments approximate to the average frequency envelopment SA, frequency envelopment SH, and frequency envelopment SL have been obtained belong to a cluster CA, a cluster CH, and a cluster CL respectively. In other words, clustering is performed so that the residual vector of each frame belongs to any of the cluster CA, cluster CH or cluster CL.

With the frequency band expanding processing to estimate a high-frequency component based on a correlation between a low-frequency component and a high-frequency component, when calculating a residual vector using the coefficient $A_{ib}$(kb) and coefficient $B_{ib}$ obtained by the regression analysis, residual error increases as a subband belongs to a higher frequency side on characteristics thereof. Therefore, when performing clustering on a residual vector without change, processing is performed so that weight is put on a subband on a higher frequency side.

On the other hand, with the coefficient learning device 81, residual vectors are normalized with the residual dispersion value of each subband, whereby clustering may be performed with even weight being put on each subband assuming that the residual dispersion of each subband is equal on appearance.

In step S438, the coefficient estimating circuit 94 selects any one cluster of the cluster CA, cluster CH, or cluster CL as a cluster to be processed.

In step S439, the coefficient estimating circuit 94 calculates the coefficient $A_{ib}$(kb) and coefficient $B_{ib}$ of each subband ib (however, sb+1≤ib≤eb) by the regression analysis using the frames of residual vectors belonging to the selected cluster as the cluster to be processed.

Specifically, if we say that the frame of a residual vector belonging to the cluster to be processed will be referred to as a frame to be processed, the low-frequency subband powers and high-frequency subband powers of all of the frames to be processed are taken as explanatory variables and explained variables, and the regression analysis employing the least square method is performed. Thus, the coefficient $A_{ib}$(kb) and coefficient $B_{ib}$ are obtained for each subband ib.

In step S440, the coefficient estimating circuit 94 obtains, regarding all of the frames to be processed, residual vectors using the coefficient $A_{ib}$(kb) and coefficient $B_{ib}$ obtained by the processing in step S439. Note that, in step S440, the same processing as with step S435 is performed, and the residual vector of each frame to be processed is obtained.

In step S441, the coefficient estimating circuit 94 normalizes the residual vector of each frame to be processed obtained in the processing in step S440 by performing the same processing as with step S436. That is to say, normalization of a residual vector is performed by residual error being divided by the square root of a dispersion value for each subband.

In step S442, the coefficient estimating circuit 94 performs clustering on the normalized residual vectors of all of the frames to be processed by the k-means method or the like. The number of clusters mentioned here is determined as follows. For example, in the event of attempting to generate decoded high-frequency subband power estimating coefficients of 128 coefficient indexes at the coefficient learning device 81, a number obtained by multiplying the number of the frames to be processed by 128, and further dividing this by the number of all of the frames is taken as the number of clusters. Here, the number of all of the frames is a total number of all of the frames of all of the broadband supervisory signals supplied to the coefficient learning device 81.

In step S443, the coefficient estimating circuit 94 obtains the center-of-gravity vector of each cluster obtained by the processing in step S442.

For example, the cluster obtained by the clustering in step S442 corresponds to a coefficient index, a coefficient index is assigned for each cluster at the coefficient learning device 81, and the decoded high-frequency subband power estimating coefficient of each coefficient index is obtained.

Specifically, let us say that in step S438, the cluster CA has been selected as the cluster to be processed, and F clusters have been obtained by the clustering in step S442. Now, if we pay attention on a cluster CF which is one of the F clusters, the decoded high-frequency subband power estimating coefficient of the coefficient index of the cluster CF is taken as the coefficient $A_{ib}$(kb) obtained regarding the cluster CA in step S439 which is a linear correlation term. Also, sum of a vector obtained by subjecting the center-of-gravity vector of the cluster CF obtained in step S443 to inverse processing of normalization performed in step S441 (reverse normalization), and the coefficient $B_{ib}$ obtained in step S439 is taken as the coefficient $B_{ib}$ which is a constant term of the decoded high-frequency subband power estimating coefficient. The reverse normalization mentioned here is processing to multiply each factor of the center-of-gravity vector of the cluster CF by the same value as with the normalization (square root of dispersion values for each subband) in the event that normalization performed in step S441 is to divide residual error by the square root of dispersion values for each subband, for example.

Specifically, the set of the coefficient $A_{ib}$(kb) obtained in step S439, and the coefficient $B_{ib}$ obtained as described above becomes the decoded high-frequency subband power estimating coefficient of the coefficient index of the cluster CF. Accordingly, each of the F clusters obtained by the clustering commonly has the coefficient $A_{ib}$(kb) obtained regarding the cluster CA as a liner correlation term of the decoded high-frequency subband power estimating coefficient.

In step S444, the coefficient learning device 81 determines whether or not all of the clusters of the cluster CA, cluster CH, and cluster CL have been processed as the cluster to be processed. In the event that determination is made in step S444 that all of the clusters have not been processed, the processing returns to step S438, and the above-mentioned processing is repeated. That is to say, the next cluster is selected as an object to be processed, and a decoded high-frequency subband power estimating coefficient is calculated.

On the other hand, in the event that determination is made in step S444 that all of the clusters have been processed, a desired predetermined number of decoded high-frequency subband power estimating coefficients have been obtained, and accordingly, the processing proceeds to step S445.

In step S445, the coefficient estimating circuit 94 outputs the obtained coefficient index and decoded high-frequency subband power estimating coefficient to the decoding device 40 to record these therein, and the coefficient learning processing is ended.

For example, the decoded high-frequency subband power estimating coefficients to be output to the decoding device 40 include several decoded high-frequency subband power estimating coefficients having the same coefficient $A_{ib}$(kb) as a linear correlation term. Therefore, the coefficient learning device 81 correlates these common coefficients $A_{ib}$(kb) with a liner correlation term index (pointer) which is information for identifying the coefficients $A_{ib}$(kb), and also correlates the coefficient indexes with the linear correlation term index and the coefficient $B_{ib}$ which is a constant term.

The coefficient learning device 81 then supplies the correlated linear correlation term index (pointer) and the coefficient $A_{ib}$(kb), and the correlated coefficient index and linear correlation term index (pointer) and the coefficient $B_{ib}$ to the decoding device 40 to store these in memory within the high-frequency decoding circuit 45 of the decoding device 40. In this manner, at the time of recording the multiple decoded high-frequency subband power estimating coefficients, with regard to common linear correlation terms, if linear correlation term indexes (pointers) are stored in a recording region for the decoded high-frequency subband power estimating coefficients, the recording region may significantly be reduced.

In this case, the linear correlation term indexes and the coefficients $A_{ib}$(kb) are recorded in the memory within the high-frequency decoding circuit 45 in a correlated manner, and accordingly, a linear correlation term index and the coefficient $B_{ib}$ may be obtained from a coefficient index, and further, the coefficient $A_{ib}$(kb) may be obtained from the linear correlation term index.

Note that, as a result of analysis by the present applicant even if the linear correlation terms of the multiple decoded high-frequency subband power estimating coefficients are commonized to around three patterns, it has been known that there is almost none regarding deterioration of sound quality on listenability of audio subjected to the frequency band expanding processing. Accordingly, according to the coefficient learning device 81, the recording region used for recording of decoded high-frequency subband power estimating coefficients may further be reduced without deteriorating audio sound quality after the frequency band expanding processing.

As described above, the coefficient learning device 81 generates and outputs the decoded high-frequency subband power estimating coefficient of each coefficient index from the supplied broadband supervisory signal.

Figure 29:
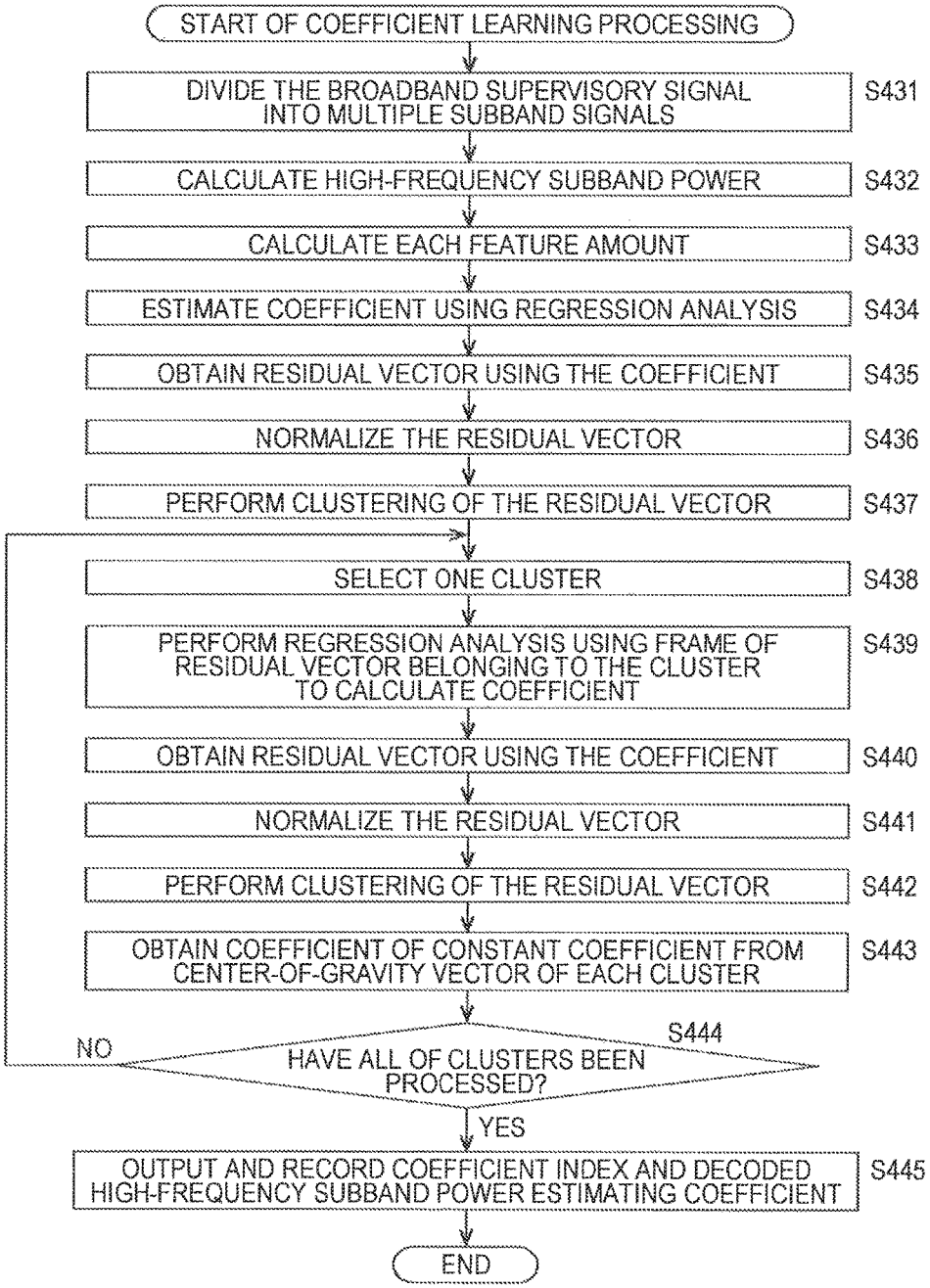
FIG. 29 is a flowchart for describing coefficient learning processing.

Note that, with the coefficient learning processing in FIG. 29, description has been made that residual vectors are normalized, but in one of step S436 or step S441, or both, normalization of the residual vectors may not be performed.

Alternatively, while normalization of the residual vectors may be performed, sharing of linear correlation terms of decoded high-frequency subband power estimating coefficients may not be performed. In such a case, after the normalization processing in step S436, the normalized residual vectors are subjected to clustering to the same number of clusters as the number of decoded high-frequency subband power estimating coefficients to be obtained. The regression analysis is performed for each cluster using the frame of a residual vector belonging to each cluster, and the decoded high-frequency subband power estimating coefficient of each cluster is generated.

7. Seventh Embodiment

[Functional Configuration Example of Encoding Device]

Incidentally, description has been made so far wherein at the time of encoding of an input signal, the coefficient $A_{ib}$(kb) and coefficient $B_{ib}$ whereby a high-frequency envelope may be estimated with the best precision, are selected from a low-frequency envelope of the input signal. In this case, information of coefficient index indicating the coefficient $A_{ib}$(kb) and coefficient $B_{ib}$ is included in the output code string and is transmitted to the decoding side, and at the time of decoding of the output code string, a high-frequency envelope is generated by using the coefficient $A_{ib}$(kb) and coefficient $B_{ib}$ corresponding to the coefficient index.

However, in the event that temporal fluctuation of a low-frequency envelope is great, even if estimation of a high-frequency envelope has been performed using the same coefficient $A_{ib}$(kb) and coefficient $B_{ib}$ for consecutive frames of the input signal, temporal fluctuation of the high-frequency envelope increases.

In other words, in the event that temporal fluctuation of a low-frequency subband power is great, even if a decoded high-frequency subband power has been calculated using the same coefficient $A_{ib}$(kb) and coefficient $B_{ib}$, temporal fluctuation of the decoded high-frequency subband power increases. This is because a low-frequency subband power is employed for calculation of a decoded high-frequency subband power, and accordingly, when the temporal fluctuation of this low-frequency subband power is great, a decoded high-frequency subband power to be obtained also temporally greatly fluctuates.

Also, though description has been made so far wherein the multiple sets of the coefficient $A_{ib}$(kb) and coefficient $B_{ib}$ are prepared beforehand by learning with a broadband supervisory signal, this broadband supervisory signal is a signal obtained by encoding the input signal, and further decoding the input signal after encoding.

The sets of the coefficient $A_{ib}$(kb) and coefficient $B_{ib}$ obtained by such learning are coefficient sets suitable for a case to encode the actual input signal using the coding system and encoding algorithm when encoding the input signal at the time of learning.

At the time of generating a broadband supervisory signal, a different broadband supervisory is obtained depending on what kind of coding system is employed for encoding/decoding the input signal. Also, if the encoders (encoding algorithms) differ though the same coding system is employed, a different broadband supervisory signal is obtained.

Accordingly, in the event that only one signal obtained by encoding/decoding the input signal using a particular coding system and encoding algorithm has been employed as a broadband supervisory signal, it might have been difficult to estimate a high-frequency envelope with high precision from the obtained coefficient $A_{ib}$(kb) and coefficient $B_{ib}$. That is to say, there might have not been able to sufficiently handle difference between coding systems or between encoding algorithms.

Therefore, an arrangement may be made wherein smoothing of a low-frequency envelope, and generation of suitable coefficients are performed, thereby enabling a high-frequency envelope to be estimated with high precision regardless of temporal fluctuation of a low-frequency envelope, coding system, and so forth.

Figure 30:
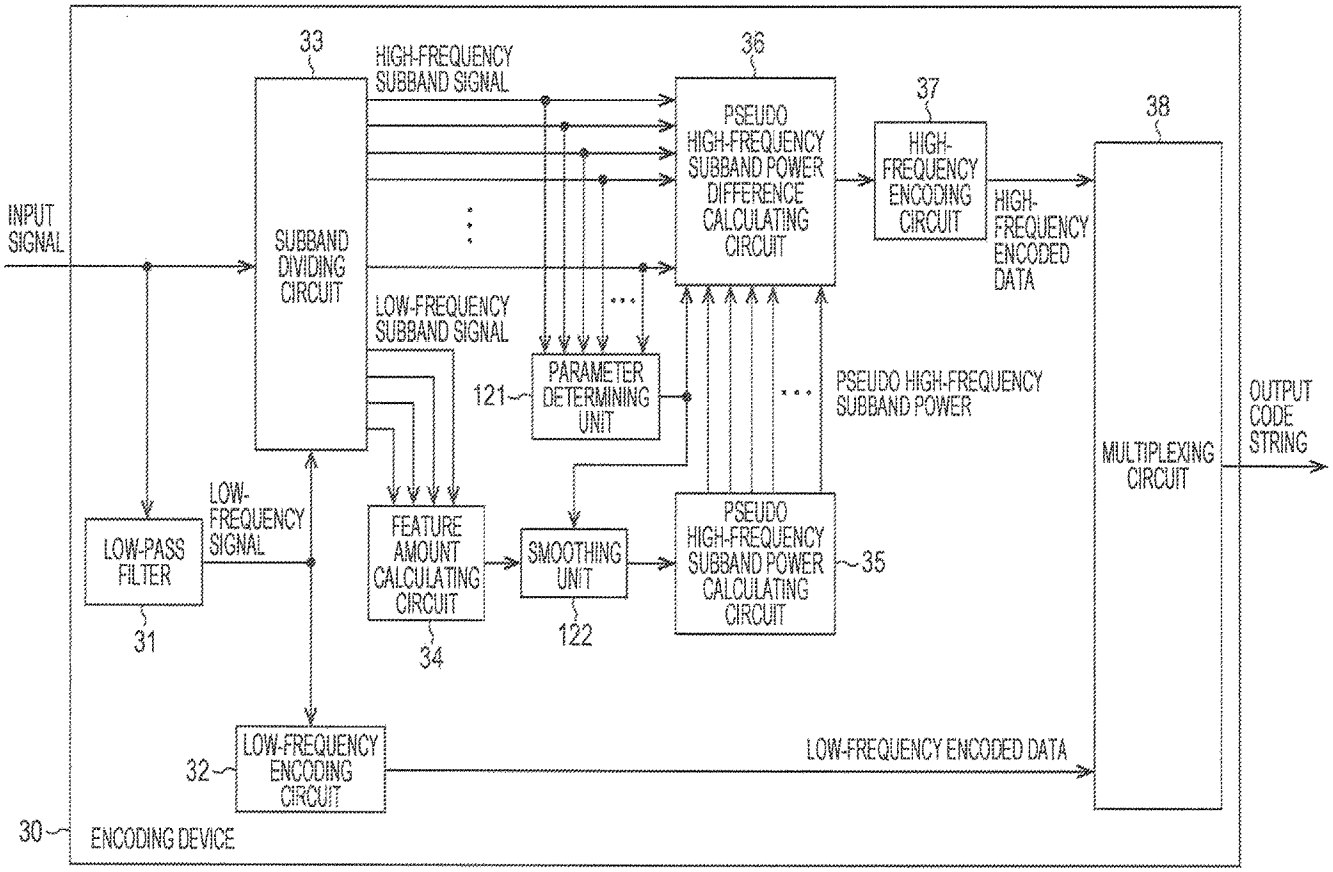
FIG. 30 is a block diagram illustrating a functional configuration example of an encoding device.

In such a case, an encoding device which encodes the input signal is configured as illustrated in FIG. 30. Note that, in FIG. 30, a portion corresponding to the case in FIG. 18 is denoted with the same reference numeral, and description thereof will be omitted as appropriate. The encoding device 30 in FIG. 30 differs from the encoding device 30 in FIG. 18 in that a parameter determining unit 121 and a smoothing unit 122 are newly provided, and other points are the same.

The parameter determining unit 121 generates a parameter relating to smoothing of a low-frequency subband power to be calculated as a feature amount (hereinafter, referred to as smoothing parameter) based on the high-frequency subband signal supplied from the subband dividing circuit 33. The parameter determining unit 121 supplies the generated smoothing parameter to the pseudo high-frequency subband power difference calculating circuit 36 and smoothing unit 122.

Here, the smoothing parameter is information or the like indicating how many frames worth of temporally consecutive low-frequency subband power is used to smooth the low-frequency subband power of the current frame serving as an object to be processed, for example. That is to say, a parameter to be used for smoothing processing of a low-frequency subband power is determined by the parameter determining unit 121.

The smoothing unit 122 smoothens the low-frequency subband power serving as a feature amount supplied from the feature amount calculating circuit 34 using the smoothing parameter supplied from the parameter determining unit 121 to supply to the pseudo high-frequency subband power calculating circuit 35.

With the pseudo high-frequency subband power calculating circuit 35, the multiple decoded high-frequency subband power estimating coefficients obtained by regression analysis, a coefficient group index and a coefficient index to identify these decoded high-frequency subband power estimating coefficients are recorded in a correlated manner.

Specifically, encoding is performed on one input signal in accordance with each of multiple different coding systems and encoding algorithms, a signal obtained by further decoding a signal obtained by encoding is prepared as a broadband supervisory signal.

For every of these multiple broadband supervisory signals, a low-frequency subband power is taken as an explanatory variable, and a high-frequency subband power is taken as an explained variable. According to the regression analysis (learning) using the least square method, the multiple sets of the coefficient $A_{ib}$(kb) and coefficient $B_{ib}$ of each subband are obtained and recorded in the pseudo high-frequency subband power calculating circuit 35.

Here, with learning using one broadband supervisory signal, there are obtained multiple sets of the coefficient $A_{ib}$(kb) and coefficient $B_{ib}$ of each subband (hereinafter, referred to as coefficient sets). Let us say that a group of multiple coefficient sets, obtained from one broadband supervisory signal in this manner will be referred to as a coefficient group, information to identify a coefficient group will be referred to as a coefficient group index, and information to identify a coefficient set belonging to a coefficient group will be referred to as a coefficient index.

With the pseudo high-frequency subband power calculating circuit 35, a coefficient set of multiple coefficient groups is recorded in a manner correlated with a coefficient group index and a coefficient index to identify the coefficient set thereof. That is to say, a coefficient set (coefficient $A_{ib}$(kb) and coefficient $B_{ib}$) serving as a decoded high-frequency subband power estimating coefficient, recorded in the pseudo high-frequency subband power calculating circuit 35 is identified by a coefficient group index and a coefficient index.

Note that, at the time of learning of a coefficient set, a low-frequency subband power serving as an explanatory variable may be smoothed by the same processing as with smoothing of a low-frequency subband power serving as a feature amount at the smoothing unit 122.

The pseudo high-frequency subband power calculating circuit 35 calculates the pseudo high-frequency subband power of each subband on the high-frequency side using, for each recoded decoded high-frequency subband power estimating coefficient, the decoded high-frequency subband power estimating coefficient, and the feature amount after smoothing supplied from the smoothing unit 122 to supply to the pseudo high-frequency subband power difference calculating circuit 36.

The pseudo high-frequency subband power difference calculating circuit 36 compares a high-frequency subband power obtained from the high-frequency subband signal supplied from the subband dividing circuit 33, and the pseudo high-frequency subband power from the pseudo high-frequency subband power calculating circuit 35.

The pseudo high-frequency subband power difference calculating circuit 36 then supplies, as a result of the comparison, of the multiple decoded high-frequency subband power estimating coefficients, the coefficient group index and coefficient index of the decoded high-frequency subband power estimating coefficient whereby a pseudo high-frequency subband power most approximate to a high-frequency subband power has been obtained, to the high-frequency encoding circuit 37. Also, pseudo high-frequency subband power difference calculating circuit 36 also supplies smoothing information indicating the smoothing parameter supplied from the parameter determining unit 121 to the high-frequency encoding circuit 37.

In this manner, multiple coefficient groups are prepared beforehand by learning so as to handle difference of coding systems or encoding algorithms, and are recoded in the pseudo high-frequency subband power calculating circuit 35, whereby a more suitable decoded high-frequency subband power estimating coefficient may be employed. Thus, with the decoding side of the output code string, estimation of a high-frequency envelope may be performed with higher precision regardless of coding systems or encoding algorithms.

[Encoding Processing of Encoding Device]

Figure 31:
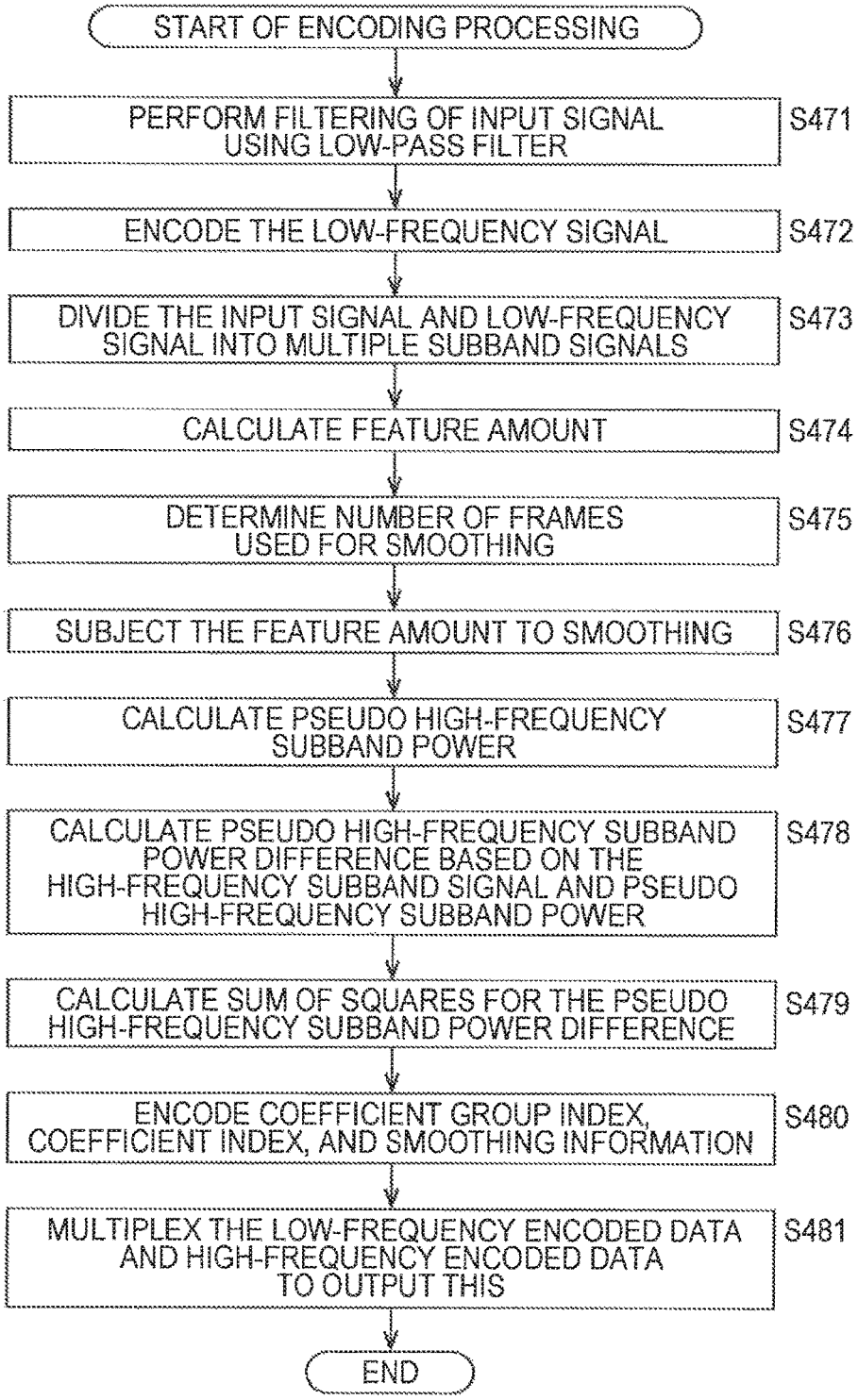
FIG. 31 is a flowchart for describing encoding processing.

Next, encoding processing to be performed by the encoding device 30 in FIG. 30 will be described with reference to the flowchart in FIG. 31. Note that processes in step S471 to step S474 are the same as the processes in step S181 to step S184 in FIG. 19, and accordingly, description thereof will be omitted.

However, the high-frequency subband signal obtained in step S473 is supplied from the subband dividing circuit 33 to the pseudo high-frequency subband power difference calculating circuit 36 and parameter determining unit 121. Also, in step S474, as a feature amount, the low-frequency subband power power(ib, J) of each subband ib (sb−3≤ib≤sb) on the low-frequency side of the frame J serving as an object to be processed is calculated and supplied to the smoothing unit 122.

In step S475, the parameter determining unit 121 determines the number of frames to be used for smoothing of a feature amount, based on the high-frequency subband signal of each subband on the high-frequency side supplied from the subband dividing circuit 33.

For example, the parameter determining unit 121 performs the calculation of the above-mentioned Expression (1) regarding each subband ib (however, sb+1≤ib≤eb) on the high-frequency side of the frame J serving as an object to be processed to obtain a subband power, and further obtains sum of these subband powers.

Similarly, the parameter determining unit 121 obtains, regarding the temporally one previous frame (J−1) before the frame J, the subband power of each subband ib on the high-frequency side, and further obtains sum of these subband powers. The parameter determining unit 121 compares a value obtained by subtracting the sum of the subband powers obtained regarding the frame (J−1) from the sum of the subband powers obtained regarding the frame J (hereinafter, referred to as difference of subband power sum), and a predetermined threshold.

For example, the parameter determining unit 121 determines, in the event that the difference of subband power sum is equal to or greater than the threshold, the number of frames to be used for smoothing of a feature amount (hereinafter, referred to as the number-of-frames ns) to be ns=4, and in the event that the difference of subband power sum is less than the threshold, determines the number-of-frames ns to be ns=16. The parameter determining unit 121 supplies the determined number-of-frames ns to the pseudo high-frequency subband power difference calculating circuit 36 and smoothing unit 122 as the smoothing parameter.

Now, an arrangement may be made wherein difference of subband power sum and multiple thresholds are compared, and the number-of-frames ns is determined to be any of three or more values.

In step S476, the smoothing unit 122 calculates the following Expression (31) using the smoothing parameter supplied from the parameter determining unit 121 to smooth the feature amount supplied from the feature amount calculating circuit 34, and supplies this to the pseudo high-frequency subband power calculating circuit 35. That is to say, the low-frequency subband power power(ib, J) of each subband on the low-frequency side of the frame J to be processed supplied as the feature amount is smoothed.

[Mathematical Expression 31]

$$\text{power}_{smooth}(ib, J) = \sum_{ti=0}^{ns-1} (\text{power}(ib, J - ti) \cdot SC(ti)) \tag{31}$$

Note that, in Expression (31), the ns is the number-of-frames ns serving as a smoothing parameter, and the greater this number-of-frames ns is, the more frames are used for smoothing of the low-frequency subband power serving as a feature amount. Also, let us say that the low-frequency subband powers of the subbands of several frames worth before the frame J are held in the smoothing unit 122.

Also, weight SC(l) by which the low-frequency subband power power(ib, J) is multiplied is weight to be determined by the following Expression (32), for example. The weight SC(l) for each frame has a great value as much as the weight SC(l) by which a frame temporally approximate to the frame J to be processed is multiplied.

[Mathematical Expression 32]

$$SC(l) = \frac{\sqrt{\cos\left(\frac{2 \cdot \pi \cdot l}{4 \cdot \text{ns}}\right)}}{\sum_{li=0}^{ns-1} \sqrt{\cos\left(\frac{2 \cdot \pi \cdot li}{4 \cdot \text{ns}}\right)}} \tag{32}$$

Accordingly, with the smoothing unit 122, the feature amount is smoothed by performing weighted addition by weighting SC(l) on the past ns frames worth of low-frequency subband powers to be determined by the number-of-frames ns including the current frame J. Specifically, an weighted average of low-frequency subband powers of the same subbands from the frame J to the frame (J−ns+1) is obtained as the low-frequency subband power $\text{power}_{smooth}$(ib, J) after the smoothing.

Here, the greater the number-of-frames ns to be used for smoothing is, the smaller temporal fluctuation of the low-frequency subband power $\text{power}_{smooth}$(ib, J) is. Accordingly, in the event of estimating a subband power on the high-frequency side using the low-frequency subband power $\text{power}_{smooth}$(ib, J), temporal fluctuation of an estimated value of a subband power on the high-frequency side may be reduced.

However, unless the number-of-frames ns is set to a smaller value as much as possible for a transitory input signal such as attack or the like, i.e., an input signal where temporal fluctuation of the high-frequency component is great, tracking for temporal change of the input signal is delayed. Consequently, with the decoding side, when playing an output signal obtained by decoding, unnatural sensations in listenability may likely be caused.

Therefore, with the parameter determining unit 121, in the event that the above-mentioned difference of subband power sum is equal to or greater than the threshold, the input signal is regarded as a transitory signal where the subband power on the high-frequency side temporally greatly fluctuates, and the number-of-frames ns is determined to be a smaller value (e.g., ns=4). Thus, even when the input signal is a transitory signal (signal with attack), the low-frequency subband power is suitably smoothed, temporal fluctuation of the estimated value of the subband power on the high-frequency side is reduced, and also, delay of tracking for change in high-frequency components may be suppressed.

On the other hand, in the event that the difference of subband power sum is less than the threshold, with the parameter determining unit 121, the input signal is regarded as a constant signal with less temporal fluctuation of the subband power on the high-frequency side, and the number-of-frames ns is determined to be a greater value (e.g., ns=16). Thus, the low-frequency subband power is suitably smoothed, and temporal fluctuation of the estimated value of the subband power on the high-frequency side may be reduced.

In step S477, the pseudo high-frequency subband power calculating circuit 35 calculates a pseudo high-frequency subband power based on the low-frequency subband power $power_{smooth}(ib, J)$ of each subband on the low-frequency side supplied from the smoothing unit 122, and supplies this to the pseudo high-frequency subband power difference calculating circuit 36.

For example, the pseudo high-frequency subband power calculating circuit 35 performs the calculation of the above-mentioned Expression (2) using the coefficient $A_{ib}(kb)$ and coefficient $B_{ib}$ recorded beforehand as decoded high-frequency subband power estimating coefficients, and the low-frequency subband power $power_{smooth}(ib, J)$ (however, $sb-3 \leq ib \leq sb$) to calculate the pseudo high-frequency subband power $power_{est}(ib, J)$.

Note that, here, the low-frequency subband power power (kb, J) in Expression (2) is replaced with the smoothed low-frequency subband power $power_{smooth}(kb, J)$ (however, $sb-3 \leq kb \leq sb$).

Specifically, the low-frequency subband power $power_{smooth}(kb, J)$ of each subband on the low-frequency side is multiplied by the coefficient $A_{ib}(kb)$ for each subband, and further, the coefficient $B_{ib}$ is added to sum of low-frequency subband powers multiplied by the coefficient, and is taken as the pseudo high-frequency subband power $power_{est}(ib, J)$. This pseudo high-frequency subband power is calculated regarding each subband on the high-frequency side of which the index is sb+1 to eb.

Also, the pseudo high-frequency subband power calculating circuit 35 performs calculation of a pseudo high-frequency subband power for each decoded high-frequency subband power estimating coefficient recorded beforehand. Specifically, regarding all of the recorded coefficient groups, calculation of a pseudo high-frequency subband power is performed for each coefficient set (coefficient $A_{ib}(kb)$ and coefficient $B_{ib}$) of coefficient groups.

In step S478, the pseudo high-frequency subband power difference calculating circuit 36 calculates pseudo high-frequency subband power difference based o the high-frequency subband signal from the subband dividing circuit 33 and the pseudo high-frequency subband power from the pseudo high-frequency subband power calculating circuit 35.

In step S479, the pseudo high-frequency subband power difference calculating circuit 36 calculates the above-mentioned Expression (15) for each decoded high-frequency subband power estimating coefficient to calculate sum of squares of pseudo high-frequency subband power difference (difference sum of squares E(J, id)).

Note that the processes in step S478 and step S479 are the same as the processes in step S186 and step S187 in FIG. 19, and accordingly, detailed description thereof will be omitted.

When calculating the difference sum of squares E(J, id) for each decoded high-frequency subband power estimating coefficient recorded beforehand, the pseudo high-frequency subband power difference calculating circuit 36 selects, of the difference sum of squares thereof, difference sum of squares whereby the value becomes the minimum.

The pseudo high-frequency subband power difference calculating circuit 36 then supplies a coefficient group index and a coefficient index for identifying a decoded high-frequency subband power estimating coefficient corresponding to the selected difference sum of squares, and the smoothing information indicating the smoothing parameter to the high-frequency encoding circuit 37.

Here, the smoothing information may be the value itself of the number-of-frames ns serving as the smoothing parameter determined by the parameter determining unit 121, or may be a flag or the like indicating the number-of-frames ns. For example, in the event that the smoothing information is taken as a 2-bit flag indicating the number-of-frames ns, the value of the flag is set to 0 when the number-of-frames ns=1, the value of the flag is set to 1 when the number-of-frames ns=4, the value of the flag is set to 2 when the number-of-frames ns=8, and the value of the flag is set to 3 when the number-of-frames ns=16.

In step S480, the high-frequency encoding circuit 37 encodes the coefficient group index, coefficient index, and smoothing information supplied from the pseudo high-frequency subband power difference calculating circuit 36, and supplies high-frequency encoded data obtained as a result thereof to the multiplexing circuit 38.

For example, in step S480, entropy encoding or the like is performed on the coefficient group index, coefficient index, and smoothing information. Note that the high-frequency encoded data may be any kind of information as long as the data is information from which the optimal decoded high-frequency subband power estimating coefficient, or the optimal smoothing parameter is obtained, e.g., a coefficient group index or the like may be taken as high-frequency encoded data without change.

In step S481, the multiplexing circuit 38 multiplexes the low-frequency encoded data supplied from the low-frequency encoding circuit 32, and the high-frequency encoded data supplied from the high-frequency encoding circuit 37, outputs an output code string obtained as a result thereof, and the encoding processing is ended.

In this manner, the high-frequency encoded data obtained by encoding the coefficient group index, coefficient index, and smoothing information is output as an output code string, whereby the decoding device 40 which receives input of this output code string may estimate a high-frequency component with higher precision.

Specifically, based on a coefficient group index and a coefficient index, of multiple decoded high-frequency subband power estimating coefficients, the most appropriate coefficient for the frequency band expanding processing may be obtained, and a high-frequency component may be estimated with high precision regardless of coding systems or encoding algorithms. Moreover, if a low-frequency subband power serving as a feature amount is smoothed according to the smoothing information, temporal fluctuation of a high-frequency component obtained by estimation may be reduced, and audio without unnatural sensation in listenability may be obtained regardless of whether or not the input signal is constant or transitory.

[Functional Configuration Example of Decoding Device]

Figure 32:
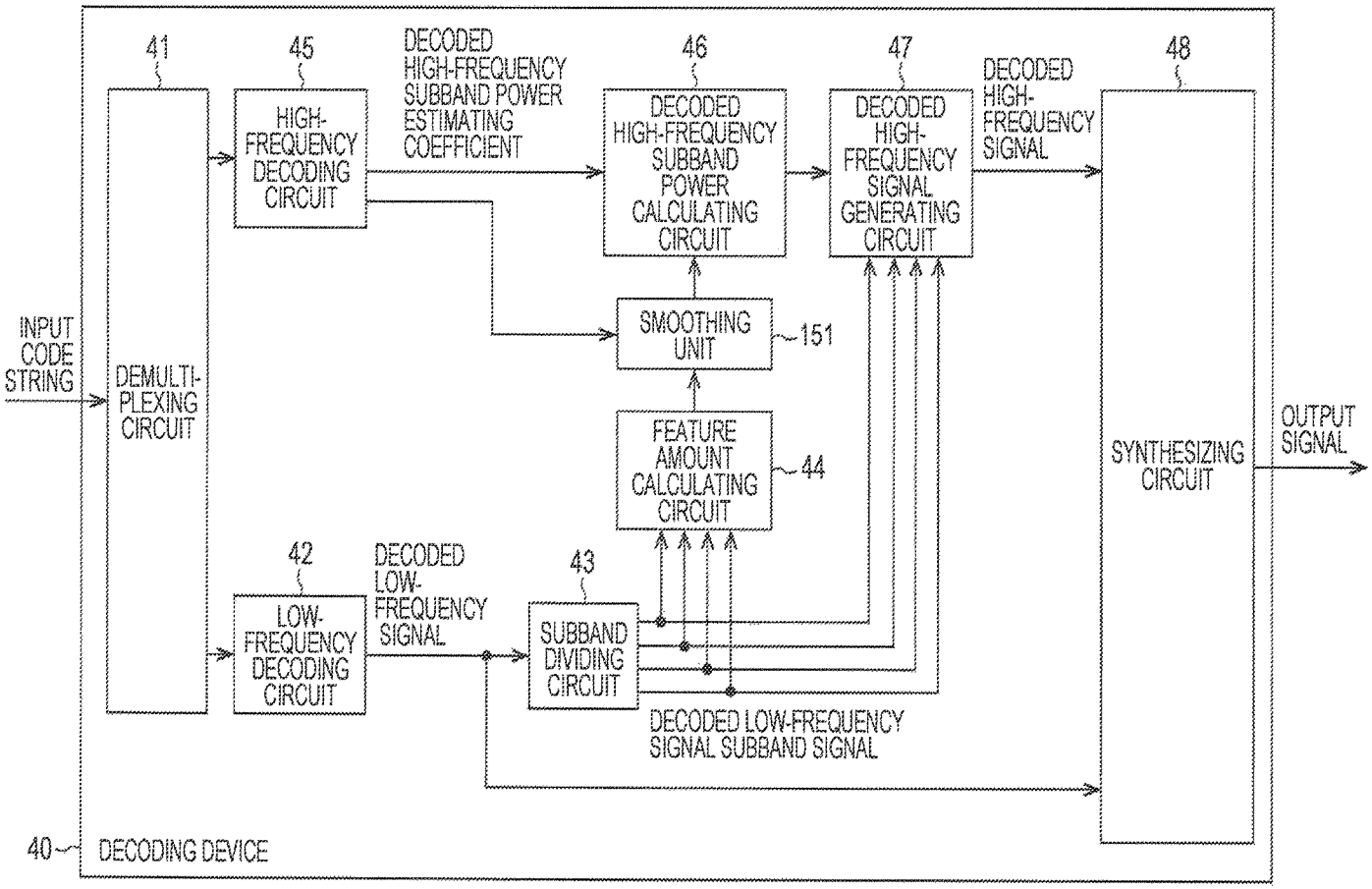
FIG. 32 is a block diagram illustrating a functional configuration example of a decoding device.

Also, the decoding device 40 which inputs the output code string output from the encoding device 30 in FIG. 30 as an input code string is configured as illustrated in FIG. 32, for example. Note that, in FIG. 32, a portion corresponding to the case in FIG. 20 is denoted with the same reference numeral, and description thereof will be omitted.

The decoding device 40 in FIG. 32 differs from the decoding device 40 in FIG. 20 in that a smoothing unit 151 is newly provided, and other points are the same.

With the decoding device 40 in FIG. 32, the high-frequency decoding circuit 45 beforehand records the same decoded high-frequency subband power estimating coefficient as a decoded high-frequency subband power estimating coefficient that the pseudo high-frequency subband power calculating circuit 35 in FIG. 30 records. Specifically, a set of the coefficient $A_{ib}$(kb) and coefficient $B_{ib}$ serving as decoded high-frequency subband power estimating coefficients, obtained beforehand be regression analysis, is recorded in a manner correlated with a coefficient group index and a coefficient index.

The high-frequency decoding circuit 45 decodes the high-frequency encoded data supplied from the demultiplexing circuit 41, and as a result thereof, obtains a coefficient group index, a coefficient index, and smoothing information. The high-frequency decoding circuit 45 supplies a decoded high-frequency subband power estimating coefficient identified from the obtained coefficient group index and coefficient index to the decoded high-frequency subband power calculating circuit 46, and also supplies the smoothing information to the smoothing unit 151.

Also, the feature amount calculating circuit 44 supplies the low-frequency subband power calculated as a feature amount to the smoothing unit 151. The smoothing unit 151 smoothens the low-frequency subband power supplied from the feature amount calculating circuit 44 in accordance with the smoothing information from the high-frequency decoding circuit 45, and supplies this to the decoded high-frequency subband power calculating circuit 46.

[Decoding Processing of Decoding Device]

Figure 33:
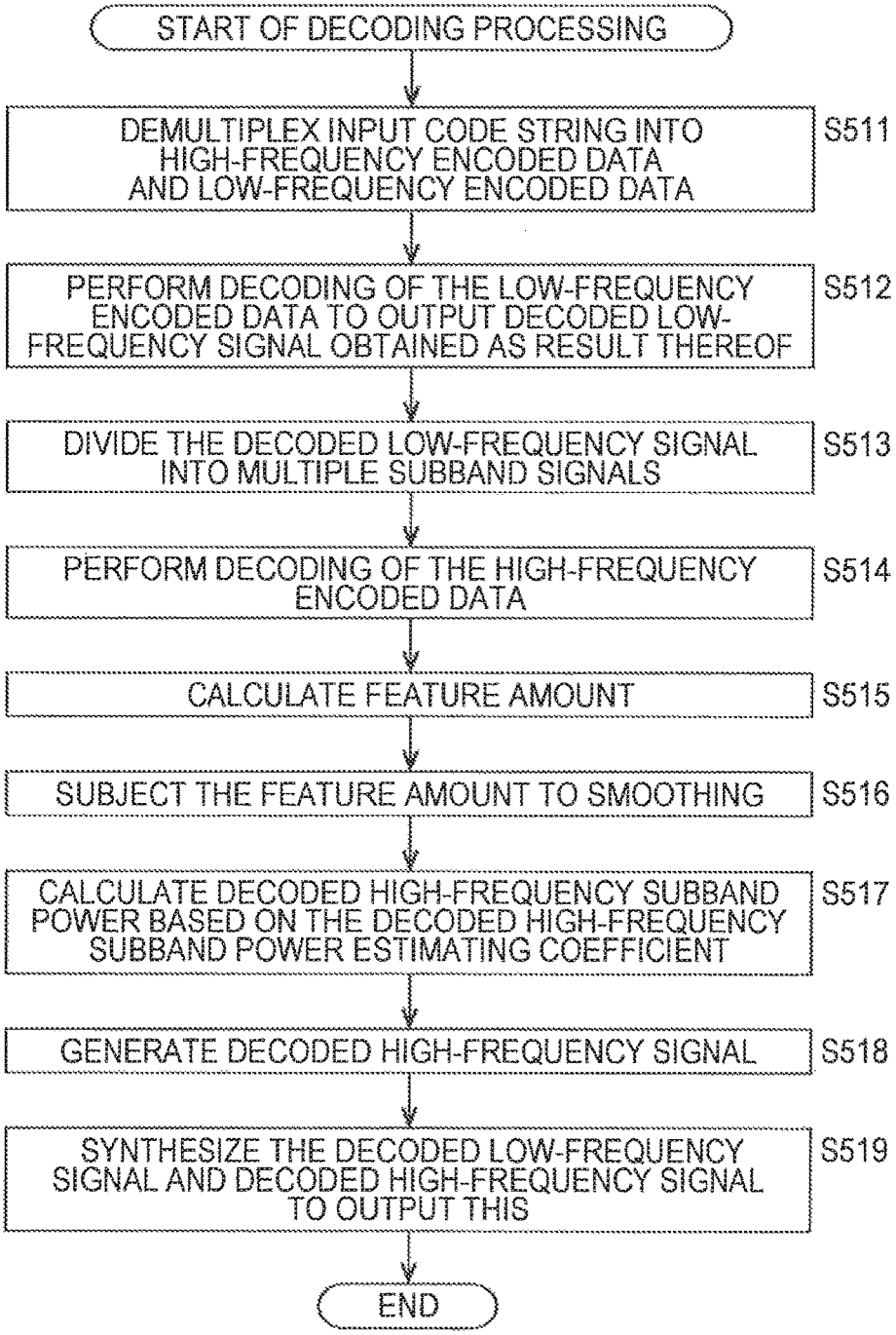
FIG. 33 is a flowchart for describing decoding processing.

Next, decoding processing to be performed by the decoding device 40 in FIG. 32 will be described with reference to the flowchart in FIG. 33.

This decoding processing is started when the output code string output from the encoding device 30 is supplied to the decoding device 40 as an input code string. Note that processes in step S511 to step S513 are the same as the processes in step S211 to step S213 in FIG. 21, and accordingly, description thereof will be omitted.

In step S514, the high-frequency decoding circuit 45 performs decoding of the high-frequency encoded data supplied from the demultiplexing circuit 41.

The high-frequency decoding circuit 45 supplies, of the already recorded multiple decoded high-frequency subband power estimating coefficients, a decoded high-frequency subband power estimating coefficient indicated by the coefficient group index and coefficient index obtained by decoding of the high-frequency encoded data to the decoded high-frequency subband power calculating circuit 46. Also, the high-frequency decoding circuit 45 supplies the smoothing information obtained by decoding of the high-frequency encoded data to the smoothing unit 151.

In step S515, the feature amount calculating circuit 44 calculates a feature amount using the decoded low-frequency subband signal from the subband dividing circuit 43, and supplies this to the smoothing unit 151. Specifically, according to the calculation of the above-mentioned Expression (1), the low-frequency subband power power(ib, J) is calculated as a feature amount regarding each subband ib on the low-frequency side.

In step S516, the smoothing unit 151 smoothens the low-frequency subband power power(ib, J) supplied from the feature amount calculating circuit 44 as a feature amount, based on the smoothing information supplied from the high-frequency decoding circuit 45.

Specifically, the smoothing unit 151 performs the calculation of the above-mentioned Expression (31) based on the number-of-frames ns indicated by the smoothing information to calculate a low-frequency subband power $power_{smooth}$(ib, J) regarding each subband ib on the low-frequency side, and supplies this to the decoded high-frequency subband power calculating circuit 46. Now, let us say that the low-frequency subband powers of the subbands of several frames worth before the frame J are held in the smoothing unit 151.

In step S517, the decoded high-frequency subband power calculating circuit 46 calculates a decoded high-frequency subband power based on the low-frequency subband power from the smoothing unit 151 and the decoded high-frequency subband power estimating coefficient from the high-frequency decoding circuit 45, and supplies this to the decoded high-frequency signal generating circuit 47.

Specifically, the decoded high-frequency subband power calculating circuit 46 performs the calculation of the above-mentioned Expression (2) using the coefficient $A_{ib}$(kb) and coefficient $B_{ib}$ serving as decoded high-frequency subband power estimating coefficients, and the low-frequency subband power $power_{smooth}$(ib, J) to calculate a decoded high-frequency subband power.

Note that, here, the low-frequency subband power power (kb, J) in Expression (2) is replaced with the smoothed low-frequency subband power $power_{smooth}$(kb, J) (however, sb−3≤kb≤sb). According to this calculation, the decoded high-frequency subband power $power_{est}$(ib, J) is obtained regarding each subband on the high-frequency side of which the index is sb+1 to eb.

In step S518, the decoded high-frequency signal generating circuit 47 generates a decoded high-frequency signal based on the decoded low-frequency subband signal supplied from the subband dividing circuit 43, and the decoded high-frequency subband power supplied from the decoded high-frequency subband power calculating circuit 46.

Specifically, the decoded high-frequency signal generating circuit 47 performs the calculation of the above-mentioned Expression (1) using the decoded low-frequency subband signal to calculate a low-frequency subband power regarding each subband on the low-frequency side. The decoded high-frequency signal generating circuit 47 then performs the calculation of the above-mentioned Expression (3) using the obtained low-frequency subband power and decoded high-frequency subband power to calculate the gain amount G(ib, J) for each subband on the high-frequency side.

Also, the decoded high-frequency signal generating circuit 47 performs the calculations of the above-mentioned Expression (5) and Expression (6) using the gain amount G(ib, J) and decoded low-frequency subband signal to generate a high-frequency subband signal x3(ib, n) regarding each subband on the high-frequency side.

Further, the decoded high-frequency signal generating circuit 47 performs the calculation of the above-mentioned Expression (7) to obtain sum of the obtained high-frequency subband signals, and to generate a decoded high-frequency signal. The decoded high-frequency signal generating circuit 47 supplies the obtained decoded high-frequency signal to the synthesizing circuit 48, and the processing proceeds from step S518 to step S519.

In step S519, the synthesizing circuit 48 synthesizes the decoded low-frequency signal from the low-frequency decoding circuit 42, and the decoded high-frequency signal from the decoded high-frequency signal generating circuit 47, and outputs this as an output signal. Thereafter, the decoding processing is ended.

As described above, according to the decoding device 40, a decoded high-frequency subband power is calculated using a decoded high-frequency subband power estimating coefficient identified by the coefficient group index and coefficient index obtained from the high-frequency encoded data, whereby estimation precision of a high-frequency subband power may be improved. Specifically, multiple decoded high-frequency subband power estimating coefficients whereby difference of coding systems or encoding algorithms may be handled are recorded beforehand in the decoding device 40. Accordingly, of these, the optimal decoded high-frequency subband power estimating coefficient identified by a coefficient group index and a coefficient index is selected and employed, whereby high-frequency components may be estimated with high precision.

Also, with the decoding device 40, a low-frequency subband power is smoothed in accordance with smoothing information to calculate a decoded high-frequency subband power. Accordingly, temporal fluctuation of a high-frequency envelope may be suppressed small, and audio without unnatural sensation in listenability may be obtained regardless of whether the input signal is constant or transitory.

Though description has been made so far wherein the number-of-frames ns is changed as a smoothing parameter, the weight SC(l) by which the low-frequency subband powers power(ib, J) are multiplied at the time of the smoothing, with the number-of-frames ns as a fixed value, may be taken as a smoothing parameter. In such a case, the parameter determining unit 121 changes the weight SC(l) as a smoothing parameter, thereby changing smoothing characteristics.

In this manner, the weight SC(l) is also taken as a smoothing parameter, whereby temporal fluctuation of a high-frequency envelope may suitably be suppressed for a constant input signal and a transitory input signal on the decoding side.

For example, in the event that the weight SC(l) in the above-mentioned Expression (31) is taken as weight to be determined by a function indicated in the following Expression (33), a tracking degree for a more transitory signal than the case of employing weight indicated in Expression (32) may be improved.

[Mathematical Expression 33]

$$SC(l) = \frac{\cos\left(\frac{2\cdot\pi\cdot l}{4\cdot \mathrm{ns}}\right)}{\sum_{li=0}^{ns-1}\cos\left(\frac{2\cdot\pi\cdot li}{4\cdot \mathrm{ns}}\right)} \tag{33}$$

Note that, in Expression (33), ns indicates the number-of-frames ns of an input signal to be used for smoothing.

In the event that the weight SC(l) is taken as a smoothing parameter, the parameter determining unit 121 determines the weight SC(l) serving as a smoothing parameter based on the high-frequency subband signal. Smoothing information indicating the weight SC(l) serving as a smoothing parameter is taken as high-frequency encoded data, and is transmitted to the decoding device 40.

In this case as well, for example, the value itself of the weight SC(l), i.e., weight SC(0) to weight SC(ns−1) may be taken as smoothing information, or multiple weights SC(l) are prepared beforehand, and of these, an index indicating the selected weight SC(l) may be taken as smoothing information.

With the decoding device 40, the weight SC(l) obtained by decoding of the high-frequency encoded data, and identified by the smoothing information is employed to perform smoothing of a low-frequency subband power. Further, both of the weight SC(l) and the number-of-frames ns are taken as smoothing parameters, and an index indicating the weight SC(l), and a flag indicating the number-of-frames ns, and so forth may be taken as smoothing information.

Further, though description has been made regarding a case where the third embodiment is applied as an example wherein multiple coefficient groups are prepared beforehand, and a low-frequency subband power serving as a feature amount is smoothed, this example may be applied to any of the above-mentioned first embodiment to fifth embodiment. That is to say, with a case where this example is applied to any of the embodiments as well, a feature amount is smoothed in accordance with a smoothing parameter, and the feature amount after the smoothing is employed to calculate the estimated value of the subband power of each subband on the high-frequency side.

The above-described series of processing may be executed not only by hardware but also by software. In the event of executing the series of processing using software, a program making up the software thereof is installed from a program recording medium to a computer built into dedicated hardware, or for example, a general-purpose personal computer or the like whereby various functions may be executed by installing various programs.

Figure 34:
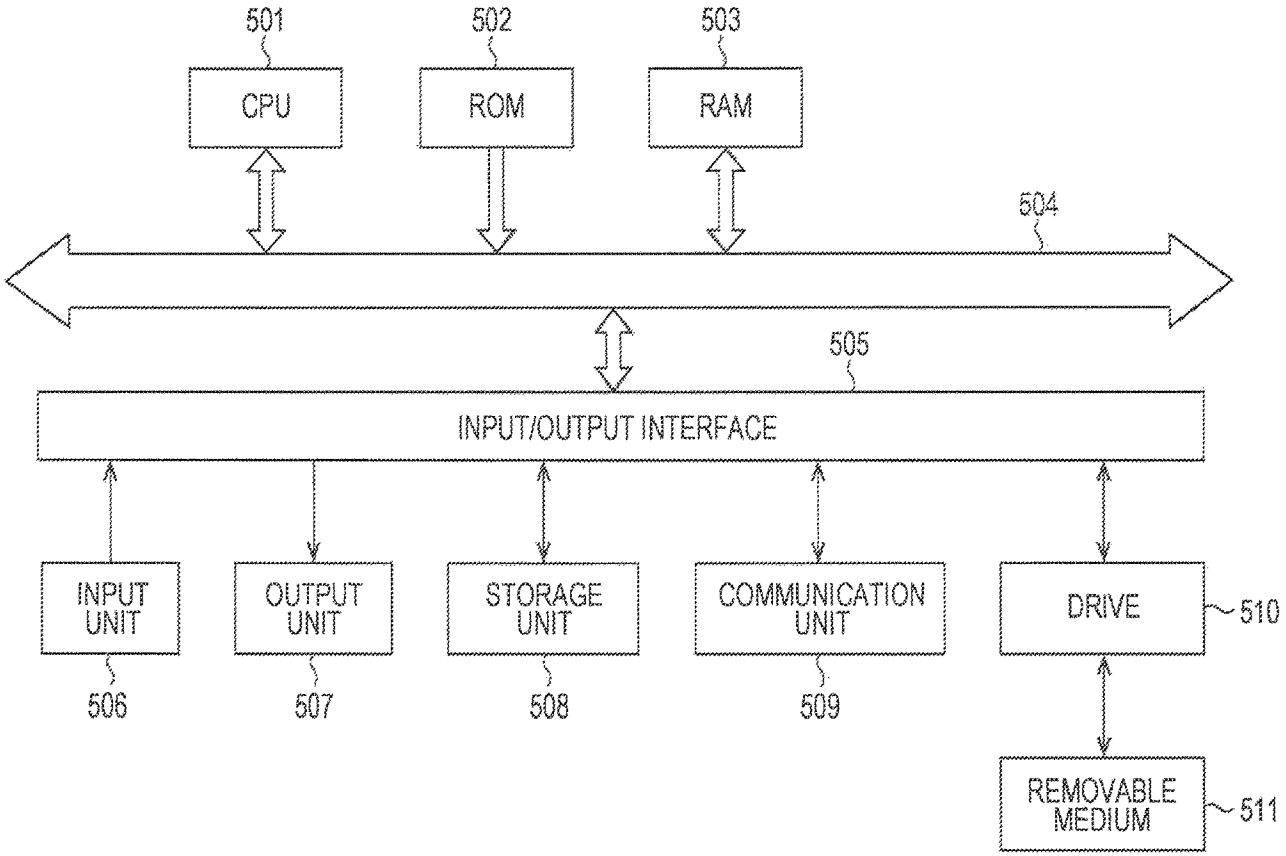
FIG. 34 is a block diagram illustrating a configuration example of hardware of a computer which executes processing to which the present invention is applied using a program.

FIG. 34 is a block diagram illustrating a configuration example of hardware of a computer which executes the above-mentioned series of processing using a program.

With the computer, a CPU 501, ROM (Read Only Memory) 502, and RAM (Random Access Memory) 503 are mutually connected by a bus 504.

Further, an input/output interface 505 is connected to the bus 504. There are connected to the input/output interface 505 an input unit 506 made up of a keyboard, mouse, microphone, and so forth, an output unit 507 made up of a display, speaker, and so forth, a storage unit 508 made up of a hard disk, nonvolatile memory, and so forth, a communication unit 509 made up of a network interface and so forth, and a drive 510 which drives a removable medium 511 such as a magnetic disk, optical disc, magneto-optical disk, semiconductor memory, or the like.

With the computer thus configured, the above-mentioned series of processing is performed by the CPU 501 loading a program stored in the storage unit 508 to the RAM 503 via the input/output interface 505 and bus 504, and executing this, for example.

The program that the computer (CPU 501) executes is provided by being recorded in the removable medium 511 which is a package medium made up of, for example, a magnetic disk (including a flexible disk), an optical disc (CD-ROM (Compact Disc-Read Only), DVD (Digital Versatile Disc), etc.), a magneto-optical disk, semiconductor memory, or the like, or provided via a cable or wireless transmission medium such as a local area network, the Internet, a digital satellite broadcast, or the like.

The program may be installed on the storage unit 508 via the input/output interface 505 by mounting the removable medium 511 on the drive 510. Also, the program may be installed on the storage unit 508 by being received at the communication unit 509 via a cable or wireless transmission medium. Additionally, the program may be installed on the ROM 502 or storage unit 508 beforehand.

Note that the program that the computer executes may be a program of which the processing is performed in a time-series manner along sequence described in the present Specification, or a program of which the processing is performed in parallel, or at the required timing such as call-up being performed, or the like.

Note that embodiments of the present invention are not restricted to the above-mentioned embodiments, and various modifications may be made without departing from the essence of the present invention.

REFERENCE SIGNS LIST

10 frequency band expanding device
11 low-pass filter
12 delay circuit
13, 13-1 to 13-N band pass filter
14 feature amount calculating circuit
15 high-frequency subband power estimating circuit
16 high-frequency signal generating circuit
17 high-pass filter
18 signal adder
20 coefficient learning device
21, 21-1 to 21-(K+N) band pass filter
22 high-frequency subband power calculating circuit
23 feature amount calculating circuit
24 coefficient estimating circuit
30 encoding device
31 low-pass filter
32 low-frequency encoding circuit
33 subband dividing circuit
34 feature amount calculating circuit
35 pseudo high-frequency subband power calculating circuit
36 pseudo high-frequency subband power difference calculating circuit
37 high-frequency encoding circuit
38 multiplexing circuit
40 decoding device
41 demultiplexing circuit
42 low-frequency decoding circuit
43 subband dividing circuit
44 feature amount calculating circuit
45 high-frequency decoding circuit
46 decoded high-frequency subband power calculating circuit
47 decoded high-frequency signal generating circuit
48 synthesizing circuit
50 coefficient learning device
51 low-pass filter
52 subband dividing circuit
53 feature amount calculating circuit
54 pseudo high-frequency subband power calculating circuit
55 pseudo high-frequency subband power difference calculating circuit
56 pseudo high-frequency subband power difference clustering circuit
57 coefficient estimating circuit
121 parameter determining unit
122 smoothing unit
151 smoothing unit

The invention claimed is:

1. A decoding device comprising:

a demultiplexing circuit configured to demultiplex input encoded data into low-frequency encoded data, coefficient information for obtaining a coefficient set, and smoothing information relating to smoothing;

a low-frequency decoding circuit configured to decode the low-frequency encoded data to generate a low-frequency signal;

a subband dividing circuit configured to divide the low-frequency signal into a plurality of subbands to generate a low-frequency subband signal for each of the subbands;

a feature amount calculating circuit configured to calculate a feature amount based on the low-frequency subband signals;

a smoothing circuit configured to subject the feature amount to smoothing based on the smoothing information indicating the number of frames used for the smoothing;

a generating circuit configured to generate a high-frequency signal based on the coefficient set obtained from the coefficient information, the feature amount subjected to smoothing, and the low-frequency subband signals; and a synthesizing circuit configured to synthesize an output signal based on the low-frequency signal and the high-frequency signal and outputting the output signal.

2. A decoding method comprising:

demultiplexing, by processing circuitry, input encoded data into low-frequency encoded data, coefficient information for obtaining a coefficient set, and smoothing information relating to smoothing;

decoding, by the processing circuitry, the low-frequency encoded data to generate a low-frequency signal;

dividing, by the processing circuitry, the low-frequency signal into a plurality of subbands to generate a low-frequency subband signal for each of the subbands;

calculating, by the processing circuitry, a feature amount based on the low-frequency subband signals;

subjecting, by the processing circuitry, the feature amount to smoothing based on the smoothing information indicating the number of frames used for the smoothing;

generating, by the processing circuitry, a high-frequency signal based on the coefficient set obtained from the coefficient information, the feature amount subjected to smoothing, and the low-frequency subband signals; and synthesizing, by the processing circuitry, an output signal based on the low-frequency signal and the high-frequency signal and outputting the output signal.

3. A non-transitory computer-readable medium storing computer-executable instructions that, when executed by a computer, cause the computer to execute processing comprising:

demultiplexing input encoded data into low-frequency encoded data, coefficient information for obtaining a coefficient set, and smoothing information relating to smoothing;

decoding the low-frequency encoded data to generate a low-frequency signal;

dividing the low-frequency signal into a plurality of subbands to generate a low-frequency subband signal for each of the subbands;

calculating a feature amount based on the low-frequency subband signals;

subjecting the feature amount to smoothing based on the smoothing information indicating the number of frames used for the smoothing;

generating a high-frequency signal based on the coefficient set obtained from the coefficient information, the feature amount subjected to smoothing, and the low-frequency subband signals; and synthesizing an output signal based on the low-frequency signal and the high-frequency signal and outputting the output signal.

* * * * *